US009203150B2

(12) United States Patent
Tatarnikov et al.

(10) Patent No.: US 9,203,150 B2
(45) Date of Patent: Dec. 1, 2015

(54) COMPACT ANTENNA SYSTEM

(75) Inventors: Dmitry Vitalievich Tatarnikov, Moscow (RU); Andrey Vitalievich Astakhov, Moscow (RU); Pavel Petrovich Shamatulskiy, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 95 days.

(21) Appl. No.: 14/343,995

(22) PCT Filed: Aug. 9, 2012

(86) PCT No.: PCT/RU2012/000652
§ 371 (c)(1),
(2), (4) Date: Mar. 10, 2014

(87) PCT Pub. No.: WO2014/025280
PCT Pub. Date: Feb. 13, 2014

(65) Prior Publication Data

US 2015/0077299 A1 Mar. 19, 2015

(51) Int. Cl.
*H01Q 1/00* (2006.01)
*H01Q 5/00* (2015.01)
(Continued)

(52) U.S. Cl.
CPC ..... *H01Q 5/0037* (2013.01); *H01Q 1/1242* (2013.01); *H01Q 5/0062* (2013.01);
(Continued)

(58) Field of Classification Search
CPC ... H01Q 9/0464; H01Q 1/1242; H01Q 19/00; H01Q 5/40; H01Q 5/0037; H01Q 21/29; H01Q 7/00
USPC ..... 343/749, 729, 730, 829, 833
See application file for complete search history.

(56) References Cited

U.S. PATENT DOCUMENTS 6,369,770 B1 4/2002 Gothard et al.
6,956,529 B1 10/2005 Chen
(Continued)

FOREIGN PATENT DOCUMENTS

EP 1503176 A2 2/2005
RU 2057386 C1 3/1996
(Continued)

OTHER PUBLICATIONS

Extended Search Report mailed Jun. 30, 2015, and received on Jul. 1, 2015, in connection with European Patent Application No. 12882562.7, 9 pgs.
(Continued)

*Primary Examiner* — Brian Young
(74) *Attorney, Agent, or Firm* — Chiesa Shahinian & Giantomasi PC

(57) ABSTRACT

An antenna system for global navigation satellite systems includes a ground plane, an active antenna disposed above the ground plane, and a passive antenna disposed below the ground plane. The active antenna includes a conducting ring substantially parallel to the ground plane. A radiating conductor passes through substantially the center of the conducting ring; the ends of the radiating conductor are electrically connected to the conducting ring. An excitation pin is electrically connected to the radiating conductor. A set of reactive impedance elements is electrically connected between the conducting ring and the ground plane. The set of reactive impedance elements is disposed substantially orthogonal to the ground plane. The passive antenna is similar to the active antenna, except the passive antenna does not have an excitation pin. The antenna system effectively suppresses multipath reception, and its compact size and light weight make it suitable for integration with a surveying pole.

51 Claims, 43 Drawing Sheets

VIEW P1

(51) Int. Cl.

| | |
|---|---|
| ***H01Q 23/00*** | (2006.01) |
| ***H01Q 5/328*** | (2015.01) |
| ***H01Q 1/12*** | (2006.01) |
| ***H01Q 9/04*** | (2006.01) |
| ***H01Q 19/00*** | (2006.01) |
| ***H01Q 5/40*** | (2015.01) |

(52) U.S. Cl.
CPC ..... *H01Q 5/328* (2015.01); *H01Q 5/40* (2015.01); *H01Q 9/0464* (2013.01); *H01Q 19/00* (2013.01); *H01Q 23/00* (2013.01)

(56) References Cited

U.S. PATENT DOCUMENTS

| | | | | |
|---|---|---|---|---|
| 7,394,440 | B2 * | 7/2008 | Goldberg | 343/893 |
| 7,463,201 | B2 * | 12/2008 | Chiang et al. | 343/702 |
| 7,609,648 | B2 * | 10/2009 | Hoffmann et al. | 370/252 |
| 8,952,859 | B2 * | 2/2015 | Tan | 343/803 |
| 2007/0085742 | A1 | 4/2007 | Kikin | |
| 2010/0211314 | A1 | 8/2010 | Zhukov et al. | |

FOREIGN PATENT DOCUMENTS

| | | | |
|---|---|---|---|
| RU | 2058635 | C1 | 4/1996 |
| WO | 2004027920 | A2 | 4/2004 |
| WO | 2011061589 | A1 | 5/2011 |

OTHER PUBLICATIONS

International Search Report issued for the counterpart International Patent Application No. PCT/RU12/000652, 3 pgs.

International Written Opinion issued for the counterpart International Patent Application No. PCT/RU12/000652, 4 pgs.

* cited by examiner

PRIOR ART

VIEW A

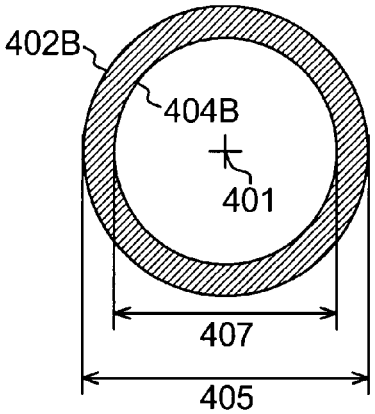
VIEW X-X'
FIG. 4B
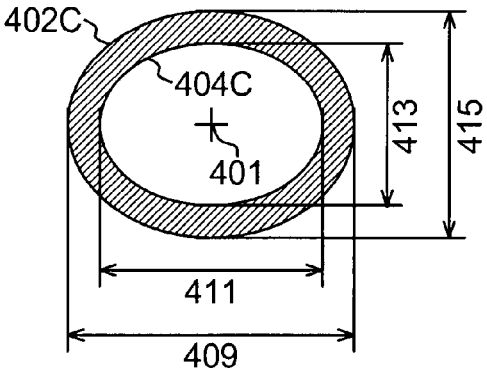
VIEW X-X'
FIG. 4C
FIG. 4D
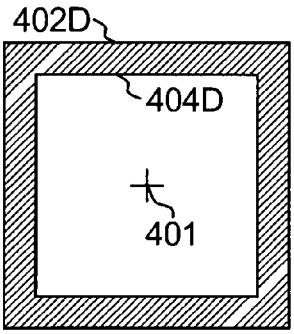
VIEW X-X'
FIG. 4E
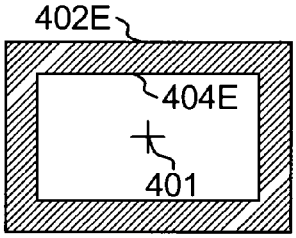
VIEW X-X'
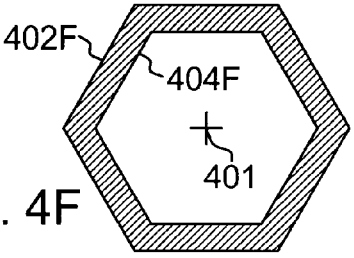
VIEW X-X'
FIG. 4F

VIEW B
302
502
506
501
503
VIEW A 501
502
506
VIEW B 502
501
506
VIEW B 507
501
505
506
502
VIEW B 506
502
501
VIEW B 503
501
502
506
VIEW B

VIEW F

VIEW P9

VIEW I

VIEW H

COMPACT ANTENNA SYSTEM

BACKGROUND OF THE INVENTION

The present invention relates generally to antennas, and more particularly to a compact antenna system with a reduced directional pattern in the backward hemisphere.

Global navigation satellite systems (GNSSs) can determine locations with high accuracy. Currently deployed GNSSs include the United States Global Positioning System (GPS) and the Russian GLONASS. Other GNSSs, such as the European GALILEO system, are under development. GNSSs are used in a wide range of applications, such as surveying, geology, and mapping.

In a GNSS, a navigation receiver receives and processes radio signals transmitted by satellites located within a line-of-sight of the navigation receiver. A critical component of a GNSS is the receiver antenna. Key properties of the antenna are bandwidth, multipath rejection, size, and weight.

High-accuracy navigation receivers typically process signals from two frequency bands. Two common frequency bands are a low-frequency band in the range of 1164-1300 MHz and a high-frequency band in the range of 1525-1610 MHz.

For portable navigation receivers, antennas with light weight and compact size are desirable. In surveying applications, for example, an antenna is mounted on a surveying pole. The dimensions of the antenna should be sufficiently small to accommodate mounting on a standard surveying pole. The weight of the antenna should also be small enough to ensure easy handling of the pole-mounted assembly: if the weight is excessive, the center-of-gravity is raised too high, and the pole-mounted assembly is unwieldy.

Navigation receivers achieve the highest accuracy when they receive only the direct, line-of-sight, radio signals from the satellites. Navigation receivers, however, typically operate in environments in which the radio signals reflect off environmental surfaces, such as earth and water, and objects, such as buildings, towers, and vehicles. Reflected signals that are detected by the navigation receiver are referred to as multipath signals. Multipath signals reduce the accuracy with which the position of the navigation receiver can be determined.

Antennas that reject or suppress the reception of multipath signals, therefore, are desirable. PCT International Publication No. WO 2004/027920 (I. Soutiaguine et al.), for example, describes an antenna system that operates over a wide bandwidth and reduces multipath reception of GPS signals. FIG. 1 shows a cross-sectional view of the antenna system 100, which includes two micropatch antennas. The micropatch antenna 120 is a directly-excited active antenna; the micropatch antenna 130 is a passive antenna excited by the field of the active micropatch antenna 120.

The active micropatch antenna 120 includes the ground plane 102 and the radiating patch 104. The ground plane 102 and the radiating patch 104 are separated by the dielectric substrate 106. The radiating patch 104 is actively driven by the excitation pin 108.

The passive micropatch antenna 130 includes the ground plane 102 and the radiating patch 110. The ground plane 102 and the radiating patch 110 are separated by the dielectric substrate 112. The radiating patch 110 has no excitation pin and is driven by the field from the active micropatch antenna 120.

The fields of the micropatch antenna 120 and the micropatch antenna 130 are mutually suppressed in the backward hemisphere; consequently, the level of the directional pattern in the backward hemisphere is reduced. The antenna system 100, however, suppresses the multipath signal only within a narrow bandwidth; and the stacked antenna construction has the further disadvantages of heavy weight and large dimensions.

The operating bandwidth for the antenna system 100 is dependent on the distance between the radiating patch 104 and the ground plane 102. To reduce the antenna dimensions and expand the directional pattern in the forward hemisphere, the space between the radiating patch 104 and the ground plane 102 is filled with the dielectric substrate 106. Suitable dielectric materials over the operating frequency bands, however, have a high density; consequently, the weight of the antenna system increases significantly.

As discussed above, in surveying applications, an antenna is mounted on a surveying pole. Examples of pole-mounted GPS antennas are given in European Patent Application Publication No. EP 1503176 (F. Ohtomo et al.) and United States Patent Application Publication No. 20100211314 (Zhukov et al.). In both instances, the antenna extends considerably beyond the pole (particularly along lateral dimensions), and the configuration of outer mounting elements reduces the stability of the overall pole-mounted assembly.

A GNSS antenna with compact size, low weight, and high multipath rejection is therefore advantageous. An antenna that can operate over dual frequency bands and that can be readily mounted onto a standard surveying pole, while maintaining ease of handling, is further advantageous.

BRIEF SUMMARY OF THE INVENTION

In an embodiment, an antenna system includes a ground plane, an active antenna disposed above the ground plane, and a passive antenna disposed below the ground plane. The ground plane is substantially flat, with a top surface, a bottom surface, a perimeter, and a normal axis substantially coincident with the antenna axis.

The active antenna includes a first conducting ring substantially parallel to the top surface of the ground plane and disposed above the top surface of the ground plane. A first radiating conductor passes through substantially the center of the first conducting ring; the ends of the first radiating conductor are electrically connected to the first conducting ring. An excitation pin is electrically connected to the first radiating conductor.

A first set of reactive impedance elements is electrically connected between the first conducting ring and the top surface of the ground plane. The first set of reactive impedance elements is disposed substantially parallel to the antenna axis.

The passive antenna includes a second conducting ring substantially parallel to the bottom surface of the ground plane and disposed below the bottom surface of the ground plane. A second radiating conductor passes through substantially the center of the second conducting ring; the ends of the second radiating conductor are electrically connected to the conducting ring. The passive antenna does not include an excitation pin.

A second set of reactive impedance elements is electrically connected between the second conducting ring and the bottom surface of the ground plane. The second set of reactive impedance elements is disposed substantially parallel to the antenna axis.

Embodiments of the antenna system can be configured for linearly-polarized radiation or circularly-polarized radiation. Embodiments of the antenna can be configured for single-frequency band or dual-frequency band operation. Embodiments of the antenna system can be inexpensively manufactured with flexible printed circuit boards. Embodiments of the antenna system are light weight and compact and can be readily integrated with a surveying pole for applications with global navigation satellite systems.

These and other advantages of the invention will be apparent to those of ordinary skill in the art by reference to the following detailed description and the accompanying drawings.

BRIEF DESCRIPTION OF THE DRAWINGS

FIG. 4A-FIG. 4F show examples of geometrical configurations of tubular substrates;

DETAILED DESCRIPTION

Figure 1:
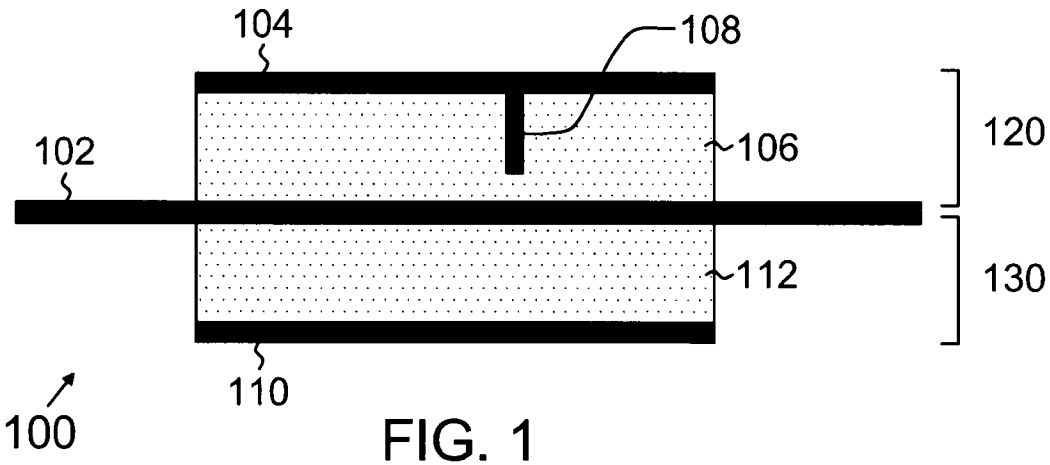
FIG. 1 shows a schematic of a prior-art patch antenna.
Figure 2:
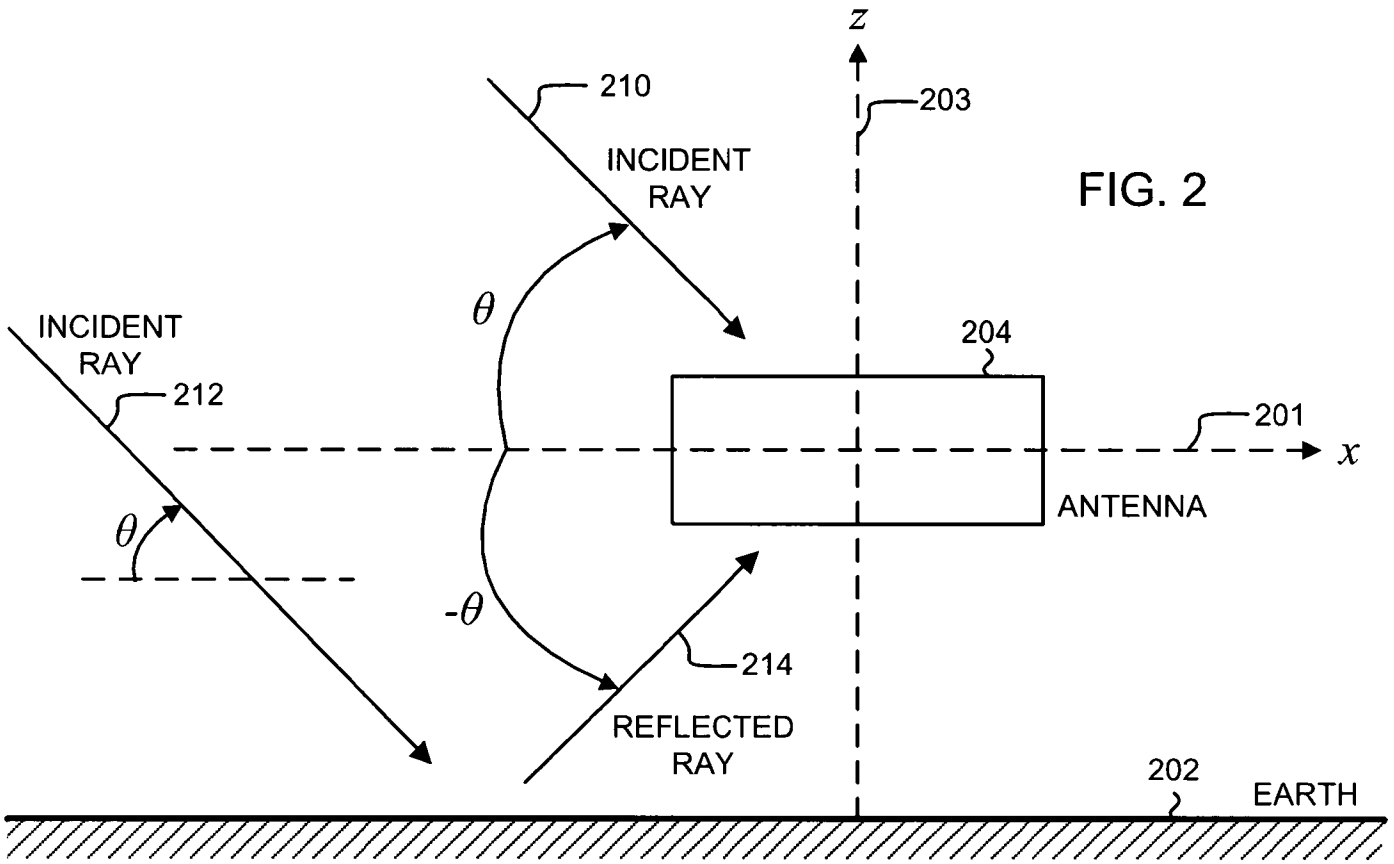
FIG. 2 shows a reference geometry for incident and reflected rays.

FIG. 2 shows a schematic of an antenna 204 positioned above the Earth 202. The antenna 204, for example, can be mounted on a surveying pole (not shown) for surveying applications. The plane of the figure is the x-z plane, defined by the x-axis 201 and the z-axis 203. The +y direction points into the plane of the figure. In an open-air environment, the +z (up) direction, also referred to as the zenith, points towards the sky, and the −z (down) direction points towards the Earth. The horizon falls on the x-y plane. Herein, the term Earth includes both land and water environments. To avoid confusion with "electrical" ground, as used in reference to a ground plane, "geographical" ground, as used in reference to land, is not used herein.

In FIG. 2, electromagnetic waves are represented as rays, incident upon the antenna 204 at an incident angle θ with respect to the x-axis. The horizon corresponds to θ=0 deg. Rays incident from the open sky, such as the ray 210 and the ray 212, have positive values of incident angle. Rays reflected from the Earth 202, such as the ray 214, have negative values of incident angle. Herein, the region of space with positive values of incident angle is referred to as the direct signal region. The direct signal region is also referred to as the forward hemisphere and as the top hemisphere. Herein, the region of space with negative values of incident angle is referred to as the multipath signal region. The multipath signal region is also referred to as the backward hemisphere and as the bottom hemisphere. The incident ray 210 impinges directly on the antenna 204. The incident ray 212 impinges directly on the Earth 202. The reflected ray 214, resulting from reflection of the incident ray 212 off the Earth 202, impinges on the antenna 204.

To quantitatively characterize the capability of an antenna to reject or suppress the reflected signal, the following ratio is commonly used:

$$DU(\theta) = \frac{F(-\theta)}{F(\theta)}. \tag{E1}$$

The parameter DU(θ) (down/up ratio) is equal to the ratio of the antenna directional pattern (DP) level F(−θ) in the backward hemisphere to the antenna directional pattern level F(θ) in the forward hemisphere at the mirror angle, where F represents a voltage level. Expressed in dB, the ratio is:

$$DU(\theta)(\text{dB}) = 20 \log DU(\theta). \tag{E2}$$

Compact, light-weight antenna systems with high rejection of multipath signals in the backward hemisphere are described below. Embodiments of the invention are described for antenna systems configured to receive or transmit electromagnetic radiation with the following characteristics: (1) single-frequency band, linearly-polarized radiation, (2) single-frequency band, circularly-polarized radiation, (3) dual-frequency band, linearly-polarized radiation, and (4) dual-frequency band, circularly-polarized radiation. An antenna system configured for electromagnetic radiation with specific characteristics refers to an antenna system configured to receive or transmit electromagnetic radiation with the specific characteristics. From the well-known antenna reciprocity theorem, antenna properties, such as directional pattern, in the transmit mode correspond to antenna properties in the receive mode.

Figure 3A:
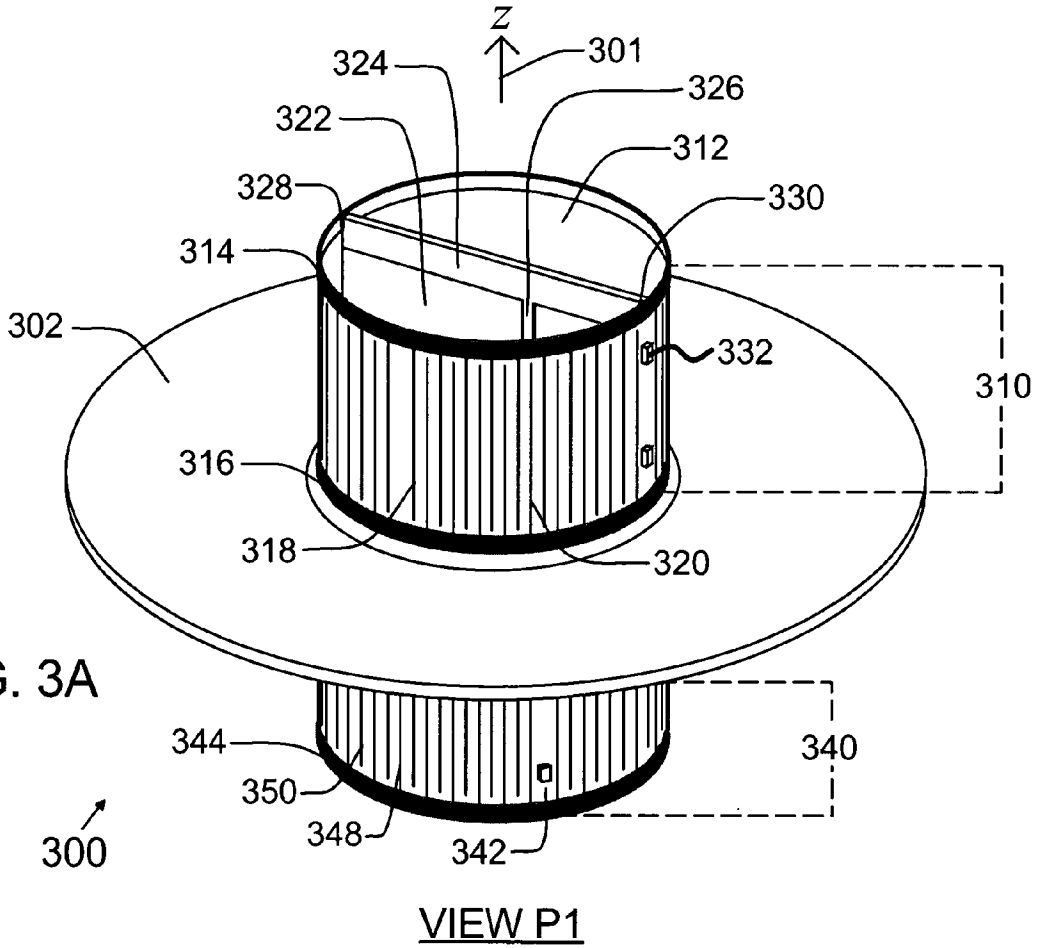
FIG. 3A and FIG. 3B show an embodiment of a single-frequency band antenna for linearly-polarized radiation.
Figure 3B:
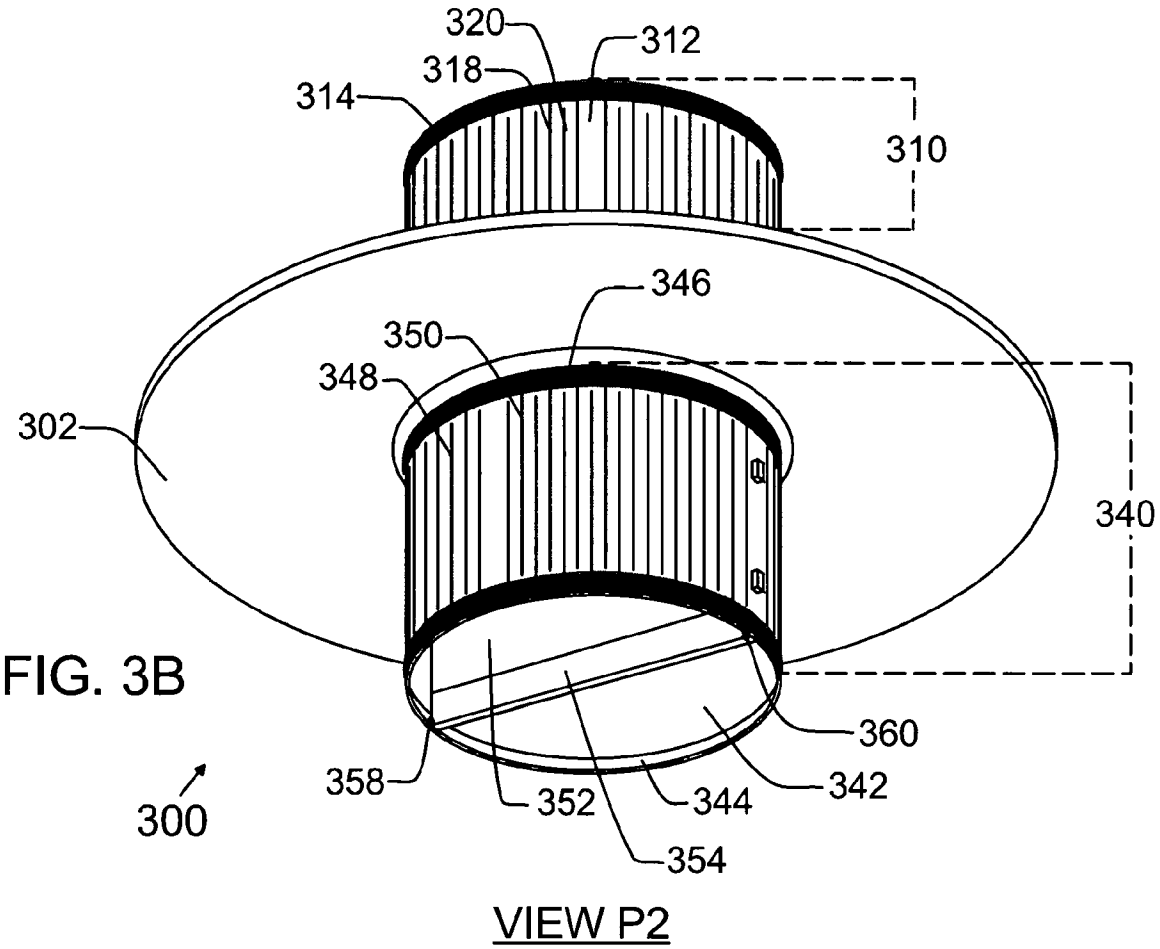

FIG. 3A and FIG. 3B show perspective views of a single-frequency band antenna system configured for linearly-polarized radiation. The overall antenna system is first described; details of various components then follow. The antenna system 300 includes the active antenna 310, the passive antenna 340, and the ground plane 302. In operation, the active antenna 310 faces towards the sky, and the passive antenna 340 faces towards the Earth. The antenna axis (also referred to as the longitudinal axis) 301 points along the +z axis.

Herein, an active antenna refers to an antenna whose radiating element has an excitation pin, and a passive antenna refers to an antenna whose radiating element has no excitation pin. In the transmit mode of the antenna, the excitation pin is coupled to the output of a transmitter, and the excitation pin is driven by signals from the transmitter. In the receive mode of the antenna, the excitation pin is coupled to the input of a receiver. Signals received by the active antenna are typically transmitted from the excitation pin to the input of a low-noise amplifier (LNA) in the receiver. There can be intermediate components, such as combiners and splitters, cables, and connector ports, between the excitation pin and the output of the transmitter or the input of the receiver.

Refer to FIG. 3A (View P1). The active antenna 310 includes the tubular dielectric substrate 312. In an embodiment, the tubular dielectric substrate 312 is fabricated from a flexible printed circuit board (PCB) that is rolled into a tube. Single-sided or double-sided metallization can be used. At one end of the tubular dielectric substrate 312 is the conducting ring 314. At the other end of the tubular dielectric substrate 312 is the conducting ring 316, which is electrically connected to the ground plane 302.

Inside the tubular dielectric substrate 312 is the planar dielectric substrate 322, such as a printed circuit board; single-sided or double-sided metallization can be used. On the planar dielectric substrate 322 are the radiating conductor 324 and the excitation pin 326. The excitation pin 326 is connected via a power line to an antenna port (not shown). A low-noise amplifier (not shown) is then connected to the antenna port. The position of the excitation pin 326 is specified to provide the desired matching input impedance.

The radiating conductor 324 is electrically connected to the conducting ring 314; for example, via the solder joint 328 and the solder joint 330. The planar dielectric substrate 322 is secured to the tubular dielectric substrate 312 via the fastener tabs 332. The planar dielectric substrate 322 provides structural reinforcement for the tubular dielectric substrate 312.

To reduce the cross-sectional dimensions of the antenna system, the set of impedance elements 318 is electrically connected to the conducting ring 314, and the set of impedance elements 320 is electrically connected to the conducting ring 316. Cross-sectional dimensions, also referred to as lateral dimensions, refer to dimensions measured orthogonal to the antenna axis 301. Axial dimensions, also referred to as vertical dimensions or height dimensions or longitudinal dimensions, refer to dimensions measured parallel to the antenna axis 301. More details of the impedance elements are described below.

Refer to FIG. 3B (View P2). The passive antenna 340 is similar to the active antenna 310. The passive antenna 340 is driven by the electromagnetic field from the active antenna 310; that is, the passive antenna 340 is electromagnetically coupled to the active antenna 310. The passive antenna 340 includes the tubular dielectric substrate 342. At one end of the tubular dielectric substrate 342 is the conducting ring 344. At the other end of the tubular dielectric substrate 342 is the conducting ring 346, which is electrically connected to the ground plane 302.

Inside the tubular dielectric substrate 312 is the planar dielectric substrate 352. On the planar dielectric substrate 352 is the radiating conductor 354; there is no excitation pin. The radiating conductor 354 is electrically connected to the conducting ring 344; for example, via the solder joint 358 and the solder joint 360.

To reduce the cross-sectional dimensions of the antenna system, the set of impedance elements 348 is electrically connected to the conducting ring 344, and the set of impedance elements 350 is electrically connected to the conducting ring 346. More details of the impedance elements are described below.

Figure 4A:
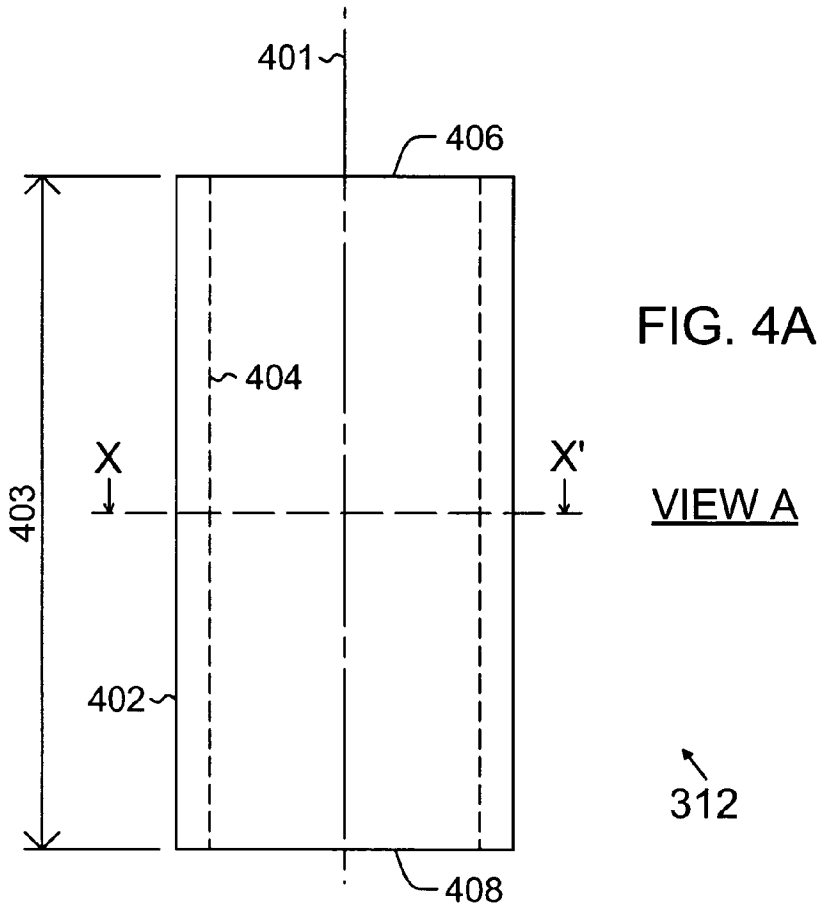

Details of the tubular dielectric substrate 312 are shown in FIG. 4A-FIG. 4F. FIG. 4A shows a side view (View A) of the tubular dielectric substrate 312, which has a longitudinal axis 401, an outer wall 402, an inner wall 404, an end face 406, and an end face 408. The outer wall 402 and the inner wall 404 are substantially parallel to the longitudinal axis 401. The end face 406 and the end face 408 are substantially orthogonal to the longitudinal axis 401. The length (or height) 403 of the tubular dielectric substrate 312 is measured parallel to the longitudinal axis 401 from the end face 408 to the end face 406.

Herein, geometrical conditions are "substantially" satisfied if they are met within user-defined tolerances. User-defined tolerances include typical manufacturing tolerances and design tolerances within which the antenna system performance is acceptable to the user; here, "user" refers, for example, to an antenna design engineer. To simplify the terminology, unless otherwise stated, geometrical conditions (such as parallel, orthogonal, circular, and cylindrical) and values of dimensions (such as lengths and angles) are implicitly modified by the term "substantially".

Refer to FIG. 4B-FIG. 4F, which show cross-sectional views (View X-X') of the tubular dielectric substrate 312. The cross-sectional views are orthogonal to the longitudinal axis 401 (FIG. 4A). FIG. 4B shows a cross-section with a circular geometry; the outer wall 402B and the inner wall 404B are concentric circles. The outer wall 402B has a diameter 405, and the inner wall 404B has a diameter 407. FIG. 4C shows a cross-section with an elliptical geometry; the outer wall 402C and the inner wall 404C are concentric ellipses. The outer wall 402C has a major axis 409 and a minor axis 415. The inner wall 404C has a major axis 411 and a minor axis 413. FIG. 4D shows a square cross-section with the outer wall 402D and the inner wall 404D. FIG. 4E shows a rectangular cross-section with the outer wall 402E and the inner wall 404E. FIG. 4F shows a hexagonal cross-section with the outer wall 402F and the inner wall 404F. Other user-defined geometries can be used.

When the tubular dielectric substrate 312 has a cross-section with a circular geometry, then the conducting ring 314 and the conducting ring 316 (FIG. 3A) have a circular geometry. Similarly, when the tubular dielectric substrate 312 has a cross-section that does not have a circular geometry, then the conducting ring 314 and the conducting ring 316 do not have a circular geometry. Herein, a "ring" is not limited to a circular geometry. A ring, for example, can have an elliptical, square, rectangular, or hexagonal geometry. In general, a ring can have a user-defined geometry.

The geometries of the tubular dielectric substrate 342 are similar to those of the tubular dielectric substrate 312.

Figures 5A, 5B, 5C, 5D, 5E, 5F:
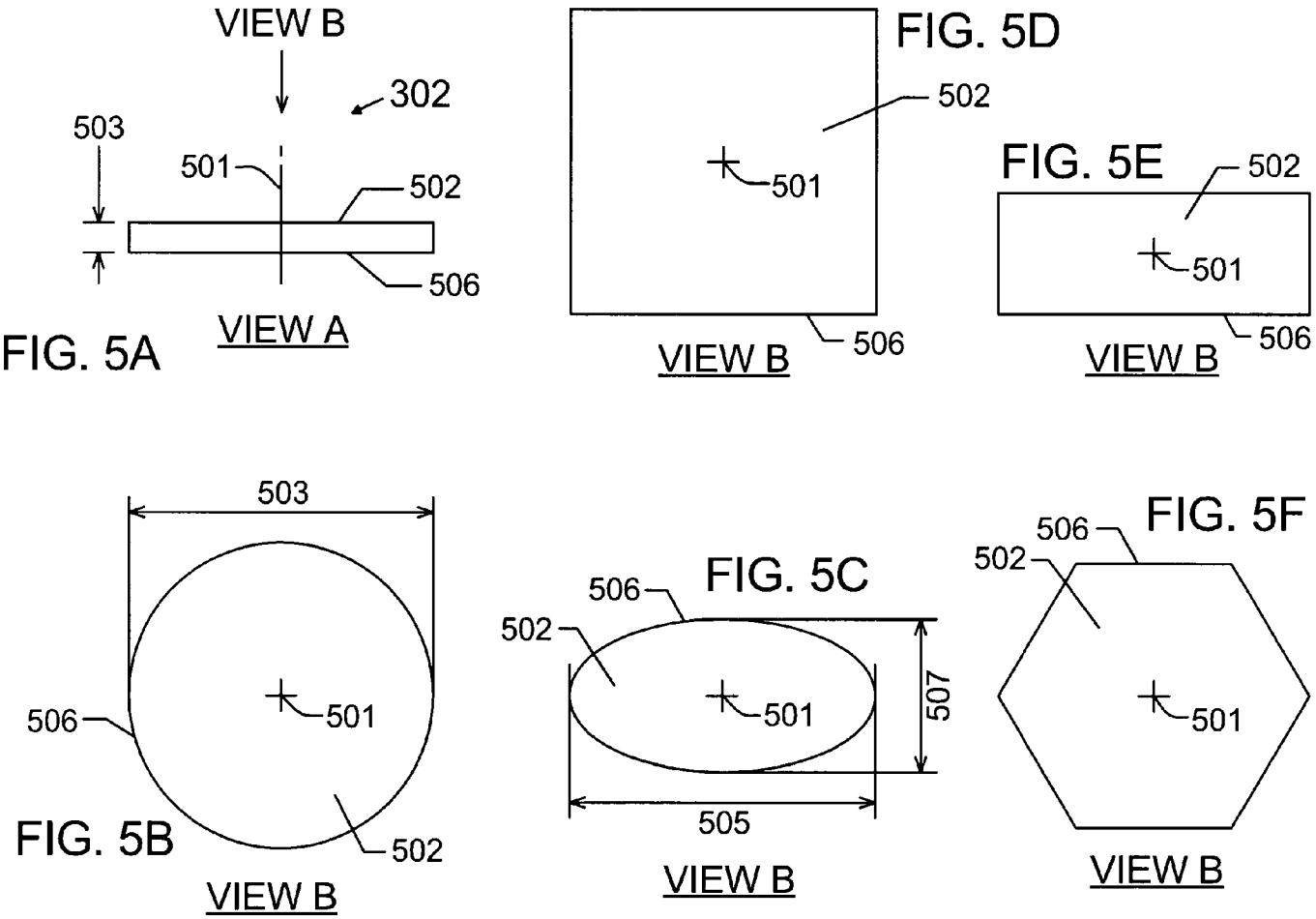
FIG. 5A-FIG. 5F show examples of geometrical configurations for ground planes.

FIG. 5A-FIG. 5F show details of the ground plane 302. FIG. 5A shows a side view (View A) of the ground plane 302. The ground plane 302 is a conducting plate with a thickness 503. The normal axis 501 passes through the geometrical center of the ground plane 302. The ground plane 302 can be fabricated, for example, from sheet metal or from a dielectric substrate metallized on all surfaces. The ground plane 302 has a surface 502 and a surface 506. For reference, the surface 502 is called the top surface and the surface 506 is called the bottom surface. With respect to the geometry shown in FIG. 3A, the active antenna 310 is positioned above the ground plane 302, and the passive antenna 340 is positioned below the ground plane 302.

FIG. 5B-FIG. 5F show plan views (View B) of ground planes with various geometries. FIG. 5B shows a ground plane with a circular geometry; the circle has a diameter 503. FIG. 5C shows a ground plane with an elliptical geometry; the ellipse has a major axis 505 and a minor axis 507. FIG. 5D, FIG. 5E, and FIG. 5F show ground planes with a square geometry, a rectangular geometry, and a hexagonal geometry, respectively. Other user-defined geometries can be used. As shown in the plan views, FIG. 5B-FIG. 5F, the ground plane 302 is bounded by a perimeter 506.

The longitudinal axis of the tubular dielectric substrate 312, the longitudinal axis of the tubular dielectric substrate 342, and the normal axis of the ground plane 302 are all aligned along the antenna axis 301. The plane of the planar dielectric substrate 322 is parallel to the antenna axis 301, and the antenna axis 301 lies on the plane of the planar dielectric substrate 322. Similarly, the plane of the planar dielectric substrate 352 is parallel to the antenna axis 301, and the antenna axis 301 lies on the plane of the planar dielectric substrate 352. The azimuthal angle, measured about the antenna axis 301, of the planar dielectric substrate 352 with respect to the planar dielectric substrate 322 is variable and set according to design specifications.

The geometries and dimensions of the tubular dielectric substrate 312, the tubular dielectric substrate 342, and the ground plane 302 are independently variable and set according to design specifications. In particular, the shape and the dimensions of the tubular dielectric substrate 312 and of the tubular dielectric substrate 342 are not necessarily the same. For example, an antenna system can be configured with a combination of a tubular dielectric substrate 312 with a circular cross-section, a tubular dielectric substrate 342 with a square cross-section, and a ground plane 302 with a hexagonal geometry. To simplify the discussion, in the examples below, the tubular dielectric substrate 312 and the tubular dielectric substrate 342 have circular cross-sections, and the ground plane 302 has a circular geometry.

The excitation efficiency of the passive antenna 340 by the active antenna 310 is a function of the lateral dimension of the ground plane 302. If the tubular dielectric substrates are cylinders with a diameter $d_1$ and the ground plane is a circular disk with a diameter $d_2>d_1$, then the value $a=(d_2-d_1)/2$ is approximately 0.12-0.15 times the operating wavelength of the antenna. For a GPS antenna, a is approximately 25-35 mm. More detailed analysis of the optimum range of a is provided below.

Figure 6:
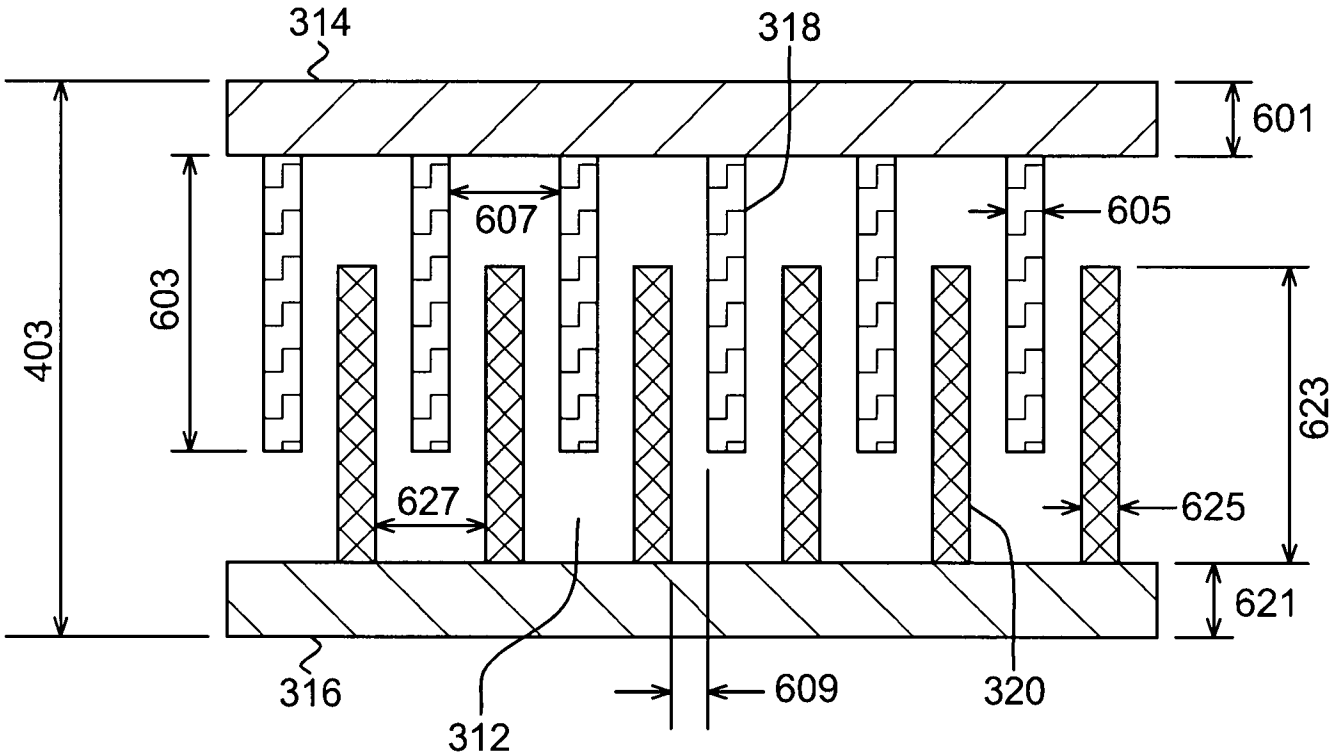
FIG. 6 shows a schematic of capacitive impedance elements configured on a dielectric substrate.

As discussed above, in an embodiment, the tubular dielectric substrate 312 and the tubular dielectric substrate 342 are fabricated from flexible printed circuit boards that are then rolled into tubes. FIG. 6 shows a section of the tubular dielectric substrate 312 when unrolled into a flat sheet. The conducting ring 314 (FIG. 3A) can be fabricated from sheet metal. The conducting ring 314 can also be fabricated as shown in FIG. 6 by metallizing strips along the edges of the tubular dielectric substrate 312. Strips are metallized, for example, along the outer wall, the inner wall, and the end face to form a continuous conducting ring. The width of the conducting ring 314 is width 601. The conducting ring 316 can be fabricated in a similar fashion. The width of the conducting ring 316 is width 621.

Also shown in FIG. 6 are details of the set of impedance elements 318 electrically connected to the conducting ring 314 and the set of impedance elements 320 electrically connected to the conducting ring 316. In this instance, the impedance elements are capacitive elements. In an embodiment, each impedance element 318 is a rectangular metal strip with a length 603 and a width 605; the spacing between consecutive rectangular strips is spacing 607. Similarly, each impedance element 320 is a rectangular metal strip with a length 623 and a width 625; the spacing between consecutive rectangular strips is spacing 627. The set of impedance elements 320 is interdigitated with the set of impedance elements 318. The offset spacing between an impedance element 318 and an adjacent impedance element 320 is offset spacing 609. The sets of impedance elements can be fabricated with standard printed circuit board techniques. More detailed discussion of impedance elements is provided below; in particular, impedance elements other than capacitive elements can be used.

The active antenna 310 shown in FIG. 3A is fabricated with two dielectric substrates, the tubular dielectric substrate 312 and the planar dielectric substrate 322. Other embodiments can be fabricated with one dielectric substrate (a combination of a tubular dielectric substrate with no planar dielectric substrate or a combination of a planar dielectric substrate with no tubular dielectric substrate) or no dielectric substrate.

The planar dielectric substrate 322, for example, can be eliminated if the radiating conductor 324 and the excitation pin 326 are fabricated from sheet metal that does not require a supporting substrate. The radiating conductor 324 and the excitation pin 326 can be fabricated as a single unit, or the excitation pin 326 can be soldered or mechanically fastened to the radiating conductor 324.

The tubular dielectric substrate 312, for example, can be eliminated if the conducting ring 314 is fabricated from metal wire or sheet metal that does not require a supporting substrate. The set of impedance elements can be fabricated from wires or pins integrally fabricated with, soldered to, or mechanically fastened to the conducting ring 314. The conducting ring 316 and the set of impedance elements 320 can be similarly fabricated. In some embodiments, the conducting ring 316 can be eliminated, and the set of impedance elements 320 can be soldered directly onto the ground plane 302.

In embodiments that have no dielectric substrates, the conducting ring 314 can be supported above the ground plane 302 with suitable dielectric posts. As described later in reference to FIG. 12, however, other configurations of impedance elements can be used to couple the conducting ring 314 with the ground plane 302. For example, an impedance element can be fabricated from discrete components or from thin-film components on a printed circuit board. If the impedance elements are connected by lead wires to the conducting ring 314 and to the ground plane 302, then the conducting ring 314 can be supported by the impedance elements, and no dielectric posts are needed.

The various fabrication techniques described above for the active antenna 310 can be similarly applied, with appropriate modifications, for the passive antenna 340 and for the active and passive antennas described below.

Figure 7A:
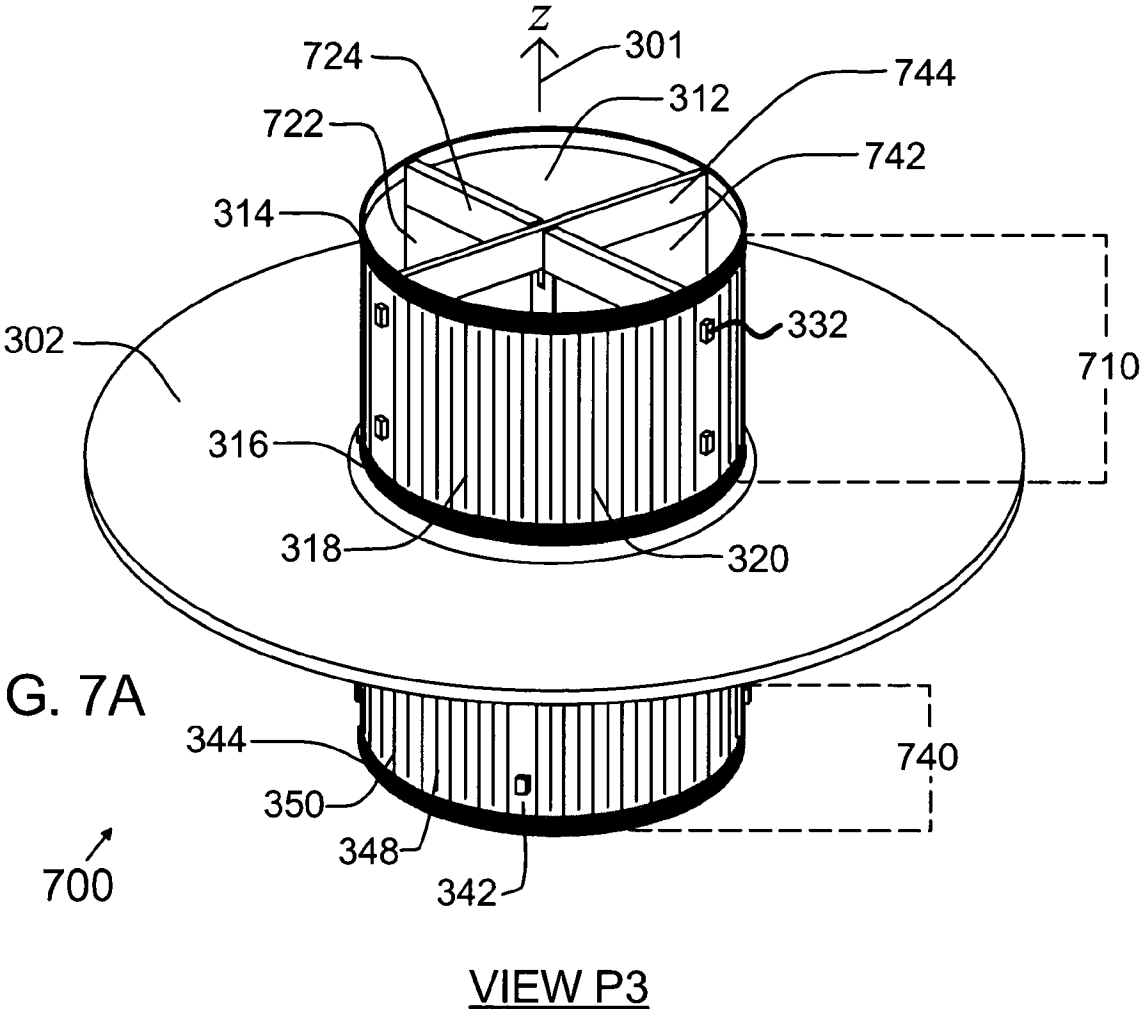
FIG. 7A-FIG. 7G show an embodiment of a single-frequency band antenna for circularly-polarized radiation.

FIG. 7A shows a perspective view (View P3) of a single-frequency band antenna system configured for circularly-polarized radiation. The antenna system 700 includes the active antenna 710, the passive antenna 740, and the ground plane 302. The antenna system 700 is similar to the antenna system 300, with the following exceptions. In the antenna system 300, there is a single planar dielectric substrate 322 inside the tubular dielectric substrate 312, and there is a single planar dielectric substrate 352 within the tubular dielectric substrate 342. In the antenna system 700, there are two planar dielectric substrates inside the tubular dielectric substrate 312, and there are two planar dielectric substrates inside the tubular dielectric substrate 342.

Figure 7B:
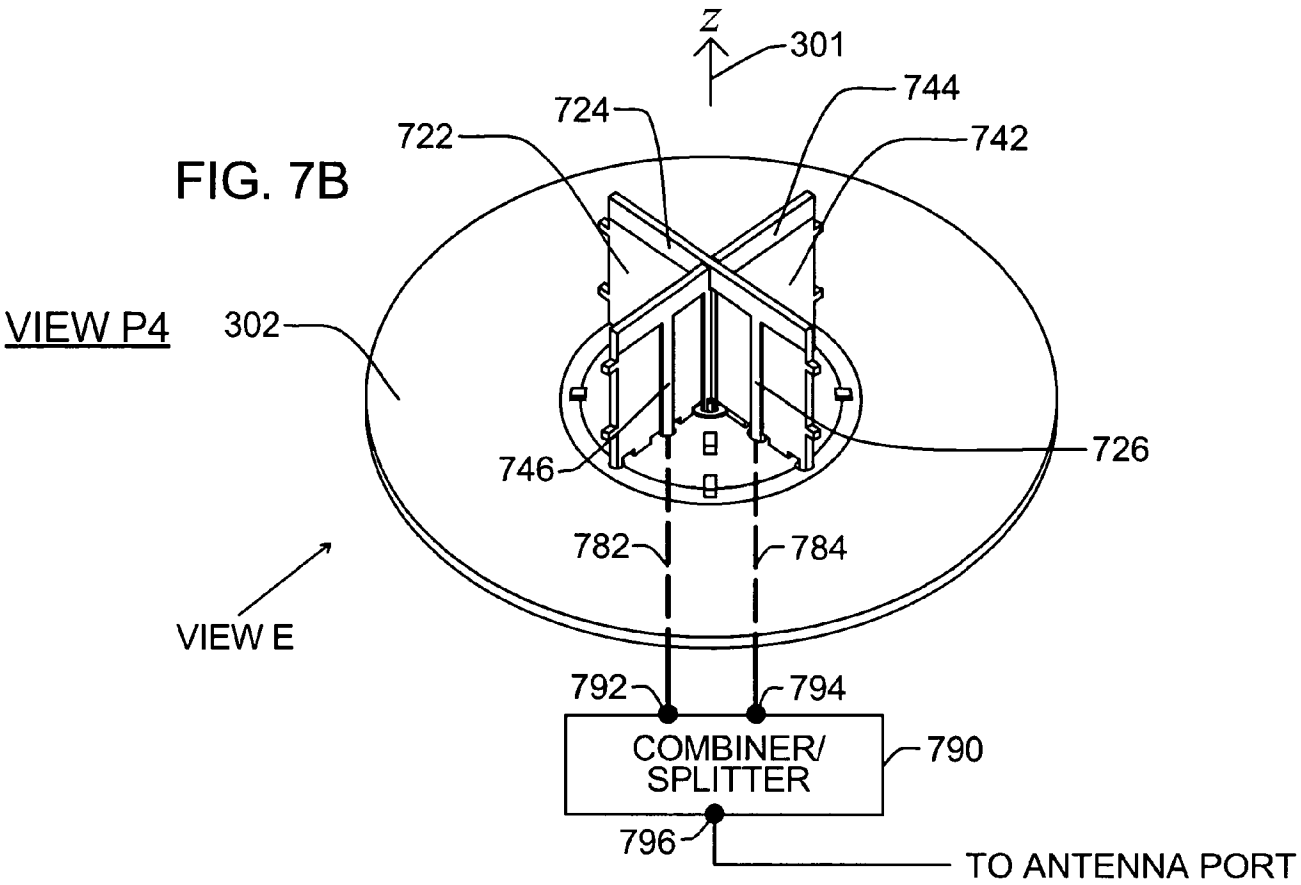

FIG. 7B shows a top perspective view (View P4) of the antenna system 700 with the tubular dielectric substrate 312 removed. The planar dielectric substrate 722 and the planar dielectric substrate 742 are orthogonal to each other and orthogonal to the ground plane 302. The line of intersection between the planar dielectric substrate 722 and the planar dielectric substrate 742 lies along the antenna axis 301. On the planar dielectric substrate 722 are the radiating conductor 724 and the excitation pin 726. Similarly, on the planar dielectric substrate 742 are the radiating conductor 744 and the excitation pin 746.

In the receive mode, the excitation pin 726 is connected via the power line 784 passing through a hole in the ground plane 302 to the input port 794 of the quadrature combiner 790. Similarly, the excitation pin 746 is connected via the power line 782 passing through a hole in the ground plane 302 to the input port 792 of the quadrature combiner 790. There is a 90-degree phase shift between the input port 792 and the input port 794. The output port 796 of the quadrature combiner 790 is connected to an antenna port (not shown). A low-noise amplifier (not shown) is then connected to the antenna port. The positions of the excitation pins are specified to provide the proper matching input impedances. [Note, in the transmit mode, the antenna port is connected to a transmitter, and the quadrature combiner acts as a quadrature splitter.]

Figure 7C:
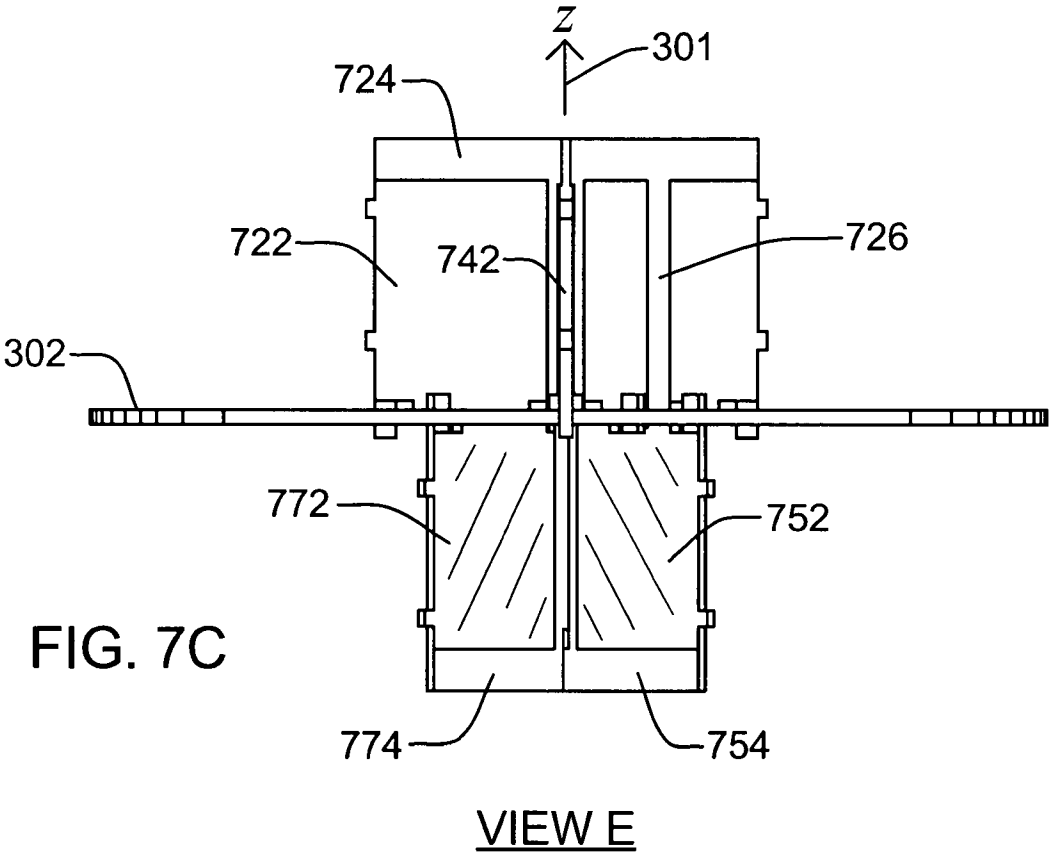

FIG. 7C shows a side view (View E) of the antenna system 700 with both the tubular dielectric substrate 312 and the tubular dielectric substrate 342 removed. The planar dielectric substrate 722 lies within the plane of the figure; the plane of the planar dielectric substrate 742 is orthogonal to the plane of the figure.

In addition to the structures in FIG. 7B, shown are the planar dielectric substrate 752 and the planar dielectric substrate 772 in the passive antenna 740. The planar dielectric substrate 752 and the planar dielectric substrate 772 are orthogonal to each other and to the ground plane 302. The line of intersection between the planar dielectric substrate 752 and the planar dielectric substrate 772 lies along the antenna axis 301. The plane of the planar dielectric substrate 752 and the plane of the planar dielectric substrate 772 are oblique to the plane of the figure.

On the planar dielectric substrate 752 is the radiating conductor 754. Similarly, on the planar dielectric substrate 772 is the radiating conductor 774. There are no excitation pins on the planar dielectric substrate 752 and the planar dielectric substrate 772. The azimuthal angle, measured about the antenna axis 301, of the planar dielectric substrate 752 and the planar dielectric substrate 772 with respect to the planar dielectric substrate 722 and the planar dielectric substrate 742 is variable and set according to design specifications. In one embodiment, the azimuthal angle is about 45 deg.

FIG. 7D-FIG. 7G show details of the individual planar dielectric substrates. In the figures, dotted hatching represents regions of the planar dielectric substrate without metallization, and zigzag hatching represents regions of the planar dielectric substrate with metallization.

Figure 7D:
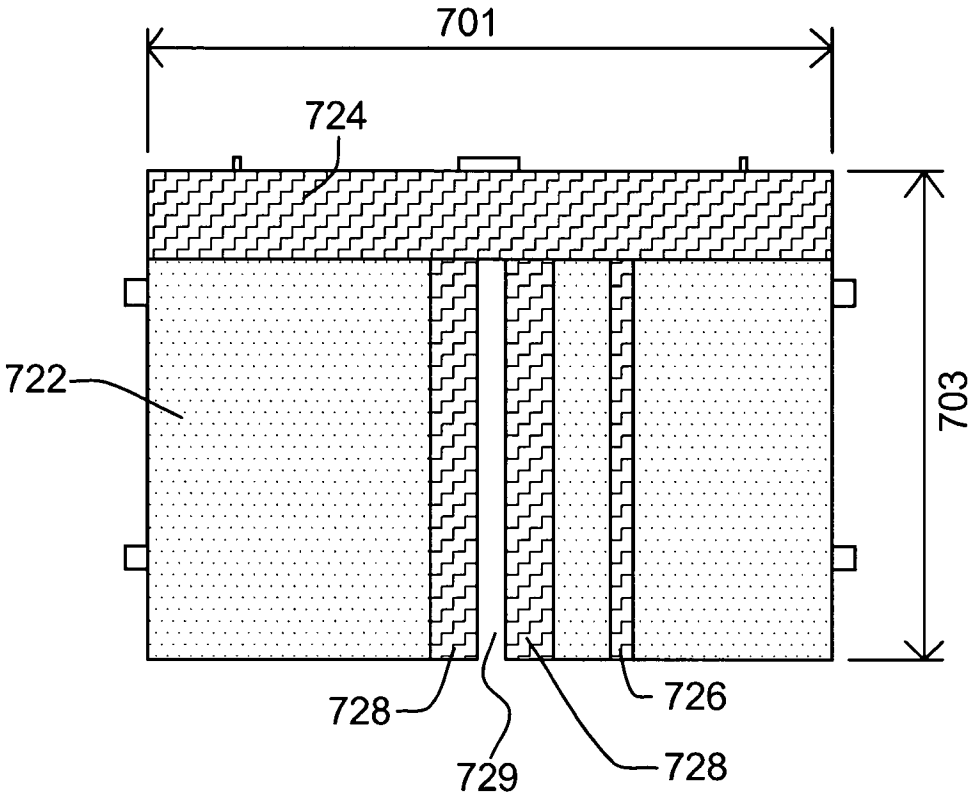

Refer to FIG. 7D. The planar dielectric substrate 722 has a length 701 and a width 703. On the planar dielectric substrate 722 are the radiating conductor 724, the conducting strip 728, and the excitation pin 726. The slot 729 is used for mounting.

Figure 7E:
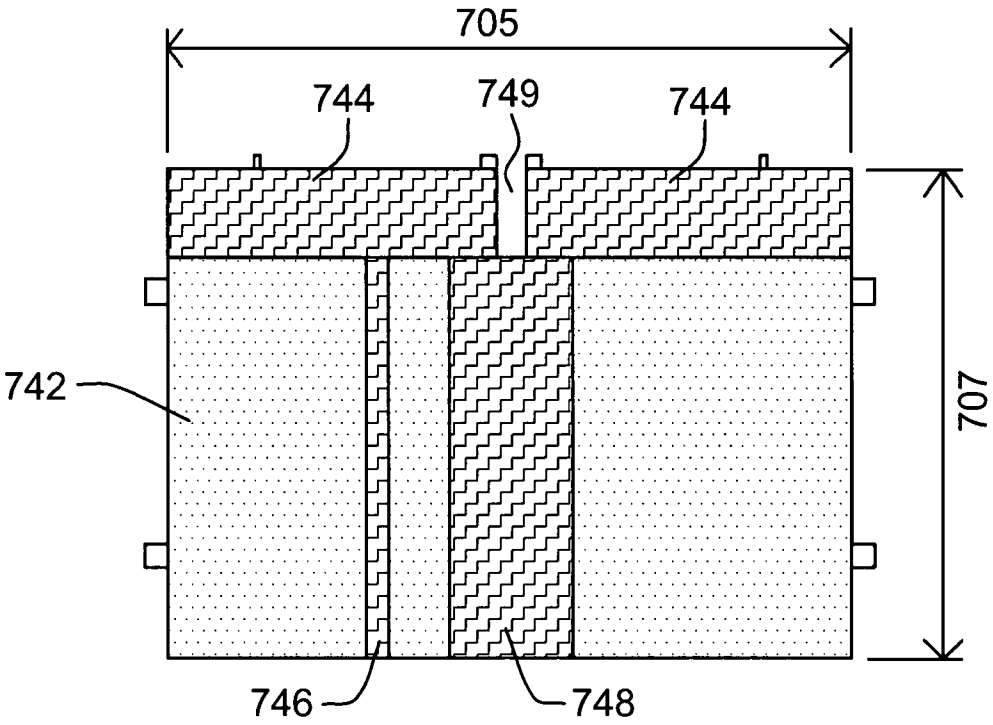

Refer to FIG. 7E. The planar dielectric substrate 742 has a length 705 and a width 707. On the planar dielectric substrate 742 are the radiating conductor 744, the conducting strip 748, and the excitation pin 746. The slot 749 is used for mounting. The planar dielectric substrate 722 and the planar dielectric substrate 742 interlock orthogonally via the slot 729 and the slot 749. The conducting strip 728 and the conducting strip 748 can be soldered together to provide structural reinforcement. The conducting strip 728 and the conducting strip 748 are also soldered to the ground plane 302.

Figure 7F:
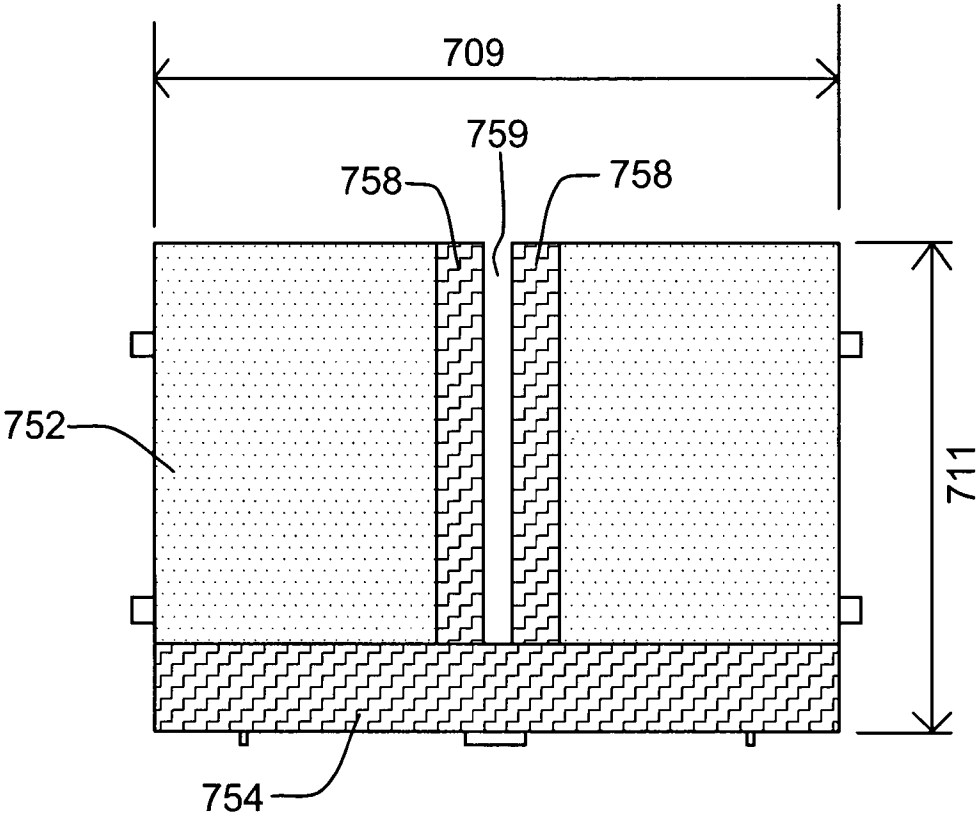

Refer to FIG. 7F. The planar dielectric substrate 752 has a length 709 and a width 711. On the planar dielectric substrate 752 are the radiating conductor 754 and the conducting strip 758; there is no exciting pin. The slot 759 is used for mounting.

Figure 7G:
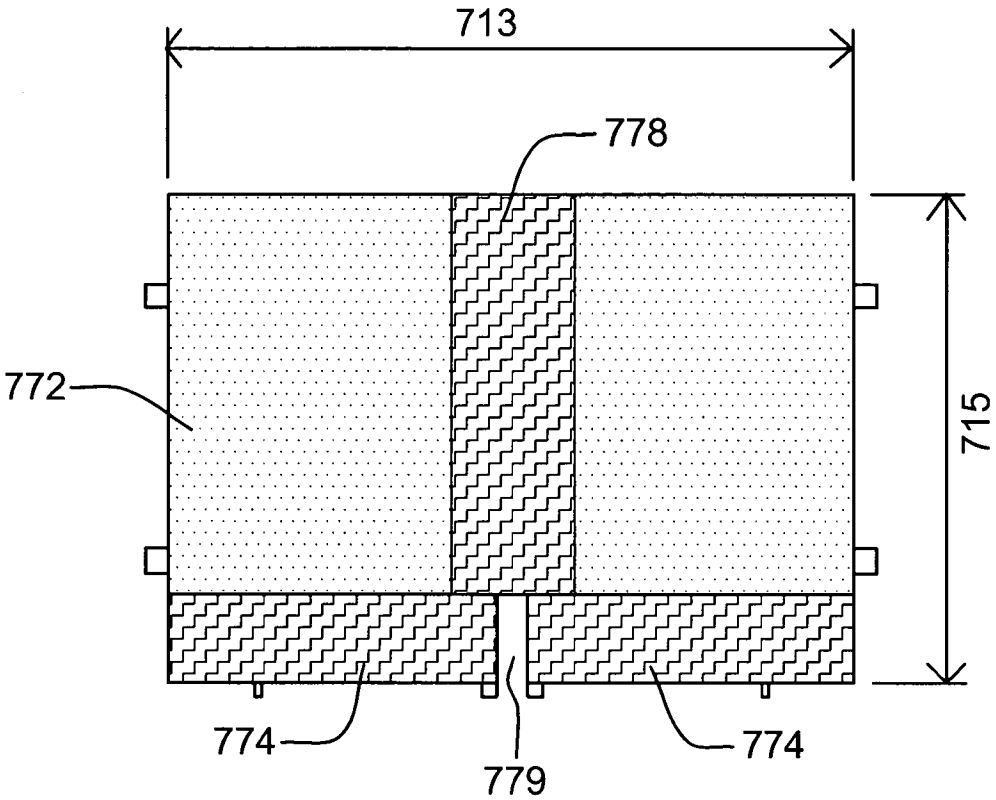

Refer to FIG. 7G. The planar dielectric substrate 772 has a length 713 and a width 715. On the planar dielectric substrate 772 are the radiating conductor 774 and the conducting strip 778; there is no excitation pin. The slot 729 is used for mounting. The planar dielectric substrate 752 and the planar dielectric substrate 772 interlock orthogonally via the slot 759 and the slot 729. The conducting strip 758 and the conducting strip 778 can be soldered together to provide structural reinforcement. The conducting strip 758 and the conducting strip 778 are also soldered to the ground plane 302.

The geometries and dimensions of the dielectric substrates, slots, radiating conductors, conductive strips, and excitation pins are all independently variable and set according to design specifications.

Figure 8A:
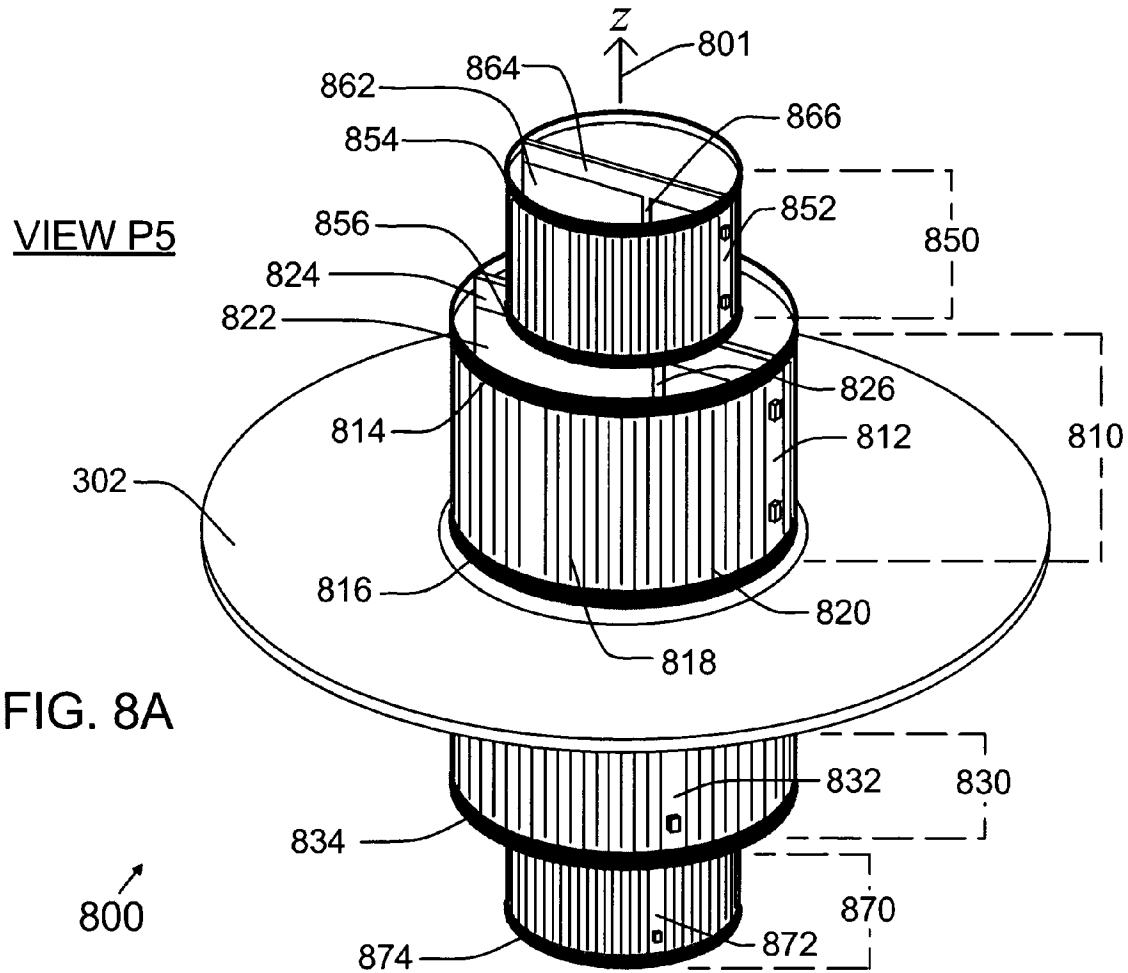
FIG. 8A and FIG. 8B show an embodiment of a dual-frequency band antenna for linearly-polarized radiation.
Figure 8B:
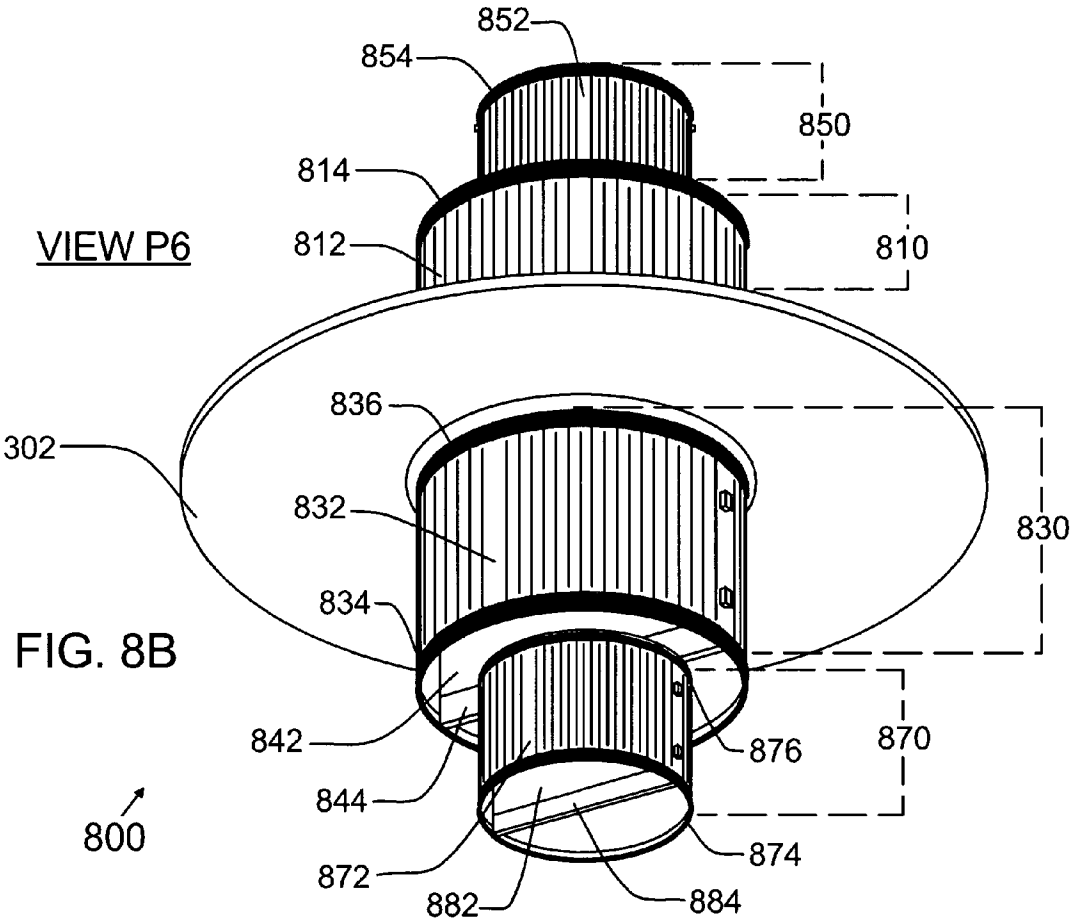

FIG. 8A and FIG. 8B show perspective views of a dual-frequency band antenna system configured for linearly-polarized radiation. For GPS, the low-frequency (LF) band can correspond to the L2 band (1215-1240 MHz), and the high-frequency (HF) band can correspond to the L1 band (1563-1588 MHz). The L5 band (1164-1189 MHz) has also been allocated for GPS. For GLONASS, the LF band can correspond to 1240-1256 MHz, and the HF band can correspond to 1591-1610 MHz. Other planned GNSSs, such as GALILEO, use other frequency bands. Antennas can also be designed to operate with more than one GNSS, and frequency allocations for various services evolve over time. For GNSS applications, a LF band with frequencies in the range of approximately 1150-1300 MHz and a HF band with frequencies in the range of approximately 1500-1650 MHz are currently suitable. Embodiments of the invention can be configured for other frequency bands allocated in the future for GNSS. Embodiments of the invention can also be configured for frequency bands used in other applications, such as wireless telecommunications.

The antenna system 800 includes the low-frequency (LF) active antenna 810, the LF passive antenna 830, the high-frequency (HF) active antenna 850, the HF passive antenna 870, and the ground plane 302. In operation, the LF active antenna 810 and the HF active antenna 850 face towards the sky, and the LF passive antenna 830 and the HF passive antenna 870 face towards the Earth.

Refer to FIG. 8A (View P5). The LF active antenna 810 includes the tubular dielectric substrate 812. At one end of the tubular dielectric substrate 812 is the conducting ring 814. At the other end of the tubular dielectric substrate 812 is the conducting ring 816, which is electrically connected to the ground plane 302.

Inside the tubular dielectric substrate 812 is the planar dielectric substrate 822. On the planar dielectric substrate 822 are the radiating conductor 824 and the excitation pin 826. The radiating conductor 824 is electrically connected to the conducting ring 814.

The HF active antenna 850 includes the tubular dielectric substrate 852. At one end of the tubular dielectric substrate 852 is the conducting ring 854. At the other end of the tubular dielectric substrate 852 is the conducting ring 856. The HF active antenna 850 is stacked above the LF active antenna 810. The conducting ring 856 of the HF active antenna 850 is electrically connected to the radiating conductor 824 of the LF active antenna 810.

Inside the tubular dielectric substrate 852 is the planar dielectric substrate 862. On the planar dielectric substrate 862 are the radiating conductor 864 and the excitation pin 866. The radiating conductor 864 is electrically connected to the conducting ring 864.

The excitation pin 826 of the LF active antenna 810 is connected via a power line to a LF antenna port (not shown). The excitation pin 866 of the HF active antenna is connected via a power line to a HF antenna port (not shown). In the receive mode, a LF low-noise amplifier (not shown) is connected to the LF antenna port, and a HF low-noise amplifier (not shown) is connected to the HF antenna port. The positions of the excitation pins are specified to provide the proper matching input impedances.

Refer to FIG. 8B (View P6). The LF passive antenna 830 is similar to the LF active antenna 810. The LF passive antenna 830 includes a tubular dielectric substrate 832. At one end of the tubular dielectric substrate 832 is the conducting ring 834. At the other end of the tubular dielectric substrate 832 is the conducting ring 836, which is electrically connected to the ground plane 302.

Inside the tubular dielectric substrate 832 is the planar dielectric substrate 842. On the planar dielectric substrate 842 is the radiating conductor 844; there is no excitation pin. The radiating conductor 844 is electrically connected to the conducting ring 834.

The HF passive antenna 870 is similar to the HF active antenna 850. The HF passive antenna 870 includes the tubular dielectric substrate 872. At one end of the tubular dielectric substrate 872 is the conducting ring 874. At the other end of the tubular dielectric substrate 872 is the conducting ring 876. The HF passive antenna 870 is stacked below the LF passive antenna 830. The conducting ring 876 of the HF passive antenna 870 is electrically connected to the radiating conductor 844 of the LF passive antenna 830.

Inside the tubular dielectric substrate 872 is the planar dielectric substrate 882. On the planar dielectric substrate 882 is the radiating conductor 884; there is no excitation pin. The radiating conductor 884 is electrically connected to the conducting ring 874.

The longitudinal axis of the tubular dielectric substrate 812, the longitudinal axis of the tubular dielectric substrate 852, the longitudinal axis of the tubular dielectric substrate 832, the longitudinal axis of the tubular dielectric substrate 872, and the normal axis of the ground plane 302 are all aligned along the antenna axis 801. The plane of the planar dielectric substrate 822 is parallel to the antenna axis 801, and the antenna axis 801 lies on the plane of the planar dielectric substrate 822. The plane of the planar dielectric substrate 862 is parallel to the antenna axis 801, and the antenna axis 801 lies on the plane of the planar dielectric substrate 862. The plane of the planar dielectric substrate 842 is parallel to the antenna axis 801, and the antenna axis 801 lies on the plane of the planar dielectric substrate 842. The plane of the planar dielectric substrate 882 is parallel to the antenna axis 801, and the antenna axis 801 lies on the plane of the planar dielectric substrate 882.

The planar dielectric substrate 822 and the planar dielectric substrate 862 are co-planar. The planar dielectric substrate 842 and the planar dielectric substrate 882 are co-planar. The azimuthal angle, measured about the antenna axis 801, of the planar dielectric substrate 822 and the planar dielectric substrate 862 with respect to the planar dielectric substrate 842 and the planar dielectric substrate 882 is variable and set according to design specifications.

To reduce the cross-sectional dimensions of the antenna system, sets of impedance elements are configured on the outer walls of the four tubular dielectric substrates. A representative example is referenced on the tubular dielectric substrate 812 (see FIG. 8A): the set of impedance elements 818 is electrically connected to the conducting ring 814, and the set of impedance elements 820 is electrically connected to the conducting ring 816.

Figure 9A:
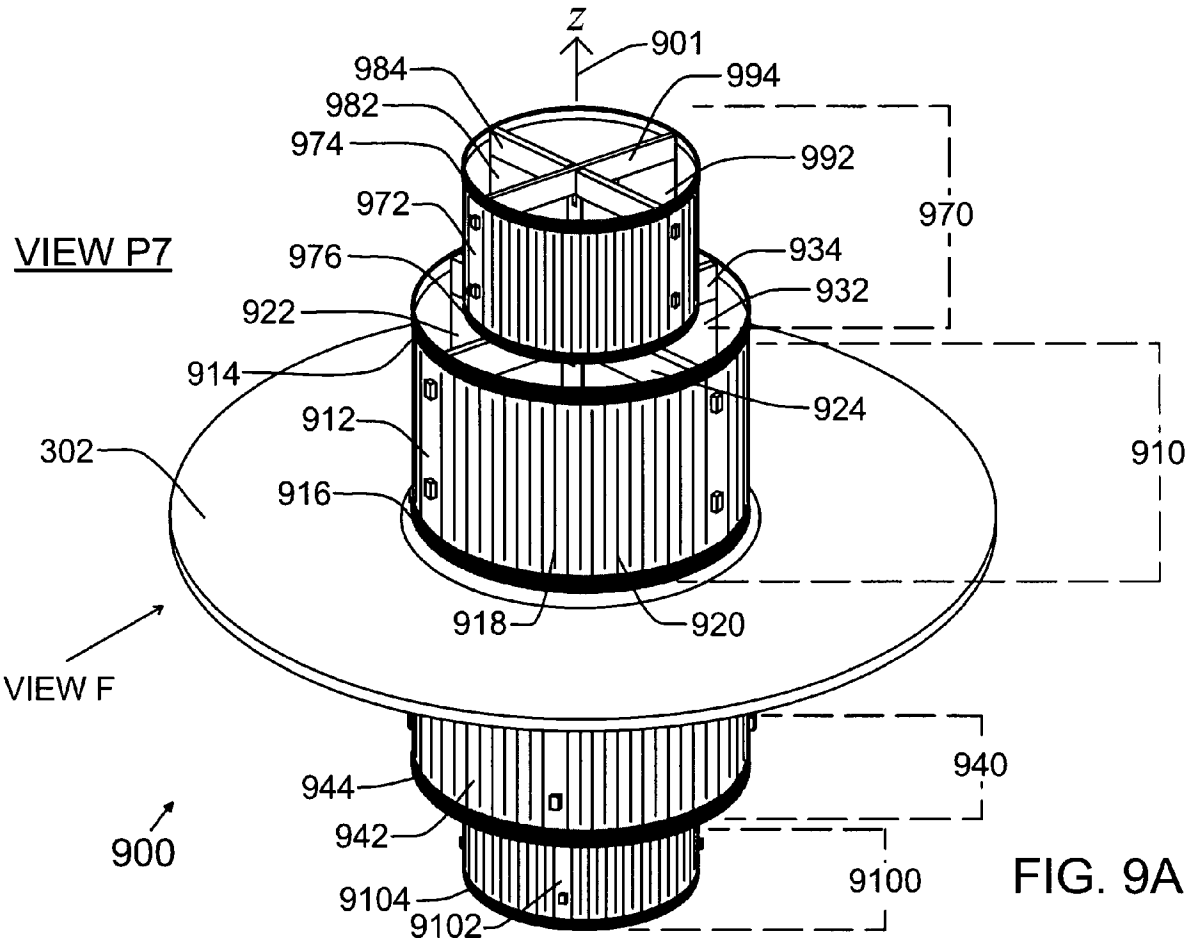
FIG. 9A-FIG. 9L show an embodiment of a dual-frequency band antenna for circularly-polarized radiation.
Figure 9B:
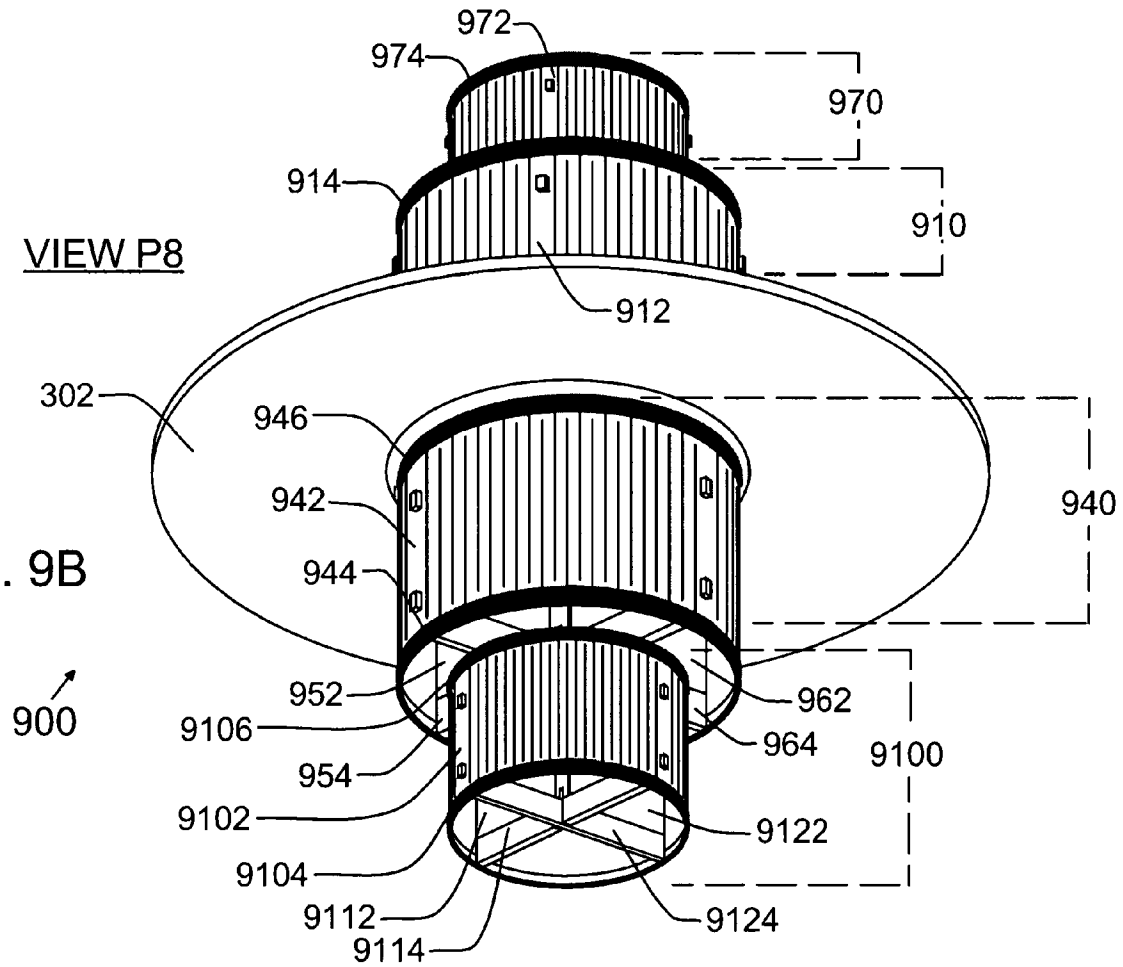

FIG. 9A and FIG. 9B show perspective views of a dual-frequency band antenna system configured for circularly-polarized radiation. The antenna system 900 includes the low-frequency (LF) active antenna 910, the LF passive antenna 940, the high-frequency (HF) active antenna 970, the HF passive antenna 9100, and the ground plane 302. In operation, the LF active antenna 910 and the HF active antenna 970 face towards the sky, and the LF passive antenna 940 and the HF passive antenna 9100 face towards the Earth.

Refer to FIG. 9A (View P7). The LF active antenna 910 includes the tubular dielectric substrate 912. At one end of the tubular dielectric substrate 912 is the conducting ring 914. At the other end of the tubular dielectric substrate 912 is the conducting ring 916, which is electrically connected to the ground plane 302.

Inside the tubular dielectric substrate 912 are the planar dielectric substrate 922 and the planar dielectric substrate 932. The planar dielectric substrate 922 and the planar dielectric substrate 932 are mounted orthogonal to each another. On the planar dielectric substrate 922 are the radiating conductor 924 and an excitation pin (not shown in this view, but shown in more detail below). The radiating conductor 924 is electrically connected to the conducting ring 914. On the planar dielectric substrate 932 are the radiating conductor 934 and an excitation pin (not shown in this view, but shown in more detail below). The radiating conductor 934 is electrically connected to the conducting ring 914.

The HF active antenna 970 includes the tubular dielectric substrate 972. At one end of the tubular dielectric substrate 972 is the conducting ring 974. At the other end of the tubular dielectric substrate 972 is the conducting ring 976. The HF active antenna 970 is stacked above the LF active antenna 910. The conducting ring 976 of the HF active antenna 970 is electrically connected to the radiating conductor 924 and the radiating conductor 934 of the LF active antenna 910.

Inside the tubular dielectric substrate 972 are the planar dielectric substrate 982 and the planar dielectric substrate 992. The planar dielectric substrate 982 and the planar dielectric substrate 992 are orthogonal to each other. On the planar dielectric substrate 982 are the radiating conductor 984 and an excitation pin (not shown in this view, but shown in more detail below). The radiating conductor 984 is electrically connected to the conducting ring 974. On the planar dielectric substrate 992 are the radiating conductor 994 and an excitation pin (not shown in this view, but shown in more detail below). The radiating conductor 994 is electrically connected to the conducting ring 974.

Refer to FIG. 9B (View P8). The LF passive antenna 940 is similar to the LF active antenna 910. The LF passive antenna 940 includes the tubular dielectric substrate 942. At one end of the tubular dielectric substrate 942 is the conducting ring 944. At the other end of the tubular dielectric substrate 942 is the conducting ring 946, which is electrically connected to the ground plane 302.

Inside the tubular dielectric substrate 942 are the planar dielectric substrate 952 and the planar dielectric substrate 962. The planar dielectric substrate 952 and the planar dielectric substrate 962 are orthogonal to each other. On the planar dielectric substrate 952 is the radiating conductor 954; there is no excitation pin. The radiating conductor 954 is electrically connected to the conducting ring 944. On the planar dielectric substrate 962 is the radiating conductor 964; there is no excitation pin. The radiating conductor 964 is electrically connected to the conducting ring 944.

The HF passive antenna 9100 is similar to the HF active antenna 970. The HF passive antenna 9100 includes the tubular dielectric substrate 9102. At one end of the tubular dielectric substrate 9102 is the conducting ring 9104. At the other end of the tubular dielectric substrate 9102 is the conducting ring 9106. The HF passive antenna 9100 is stacked below the LF passive antenna 940. The conducting ring 9106 of the HF passive antenna 9100 is electrically connected to the radiating conductor 954 and the radiating conductor 964 of the LF passive antenna 940.

Inside the tubular dielectric substrate 9102 is are the planar dielectric substrate 9112 and the planar dielectric substrate 9122. The planar dielectric substrate 9112 and the planar dielectric substrate 9122 are orthogonal to each other. On the planar dielectric substrate 9112 is the radiating conductor 9114; there is no excitation pin. The radiating conductor 9114 is electrically connected to the conducting ring 9104. On the planar dielectric substrate 9122 is the radiating conductor 9124; there is no excitation pin. The radiating conductor 9124 is electrically connected to the conducting ring 9104.

To reduce the cross-sectional dimensions of the antenna system, sets of impedance elements are configured on the outer walls of the four tubular dielectric substrates. A representative example is referenced on the tubular dielectric substrate 912 (see FIG. 9A): the set of impedance elements 918 is electrically connected to the conducting ring 914, and the set of impedance elements 920 is electrically connected to the conducting ring 916.

Figure 9C:
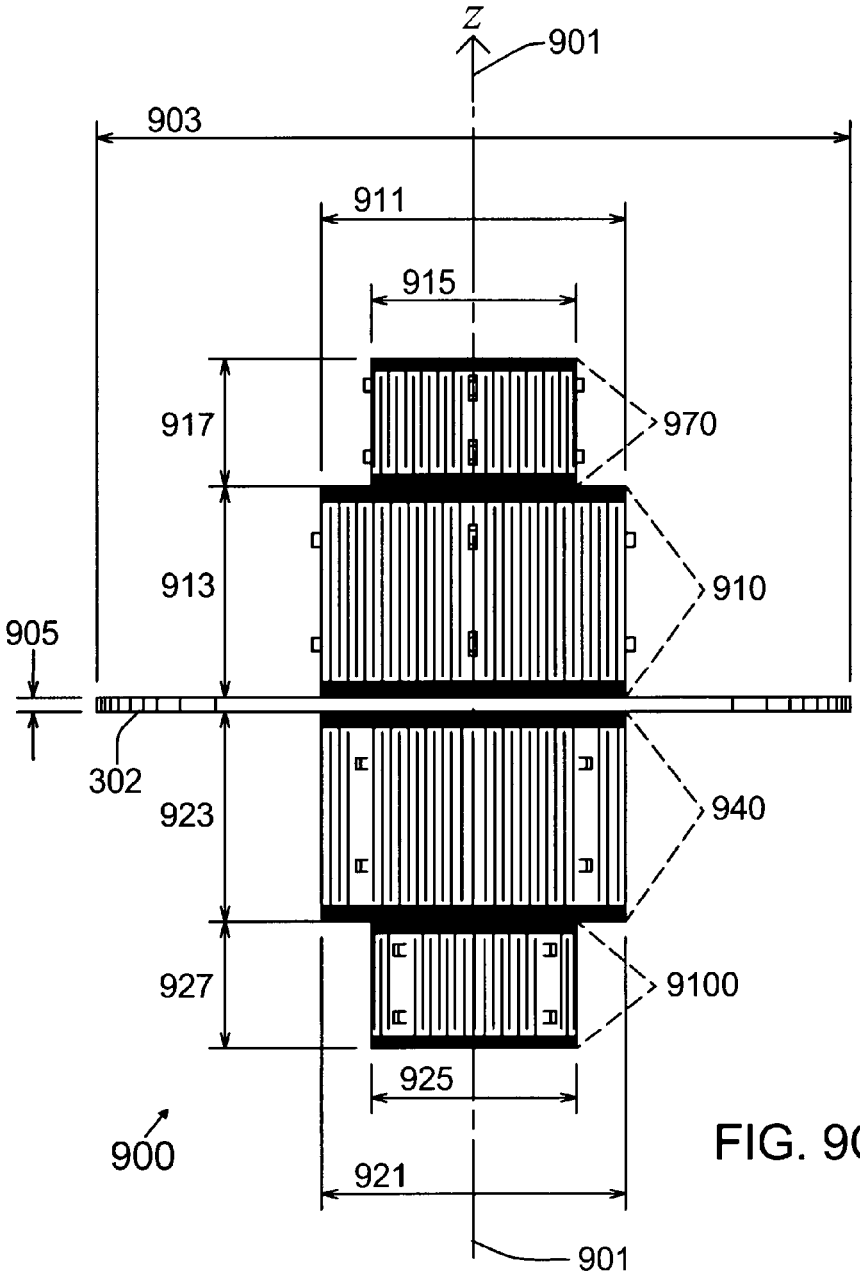

FIG. 9C shows a side view (View F) of the antenna system 900, which has an antenna axis 901. Shown are the principal dimensions, which are independently variable and set according to design specifications. The ground plane 302 has a diameter 903 and a thickness 905. The LF active antenna 910 has a diameter 911 and a length (height) 913. The HF active antenna 970 has a diameter 915 and a length 917. The LF passive antenna 940 has a diameter 921 and a length 923. The HF passive antenna 9100 has a diameter 925 and a length 927.

For a dual-frequency band antenna operating in the GPS L1 and L2 frequency bands, characteristic dimensions for an embodiment are the following:

diameter 915: 19 mm
diameter 925: 19 mm
diameter 911: 28 mm
diameter 921: 28 mm
length 917: 12 mm
length 927: 12 mm
length 913: 20 mm
length 927: 20 mm
a=(diameter 903-diameter 911)/2: 25 mm.

Approximate weights for embodiments of the antenna range from 10 to 30 grams.

Figure 9D:
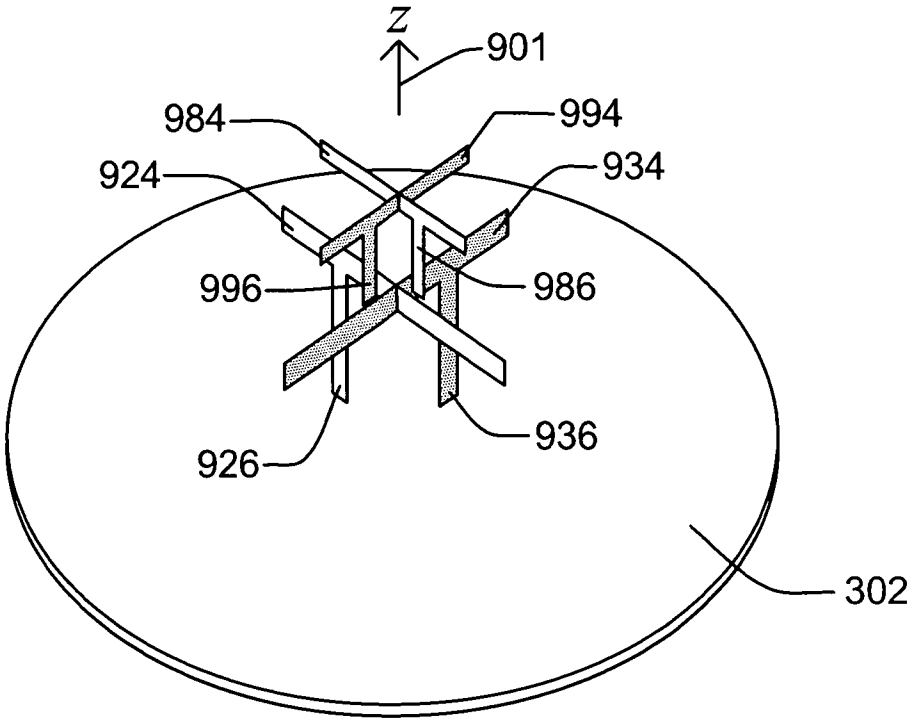
Figure 9E:
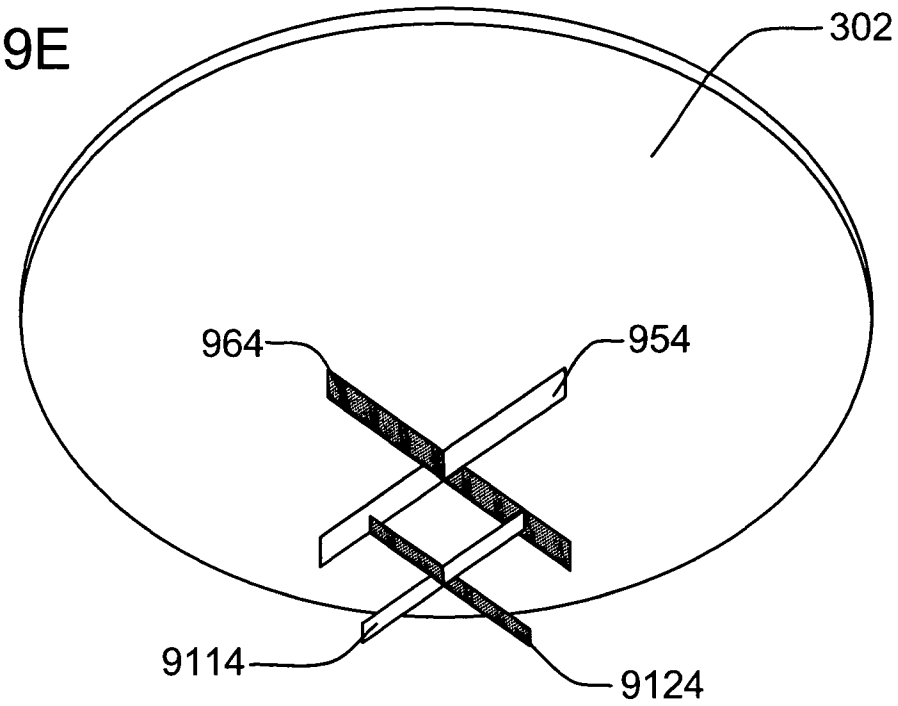

FIG. 9D and FIG. 9E show perspective views of the radiating conductors and excitation pins relative to the ground plane 302.

FIG. 9D shows a perspective view (View P9) of the elements of the active antennas. The shaded elements lie on a first plane. The non-shaded elements lie on a second plane. The first plane and the second plane are orthogonal to each other. The LF active antenna 910 has the radiating conductor 924 and the excitation pin 926 and the radiating conductor 934 and the excitation pin 936. The HF active antenna 970 has the radiating conductor 984 and the excitation pin 986 and the radiating conductor 994 and the excitation pin 996.

In the receive mode, power lines connect the excitation pin 926 and the excitation pin 936 of the LF active antenna 910 to a LF quadrature combiner (not shown, but similar to the configuration shown in FIG. 7B); the output port of the LF quadrature combiner is connected to a LF antenna port. Similarly, power lines connect the excitation pin 986 and the excitation pin 996 of the HF active antenna 970 to a HF quadrature combiner (not shown, but similar to the configuration shown in FIG. 7B); the output port of the HF quadrature combiner is connected to a HF antenna port.

FIG. 9E shows a perspective view (View P10) of the elements of the passive antennas. The shaded elements lie on a third plane. The non-shaded elements lie on a fourth plane. The third plane and the fourth plane are orthogonal to each other. The LF passive antenna 940 has the radiating conductor 954 and the radiating conductor 964; there are no excitation pins. The HF passive antenna 9100 has the radiating conductor 9114 and the radiating conductor 9124; there are no excitation pins.

FIG. 9F-FIG. 9I show details of the individual planar dielectric substrates. In the figures, dotted hatching represents regions of the planar dielectric substrate without metallization, and zigzag hatching represents regions of the planar dielectric substrate with metallization.

Figure 9F:
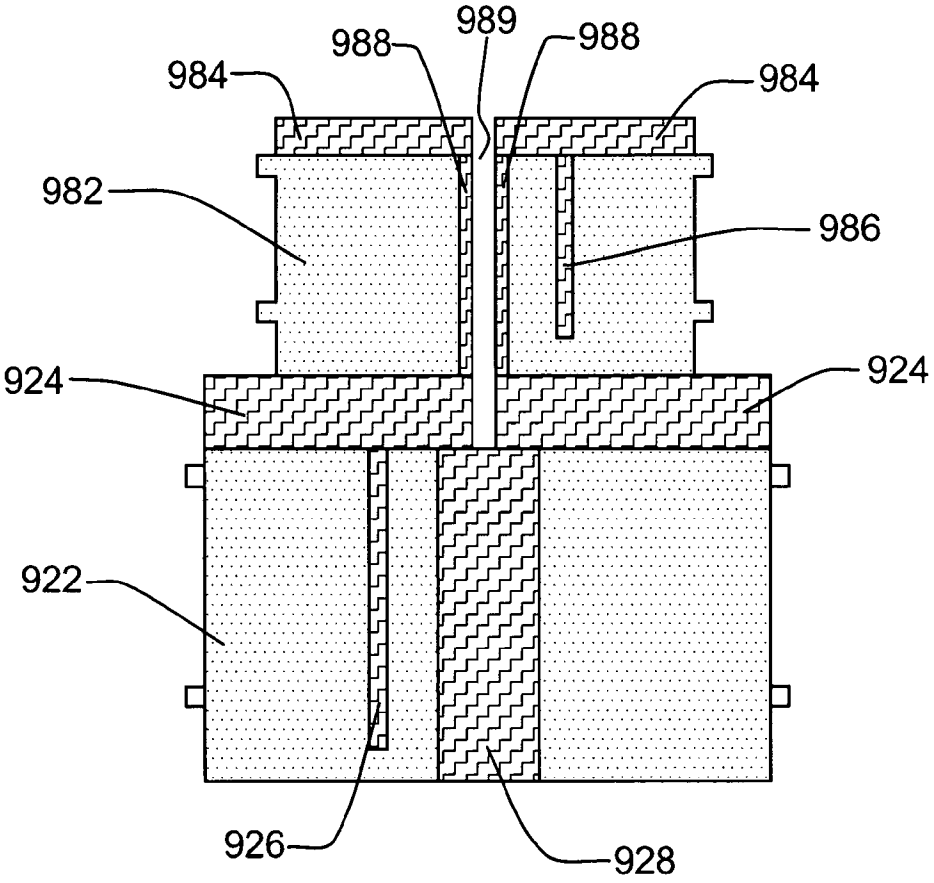

Refer to FIG. 9F. The planar dielectric substrate 922 and the planar dielectric substrate 982 are fabricated as a single planar dielectric substrate. On the planar dielectric substrate 922 are the radiating conductor 924, the conducting strip 928, and the excitation pin 926. On the planar dielectric substrate 982 are the radiating conductor 984, the conducting strip 988, and the excitation pin 986. The slot 989 is used for mounting.

Figure 9G:
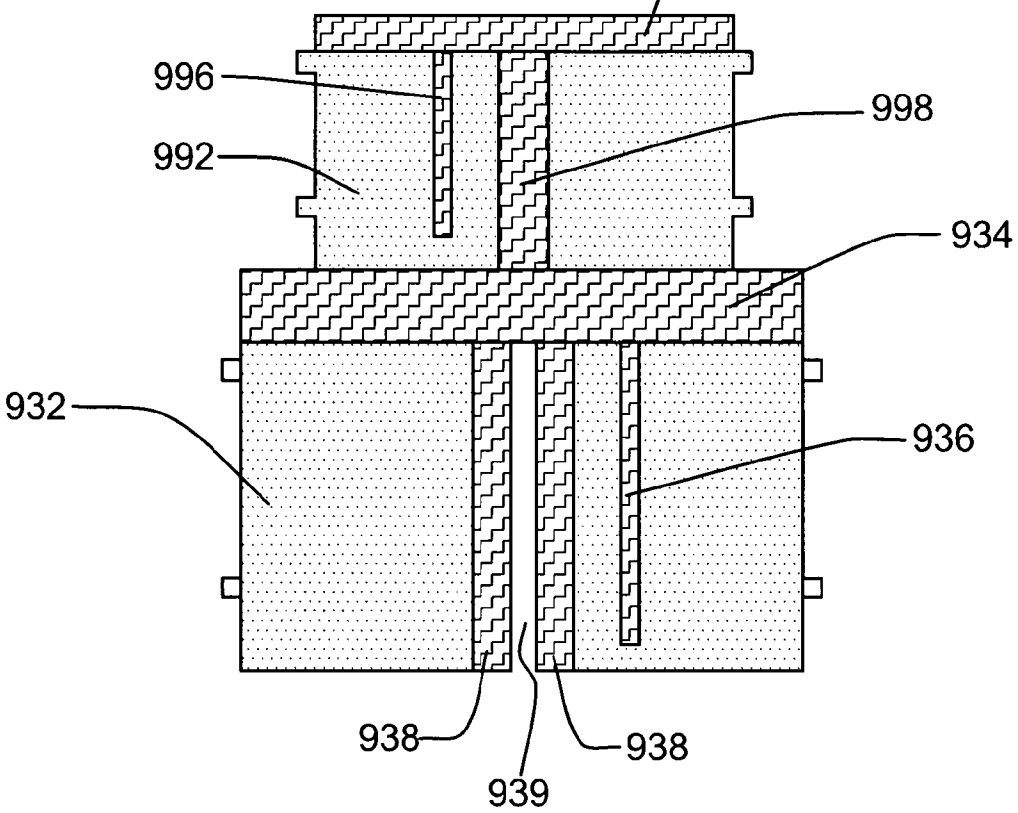

Refer to FIG. 9G. The planar dielectric substrate 932 and the planar dielectric substrate 992 are fabricated as a single planar dielectric substrate. On the planar dielectric substrate 932 are the radiating conductor 934, the conducting strip 938, and the excitation pin 936. On the planar dielectric substrate 992 are the radiating conductor 994, the conducting strip 998, and the excitation pin 996. The slot 939 is used for mounting. The planar dielectric substrate 922 and the planar dielectric substrate 982 interlock orthogonally with the planar dielectric substrate 932 and the planar dielectric substrate 992 via the slot 989 and the slot 939. The conducting strip 928 and the conducting strip 988 can be soldered to the conducting strip 938 and the conducting strip 998 to provide structural reinforcement.

Figure 9H:
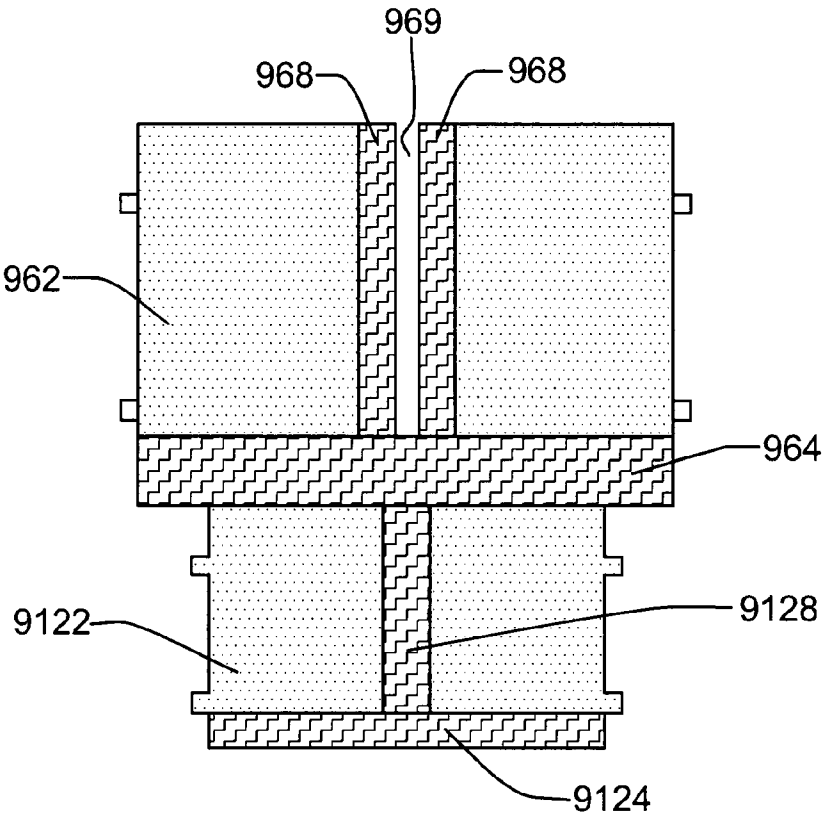

Refer to FIG. 9H. The planar dielectric substrate 962 and the planar dielectric substrate 9122 are fabricated as a single planar dielectric substrate. On the planar dielectric substrate 962 are the radiating conductor 964 and the conducting strip 968; there is no excitation pin. On the planar dielectric substrate 9122 are the radiating conductor 9124 and the conducting strip 9128; there is no excitation pin. The slot 969 is used for mounting.

Figure 9I:
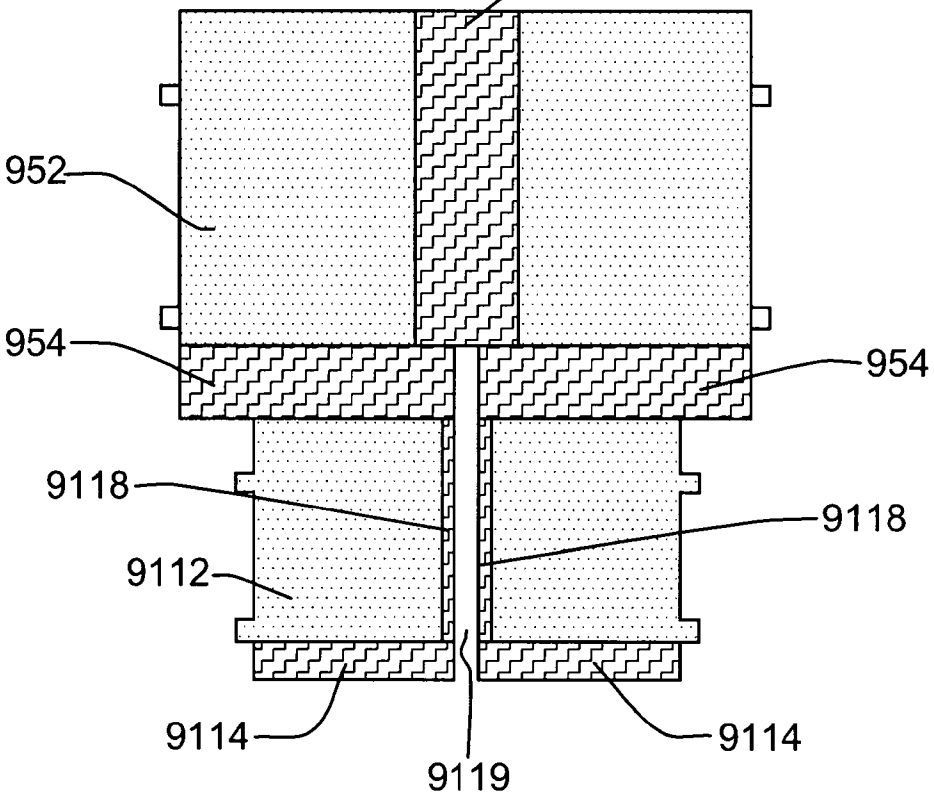

Refer to FIG. 9I. The planar dielectric substrate 952 and the dielectric substrate 9112 are fabricated as a single planar dielectric substrate. On the planar dielectric substrate 952 are the radiating conductor 954 and the conducting strip 958; there is no excitation pin. On the planar dielectric substrate 9112 are the radiating conductor 9114 and the conducting strip 9118; there is no excitation pin. The slot 9119 is used for mounting. The planar dielectric substrate 962 and the planar dielectric substrate 9122 interlock orthogonally with the planar dielectric substrate 952 and the planar dielectric substrate 9112 via the slot 969 and the slot 9119. The conducting strip 968 and the conducting strip 9128 can be soldered to the conducting strip 958 and the conducting strip 9118 to provide structural reinforcement.

Figure 9J:
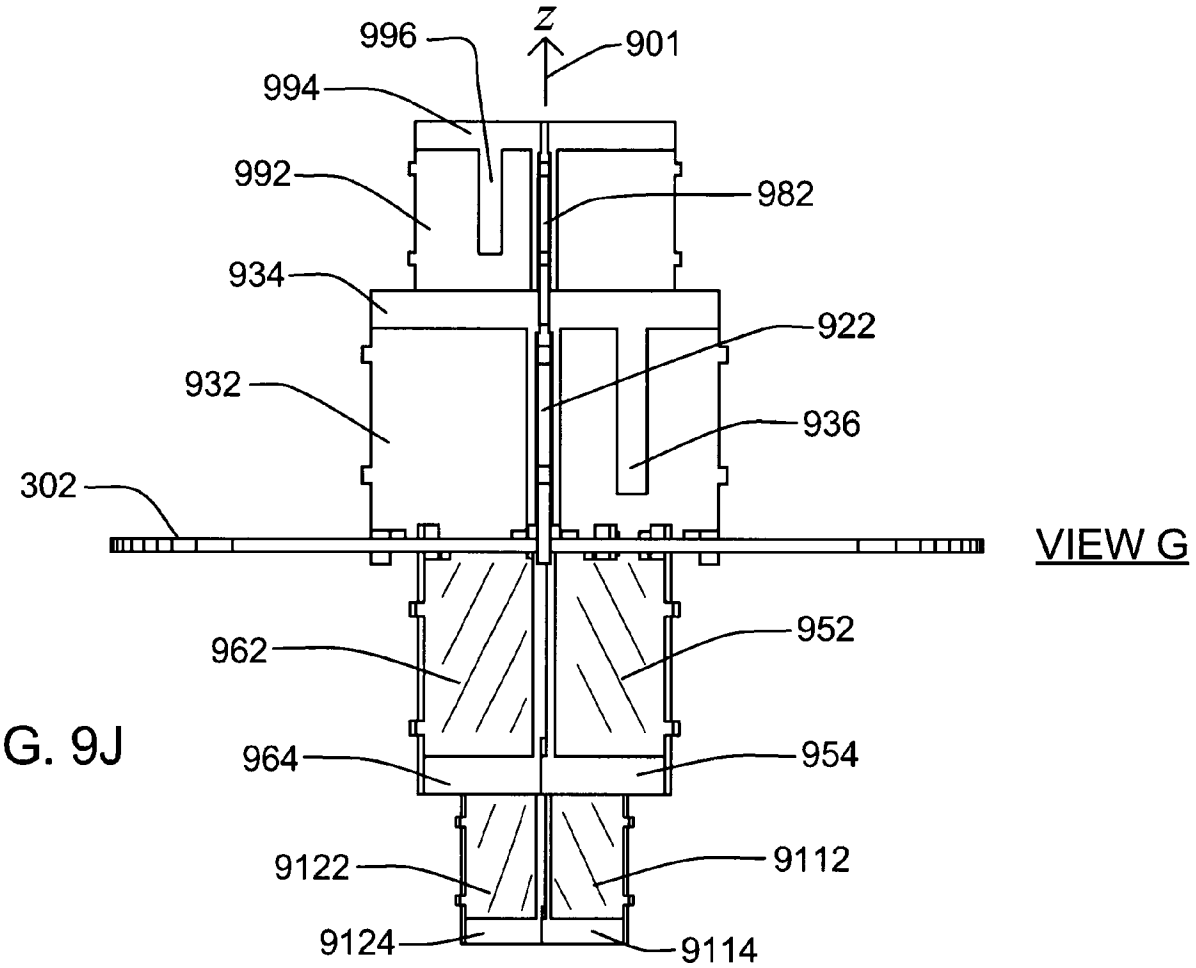

FIG. 9J shows View G of the antenna system 900. FIG. 9J is similar to FIG. 9C, except that the tubular dielectric substrates have been removed to display the planar dielectric substrates within. The planar dielectric substrate 932 and the planar dielectric substrate 992 lie within the plane of the figure. The planar dielectric substrate 922 and the planar dielectric substrate 982 are orthogonal to the plane of the figure. The planar dielectric substrate 952, the planar dielectric substrate 9112, the planar dielectric substrate 962, and the planar dielectric substrate 9122 are oblique to the plane of the figure.

Figure 9L:
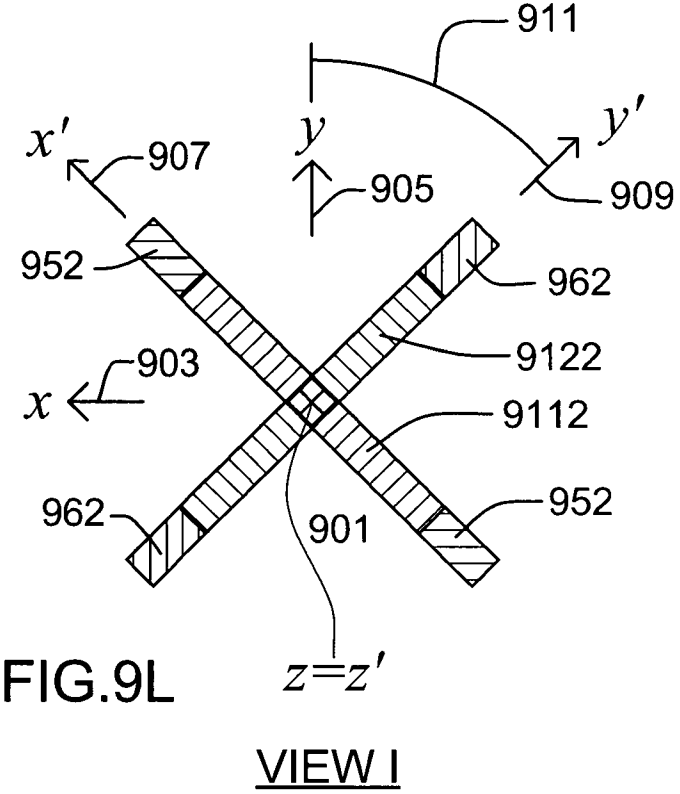
Figure 9K:
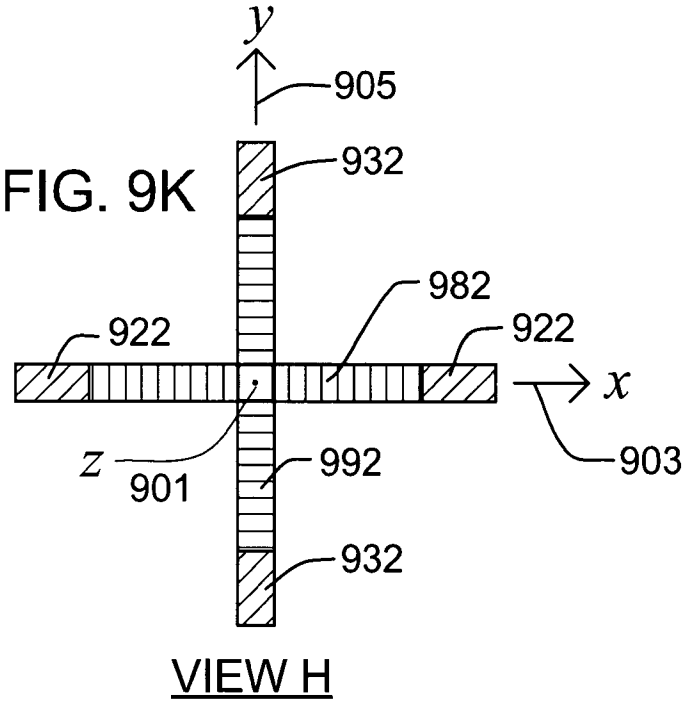

FIG. 9K and FIG. 9L show further views of the planar dielectric substrates.

FIG. 9K shows View H, sighted along the −z axis, of the planar dielectric substrates in the active antennas. The planar dielectric substrate 922 and the planar dielectric substrate 982 are oriented along the x-axis 903. The planar dielectric substrate 932 and the planar dielectric substrate 992 are oriented along the y-axis 905.

FIG. 9L shows View I, sighted along the +z axis, of the planar dielectric substrates in the passive antennas. The planar dielectric substrate 952 and the planar dielectric substrate 9112 are oriented along the x'-axis 907. The planar dielectric substrate 962 and the planar dielectric substrate 9122 are oriented along the y'-axis 909. The z'-axis is coincident with the z-axis 901. The azimuthal angle, measured about the z-axis, between the x-y axes and the x'-y' axes is referenced as angle 911. The angle 911 is variable and set according to design specifications. In an embodiment, the angle 911 is approximately 45 deg.

Figures 10A, 10B, 10C:
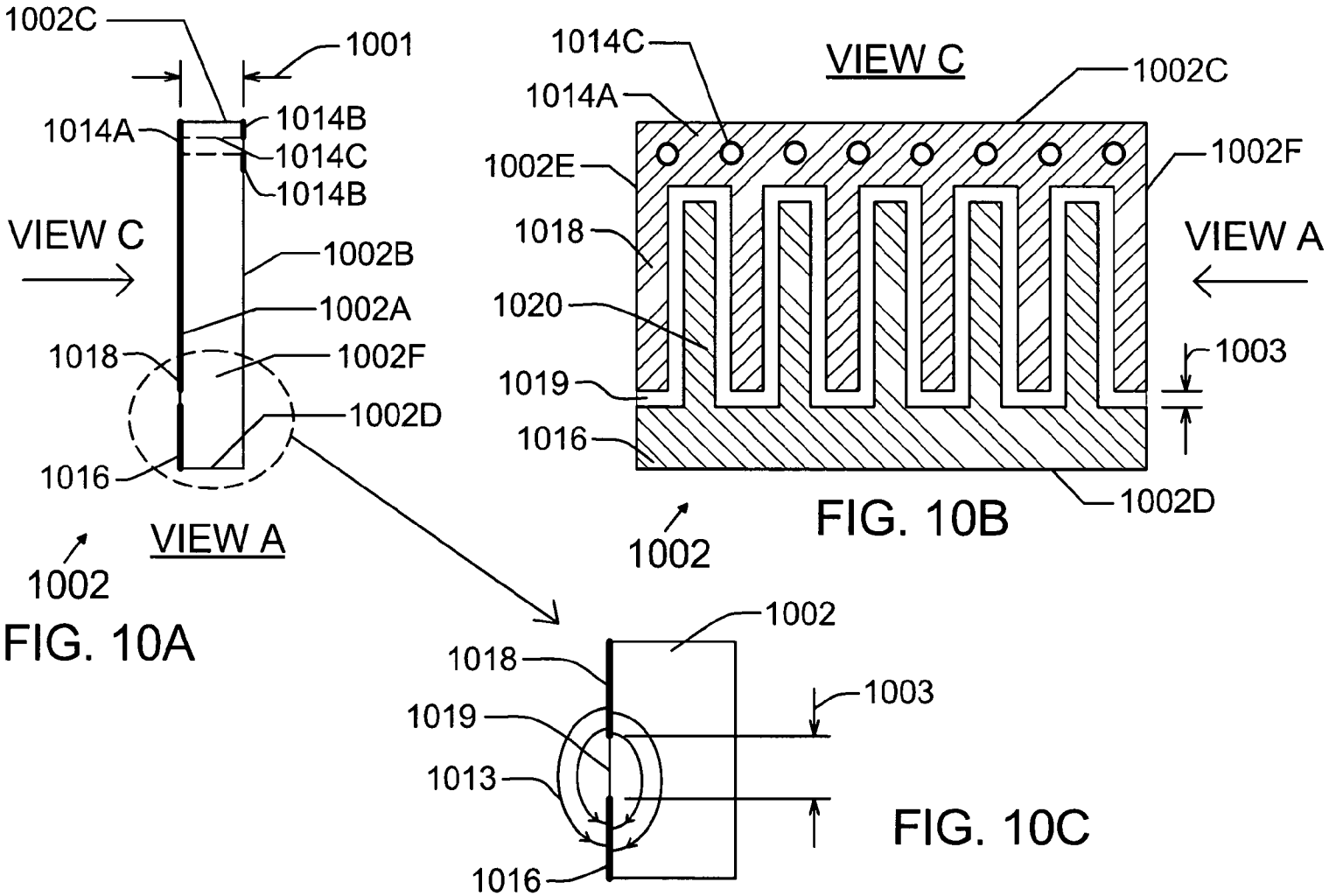
FIG. 10A-FIG. 10C show a schematic of capacitive impedance elements configured on one face of a dielectric substrate.

As discussed above, cross-sectional dimensions of the antenna system can be reduced by configuring sets of impedance elements on the tubular dielectric substrates. FIG. 10A-FIG. 10C show one configuration. FIG. 10A shows an edge view (View A) and FIG. 10B shows a face view (View C) of a dielectric substrate 1002 that is a flexible printed circuit board; the flexible printed circuit board is then rolled into a tube. FIG. 10C shows a magnified view of the gap 1019 (see below).

The dielectric substrate 1002 has a thickness 1001. The dielectric substrate 1002 has a front face 1002A, a rear face 1002B, a top face 1002C, a bottom face 1002D, a left face 1002E, and a right face 1002F. The designations of the faces are used strictly for descriptive reference with respect to the figures. When the dielectric substrate 1002 is rolled into a tube, the front face 1002A becomes the outer wall, and the rear face 1002B becomes the inner wall (compare FIG. 4A and FIG. 4B).

Refer to FIG. 10B. The plane of the figure is the front face 1002A. The hatched regions represent regions with metallization. Along the top edge is the conducting strip 1014A, and along the bottom edge is the conducting strip 1016. When the dielectric substrate 1002 is rolled into a tube, the conducting strip 1014A and the conducting strip 1016 become conducting rings (for example, the conducting ring 314 and the conducting ring 316, respectively, in FIG. 3A). In the example shown, the conducting strip 1014B extends along the top edge of the rear face 1002B (see FIG. 10A). Metallized vias (plated through-holes) 1014C passing through the dielectric substrate 1002 electrically connect the conducting strip 1014B to the conducting strip 1014A. When the dielectric substrate 1002 is rolled into a tube, the conducting strip 1014A and the conducting strip 1014B then become a continuous conducting ring with an outer wall and an inner wall (for example, the conducting ring 314 in FIG. 3A).

The set of impedance elements 1018 is electrically connected to the conducting strip 1014, and the set of impedance elements 1020 is electrically connected to the conducting strip 1016. In this instance, the set of impedance elements 1018 and the set of impedance elements 1020 are interdigitated to form a set of capacitive elements separated by the gap 1019 with a gap spacing 1003.

Figure 11B:
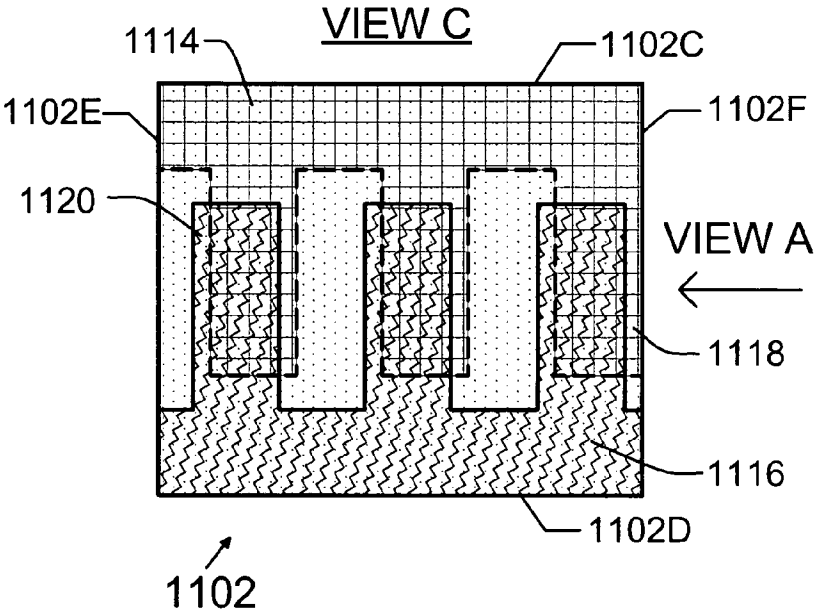
FIG. 11A and FIG. 11B show a schematic of capacitive impedance elements configured on two faces of a dielectric substrate.
Figure 11A:
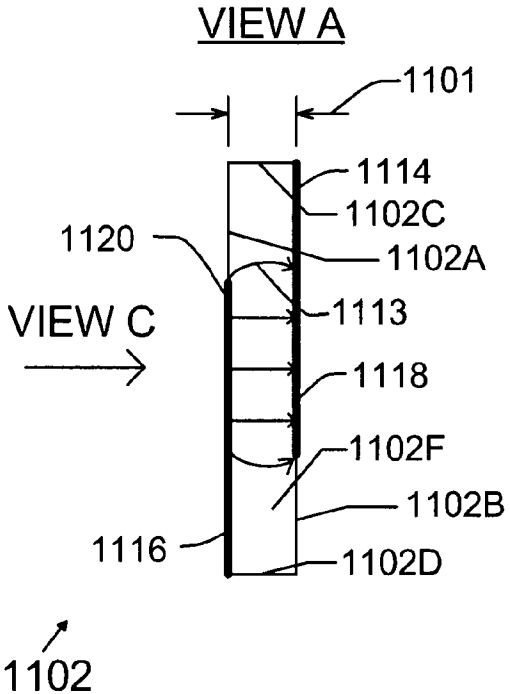

FIG. 11A and FIG. 11B show an alternative configuration of sets of impedance elements. FIG. 11A shows an edge view (View A) and FIG. 11B shows a face view (View C) of a dielectric substrate 1102 that is a flexible printed circuit board. The dielectric substrate 1102 has a thickness 1101. The dielectric substrate 1102 has a front face 1102A, a rear face 1102B, a top face 1102C, a bottom face 1102D, a left face 1102E, and a right face 1102F. When the dielectric substrate 1102 is rolled into a tube, the front face 1102A becomes the outer wall, and the rear face 1102B becomes the inner wall.

Refer to FIG. 11B. The plane of the figure is the front face 1102A. Dotted hatching represents regions of the dielectric substrate 1102 without metallization. Zigzag hatching represents regions of metallization on the front face 1102A. Square grid hatching represents regions of metallization on the rear face 1102B.

The conducting strip 1116 and the set of impedance elements 1120 are disposed on the front face 1102A. The conducting strip 1114 and the set of impedance elements 1118 are disposed on the rear face 1102B. Because the set of impedance elements 1120 and the set of impedance elements 1118 are separated by the dielectric substrate 1102, there are more degrees of freedom in configuring the sets of impedance elements than in the configuration shown in FIG. 10A-FIG. 10C. The set of impedance elements 1120 and the set of impedance elements 1118 form a set of parallel-plate capacitors. The configuration shown in FIG. 11A and FIG. 11B, however, has a higher energy loss than that of the configuration shown in FIG. 10A-FIG. 10C. In FIG. 11A, the electric field 1113 is confined within the dielectric substrate 1102. The energy loss in a flexible printed circuit board is high. In FIG. 10C, the electric field 1013 is partially within air; the energy loss in air is negligible compared to the energy loss in a flexible printed circuit board.

Figure 12:
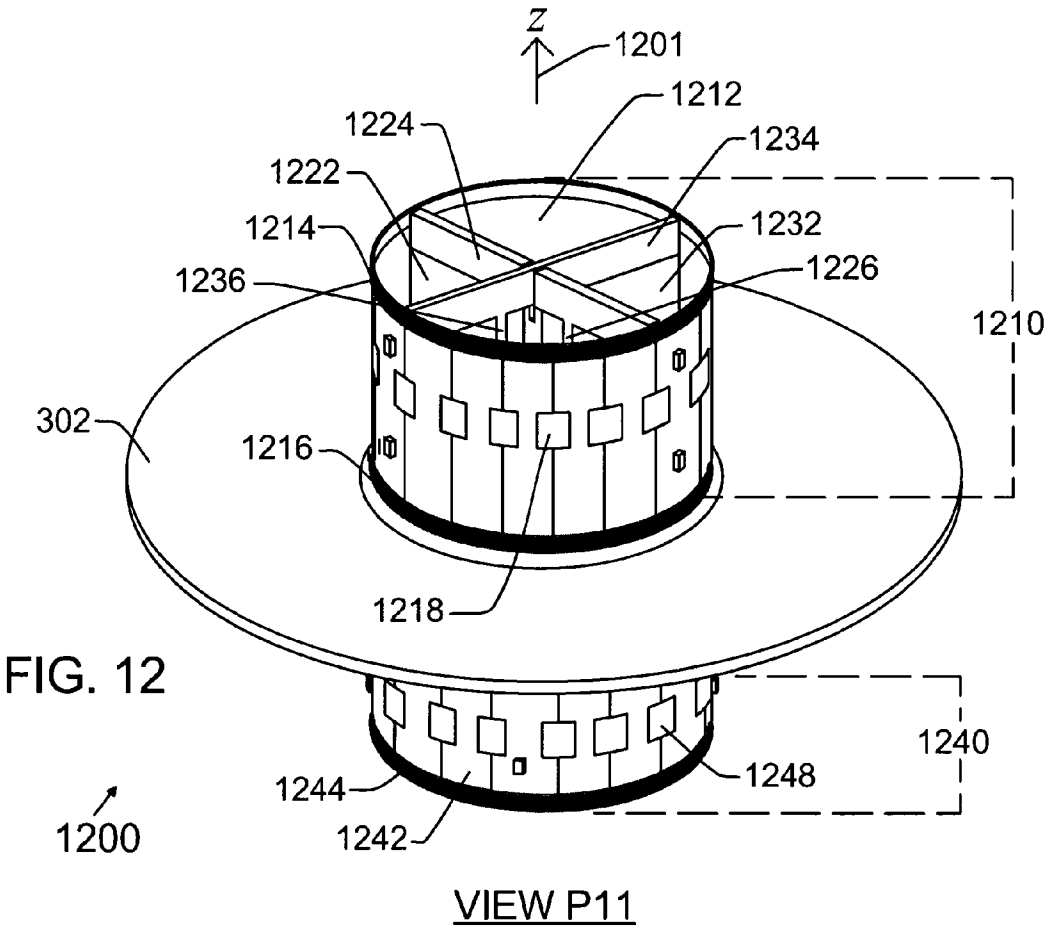
FIG. 12 shows an embodiment of a dual-frequency band antenna for circularly-polarized radiation.

FIG. 12 shows a perspective view (View P11) of a dual-frequency band antenna system configured for circularly-polarized radiation. The antenna system 1200 includes the dual-frequency active antenna 1210, the dual-frequency passive antenna 1240, and the ground plane 302. The antenna system 1200 is shorter (as measured along the antenna axis 1201) compared to the stacked HF-LF configuration of the dual-frequency band antenna system 900 (FIG. 9A and FIG. 9B).

The active antenna 1210 includes the tubular dielectric substrate 1212. At one end of the tubular dielectric substrate 1212 is the conducting ring 1214. At the other end of the tubular dielectric substrate 1212 is the conducting ring 1216, which is electrically connected to the ground plane 302. Inside the tubular dielectric substrate 1212, there are a pair of planar dielectric substrates. The planar dielectric substrate 1222 and the planar dielectric substrate 1232 are orthogonal to each other. On the planar dielectric substrate 1222 are the radiating conductor 1224 and the excitation pin 1226; as described below, the radiating conductor 1224 and the excitation pin 1226 operate over two frequency bands. The radiating conductor 1224 is electrically connected to the conducting ring 1214. On the planar dielectric substrate 1232 are the radiating conductor 1234 and the excitation pin 1236; as described below, the radiating conductor 1234 and the excitation pin 1236 operate over two frequency bands. The radiating conductor 1234 is electrically connected to the conducting ring 1214.

In this embodiment, in the receive mode, the excitation pin 1226 and the excitation pin 1236 are connected via power lines to input ports of a quadrature combiner. The output port of the quadrature combiner is connected to the input of a low-noise amplifier. The quadrature combiner and the low-noise amplifier have a wide enough bandwidth to process signals from two frequency bands.

The passive antenna 1240 is similar to the active antenna 1210. The passive antenna 1240 includes the tubular dielectric substrate 1242. At one end of the tubular dielectric substrate 1242 is the conducting ring 1244. At the other end of the tubular dielectric substrate 1212 is another conducting ring (not shown), which is electrically connected to the ground plane 302. Inside the tubular dielectric substrate 1212, there are a pair of planar dielectric substrates (not shown), similar to the pair of planar dielectric substrates in the active antenna 1210, except there are no excitation pins. The passive antenna 1240 is driven by the electromagnetic field from the active antenna 1210.

On the tubular dielectric substrate 1212, a set of impedance elements 1218 are electrically connected between the conducting ring 1214 and the conducting ring 1216. Similarly, on the tubular dielectric substrate 1242, a set of impedance elements 1248 are electrically connected between the two conducting rings. Dual-frequency operation of the active antenna 1210 and the passive antenna 1240 is achieved by a specific dependence of the impedance elements on frequency, as discussed in further detail below.

Figure 13:
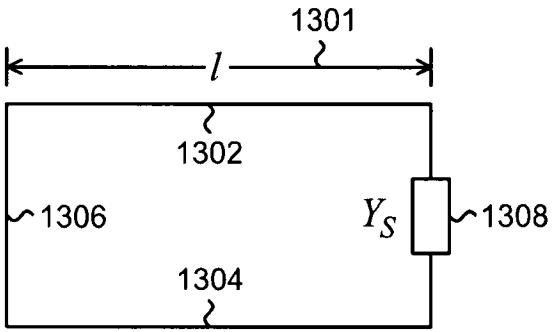
FIG. 13 shows a schematic of an equivalent transmission line model.

Frequency parameters of both the active antenna 1210 and the passive antenna 1240 can be estimated with the equivalent transmission line model shown in FIG. 13. The equivalent transmission line has a leg 1302 and a leg 1304. The length of the leg 1302 and the leg 1304 is l 1301. The length l 1301 is equal to the radius of the conducting ring 1216. The leg 1302 and the leg 1304 are shorted at one end by the short 1306 and loaded at the other end by the admittance $Y_s$ 1308.

The admittance $Y_s$ can be determined approximately as $$Y_s=(N/2)Y_i, \tag{E3}$$

where $Y_i$ is the admittance of a single impedance element 1218 and N is the number of impedance elements 1218.

The resonance condition is determined by setting the sum of the admittance for the leg, $Y_i(f)=-iY_0\mathrm{ctg}(k(f)l)$, and the admittance $Y_s(f)$ to zero:

$$Im(Y_l(f)+Y_s(f))=0, \tag{E4}$$

where $Y_0$ is the wave admittance of the equivalent transmission line;

$$k(f)=\frac{2\pi f}{c}$$

is the wave number; f is the frequency; and C is the speed of wave propagation. The frequency dependence of the admittance $Y_s(f)$ to satisfy condition (E4) must hold for two frequencies $f_1$ and $f_2$ corresponding to average frequencies of the HF and LF bands.

Figure 14:
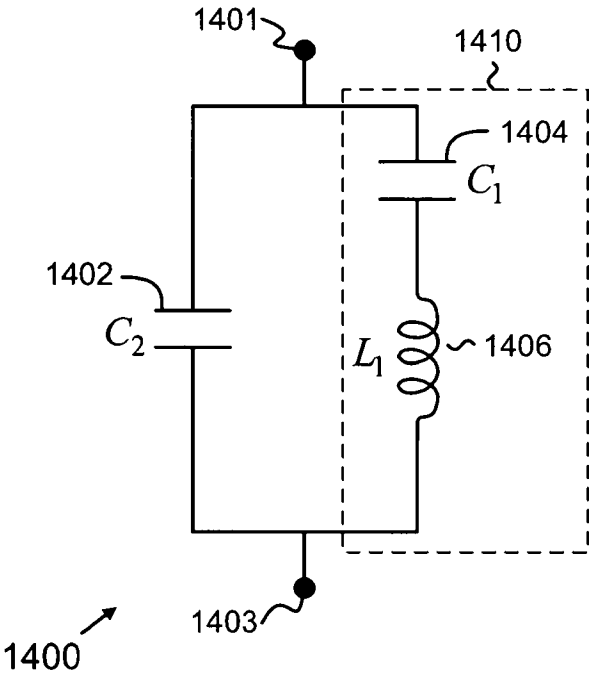
FIG. 14 shows a schematic of an impedance element.

The required frequency dependence can be implemented if each impedance element is configured as a circuit element 1400 as shown in FIG. 14. The circuit element 1400, with termination 1401 and termination 1403, has two parallel branches. One branch has a capacitor $C_2$ 1402. The other branch (referenced as branch 1410) has a capacitor $C_1$ 1404 in series with an inductor $L_1$ 1406.

Figure 15:
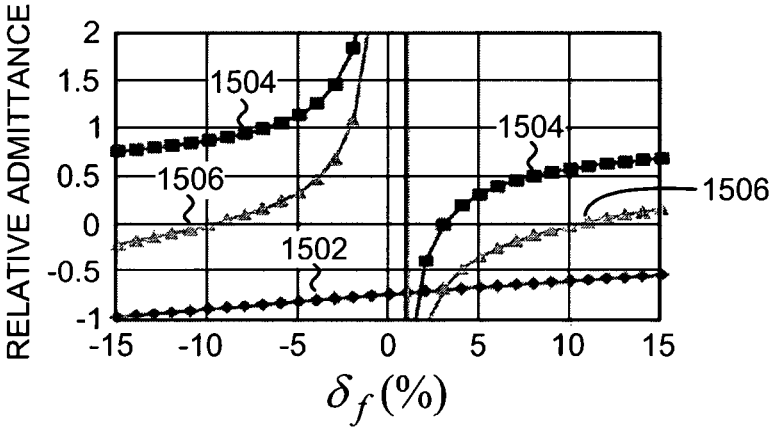
FIG. 15 shows plots of relative admittance as a function of relative frequency mismatch.

FIG. 15 shows examples of frequency dependences for reactive admittance $Y_l$, reactive admittance $Y_s$, and their sum ($Y_l+Y_s$) for the case in which $$l=0.15\lambda_0,$$

$$\frac{Y_{C_1}(f_0)}{Y_0}=0.045,$$

$$\frac{Y_{C_2}(f_0)}{Y_0}=0.75,$$

and $$\frac{Y_{L_1}(f_0)}{Y_0}=0.045.$$

Here, $$f_0=\frac{f_1+f_2}{2}$$

is the central frequency, and $\lambda_0$ is the wavelength in vacuum that corresponds to frequency $f_0$. The argument of the functions is the relative frequency mismatch $$\delta_f=\frac{f-f_0}{f_0}100\%.$$

FIG. 15 shows plots of relative admittances. Plot 1502 corresponds to $\mathrm{Im}(Y_l)/Y_0$; plot 1504 corresponds to $\mathrm{Im}(Y_s)/Y_0$; and plot 1506 corresponds to $\mathrm{Im}(Y_l+Y_s)/Y_0$.

From the plots, it is apparent that, for the frequencies corresponding to $\delta_f=\pm10\%$, $Y_l$ and $Y_s$ have equal values and opposite signs, and their sum $Y_l+Y_S$ at these frequencies is zero; that is, the resonance condition (E4) is satisfied. In the antenna system 1200 with the impedance element 1400, therefore, the resonance condition is satisfied at two frequencies $f_1$ and $f_2$ corresponding to average frequencies of the HF and LF bands, respectively.

Capacitors $C_1$, $C_2$, and inductance $L_1$ can be fabricated in the form of lumped elements (discrete components) within miniature cases or printed elements configured on a dielectric substrate (flexible or rigid). Impedance elements can be attached via lead wires, for example, to the conducting ring 1214 and the ground plane 302. The conducting ring 1214 can be supported by the set of impedance elements, and a substrate (tubular or planar) is not required for support.

An embodiment of a dual-frequency band antenna system similar to the dual-frequency band antenna system 1200 can be configured for linearly-polarized radiation. The active antenna and the passive antenna are each outfitted with a single planar dielectric substrate.

The single-frequency band antenna system 700 (shown in FIG. 7A and FIG. 7B) configured for circularly-polarized radiation can be modified into a dual-frequency band antenna system configured for circularly-polarized radiation by modifying the configuration of the planar dielectric substrates.

Figure 16A:
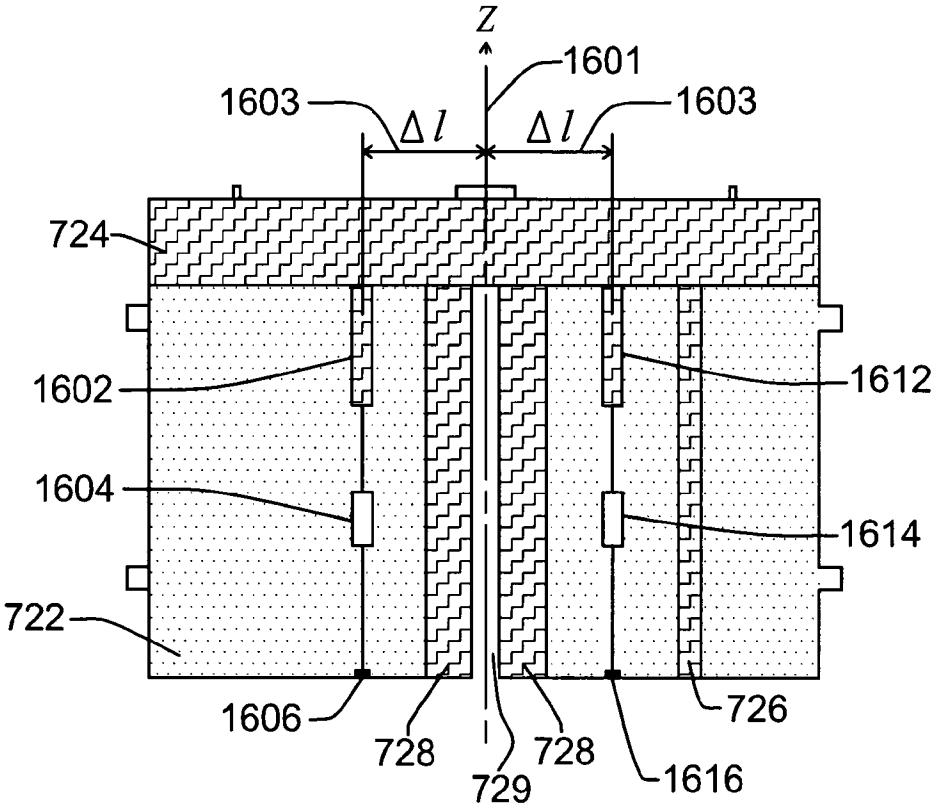
FIG. 16A-FIG. 16D show schematics of dielectric substrates configured with radiators and impedance elements.
Figure 16B:
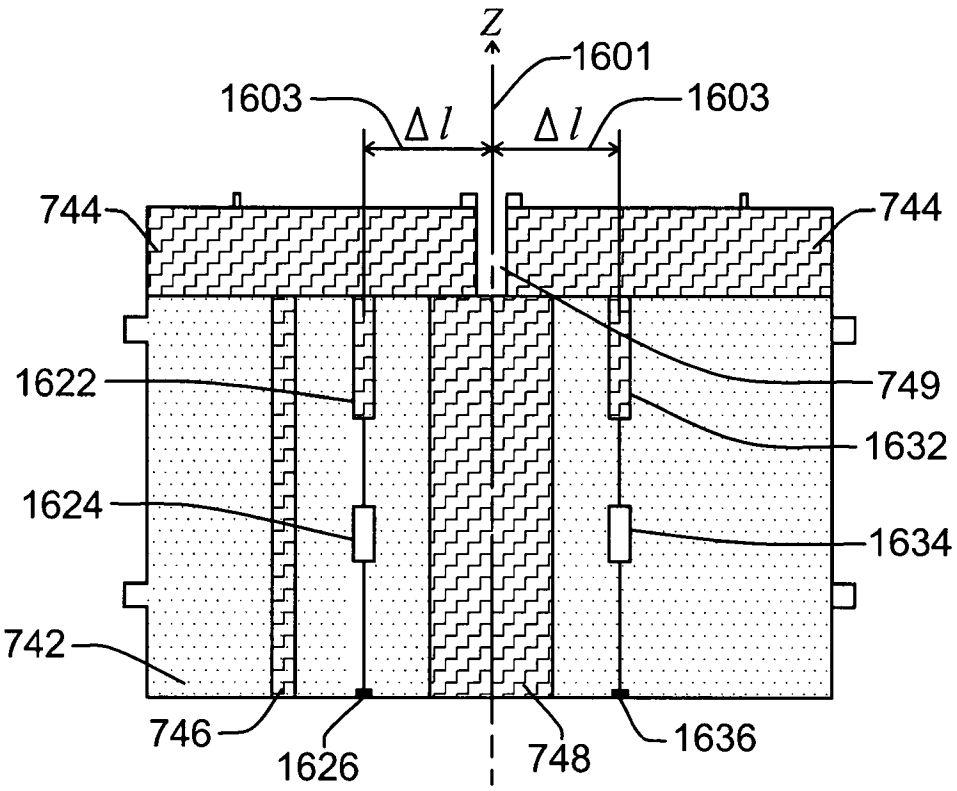
Figure 16C:
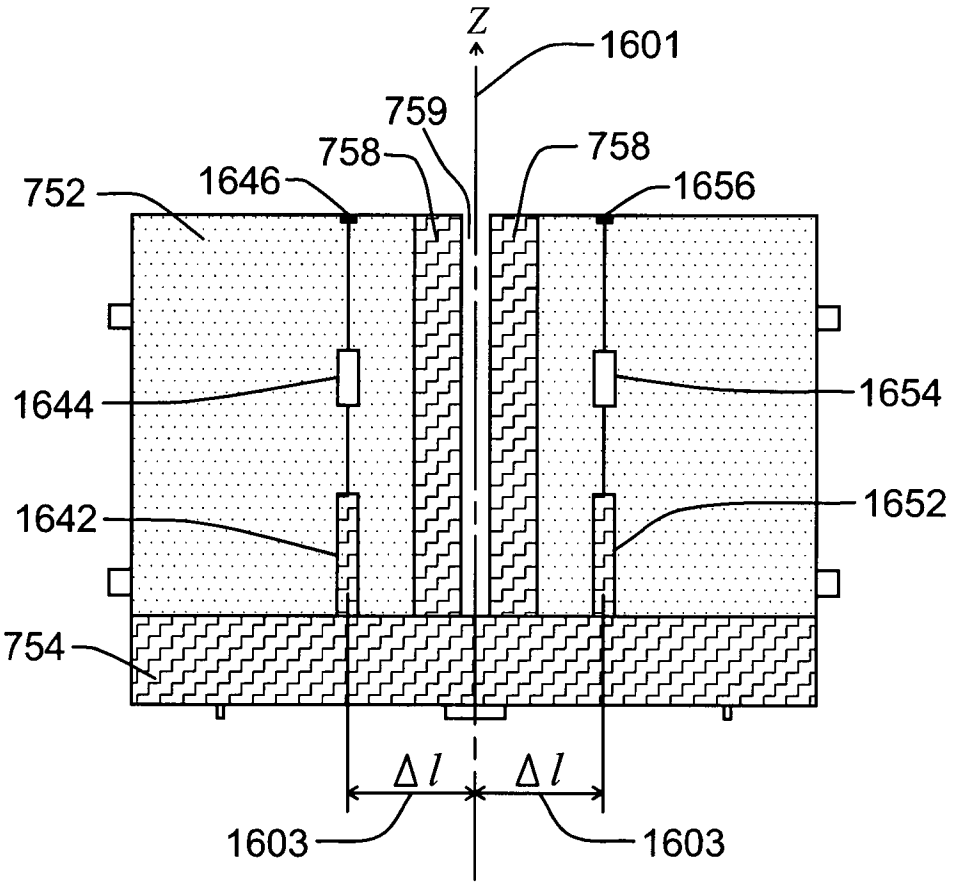
Figure 16D:
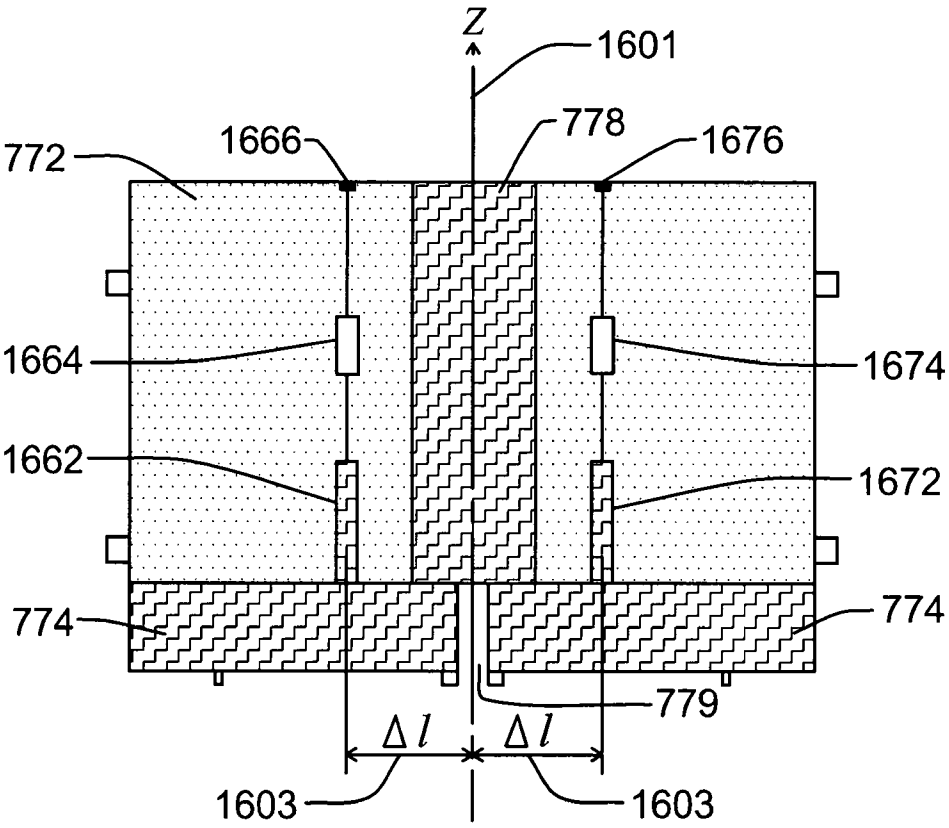

FIG. 16A-FIG. 16D show modifications of the planar dielectric substrates previously shown in FIG. 7D-FIG. 7G, respectively. FIG. 16A and FIG. 16B show the planar dielectric substrates in the active antenna. FIG. 16C and FIG. 16D show the planar dielectric substrates in the passive antenna.

In FIG. 16A, conductor 1602 and conductor 1612, spaced a distance Δl 1603 from the antenna axis 1601, are electrically connected to the radiating conductor 724. A reactive impedance element Z 1604 is electrically connected between the conductor 1602 and the contact pad 1606, which is electrically connected to the ground plane 302. A reactive impedance element Z 1614 is electrically connected between the conductor 1612 and the contact pad 1616, which is electrically connected to the ground plane 302.

In FIG. 16B, conductor 1622 and conductor 1632, spaced a distance Δl 1603 from the antenna axis 1601, are electrically connected to the radiating conductor 744. A reactive impedance element Z 1624 is electrically connected between the conductor 1622 and the contact pad 1626, which is electrically connected to the ground plane 302. A reactive impedance element Z 1634 is electrically connected between the conductor 1632 and the contact pad 1636, which is electrically connected to the ground plane 302.

In FIG. 16C, conductor 1642 and conductor 1652, spaced a distance Δl 1603 from the antenna axis 1601, are electrically connected to the radiating conductor 754. A reactive impedance element Z 1644 is electrically connected between the conductor 1642 and the contact pad 1646, which is electrically connected to the ground plane 302. A reactive impedance element Z 1654 is electrically connected between the conductor 1652 and the contact pad 1656, which is electrically connected to the ground plane 302.

In FIG. 16D, conductor 1662 and conductor 1672, spaced a distance Δl 1603 from the antenna axis 1601, are electrically connected to the radiating conductor 774. A reactive impedance element Z 1664 is electrically connected between the conductor 1662 and the contact pad 1666, which is electrically connected to the ground plane 302. A reactive impedance element Z 1674 is electrically connected between the conductor 1672 and the contact pad 1676, which is electrically connected to the ground plane 302.

Figure 17:
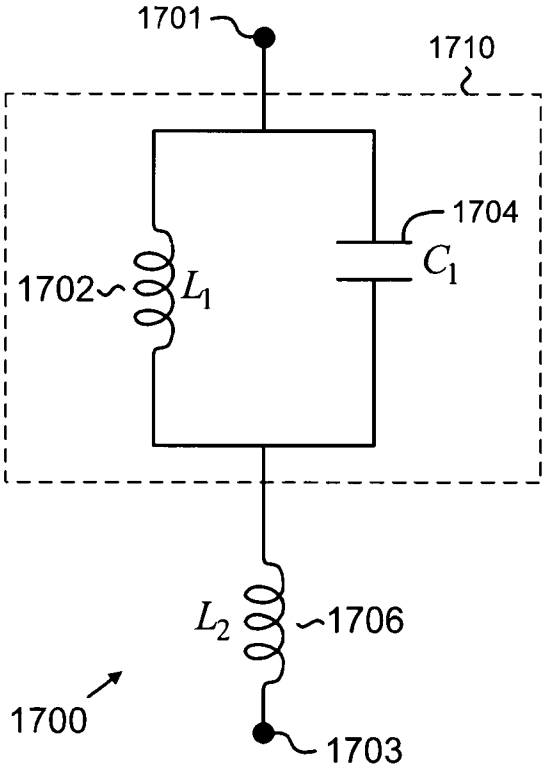
FIG. 17 shows a schematic of an impedance element.

Herein, the reactive impedance elements, Z 1604, Z 1614, Z 1624, Z 1634, Z 1644, Z 1654, Z 1664, and Z 1674 are referred to as frequency-control reactive impedance elements. FIG. 17 shows the circuit configuration of a typical frequency-control reactive impedance element. The frequency-control reactive impedance element Z 1700, with termination 1701 and termination 1703, includes a parallel oscillatory circuit 1710 in series with the inductor $L_2$ 1706. The circuit 1710 includes the inductor $L_1$ 1702 in parallel with the capacitor $C_1$ 1704.

Figure 18:
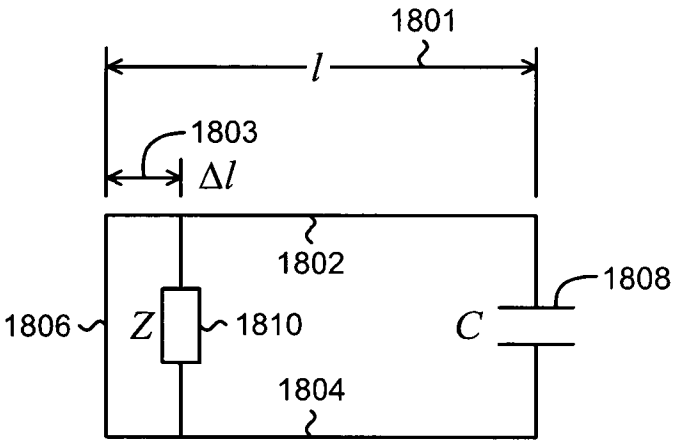
FIG. 18 shows a schematic of an equivalent transmission line model.

An equivalent transmission line diagram for the dual-frequency band antenna is shown in FIG. 18. The transmission line includes the leg 1802 and the leg 1804, each with a length l 1801. One end of the transmission line is loaded with the capacitor C 1808. The value of C is that of the set of impedance elements 318 and the set of impedance elements 320 in FIG. 7A. The other end of the transmission line is shorted with the short 1806. At a distance Δl 1803 from the short 1806, the impedance element Z 1819 is electrically connected across the leg 1802 and the leg 1804.

Figure 19:
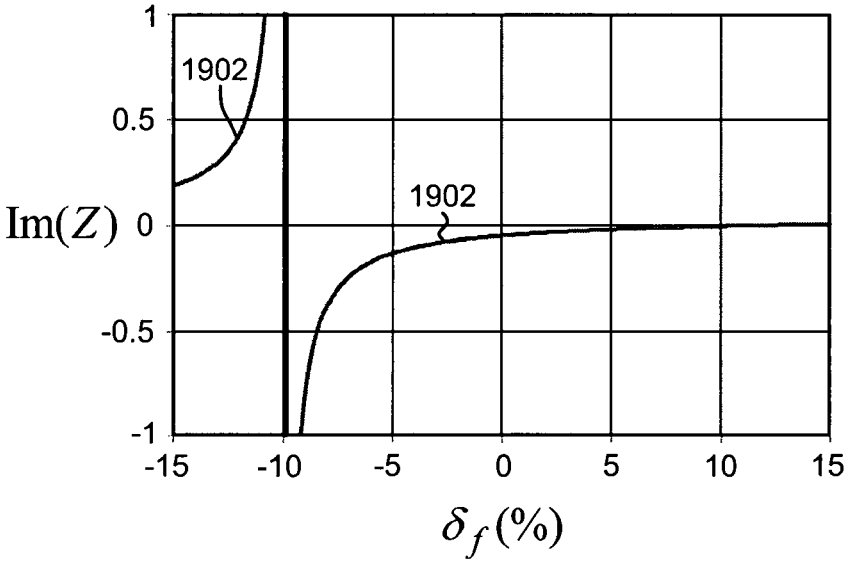
FIG. 19 shows a plot of impedance as a function of relative frequency mismatch.

At the frequency $f_1$, resonance of the parallel circuit 1710 occurs that corresponds to the idling mode (Z=∞) in the section Δl of the transmission line. At the frequency $f_2$, the circuit impedance $C_1L_1$ has a capacitive characteristic. The series-connected inductor $L_2$ 1706 permits resonance to occur: it is equivalent to a short circuit in the section Δl of the transmission line. Therefore, at the frequency $f_1$ the resonance length of the radiator remains unchanged and equal to l; however, at the frequency $f_2$, the equivalent resonance length is reduced to l−Δl. FIG. 19 shows a plot 1902 of the reactive component [IM(Z)] as a function of the relative frequency mismatch $\delta_f$(%). The value of $\delta_f$=−10% corresponds to the frequency $f_1$; the value of $\delta_f$=10% corresponds to the frequency $f_2$.

An embodiment of a dual-frequency band antenna system similar to the dual-frequency band antenna system just described above can be configured for linearly-polarized radiation. The active antenna and the passive antenna are each outfitted with a single planar dielectric substrate.

Figure 20:
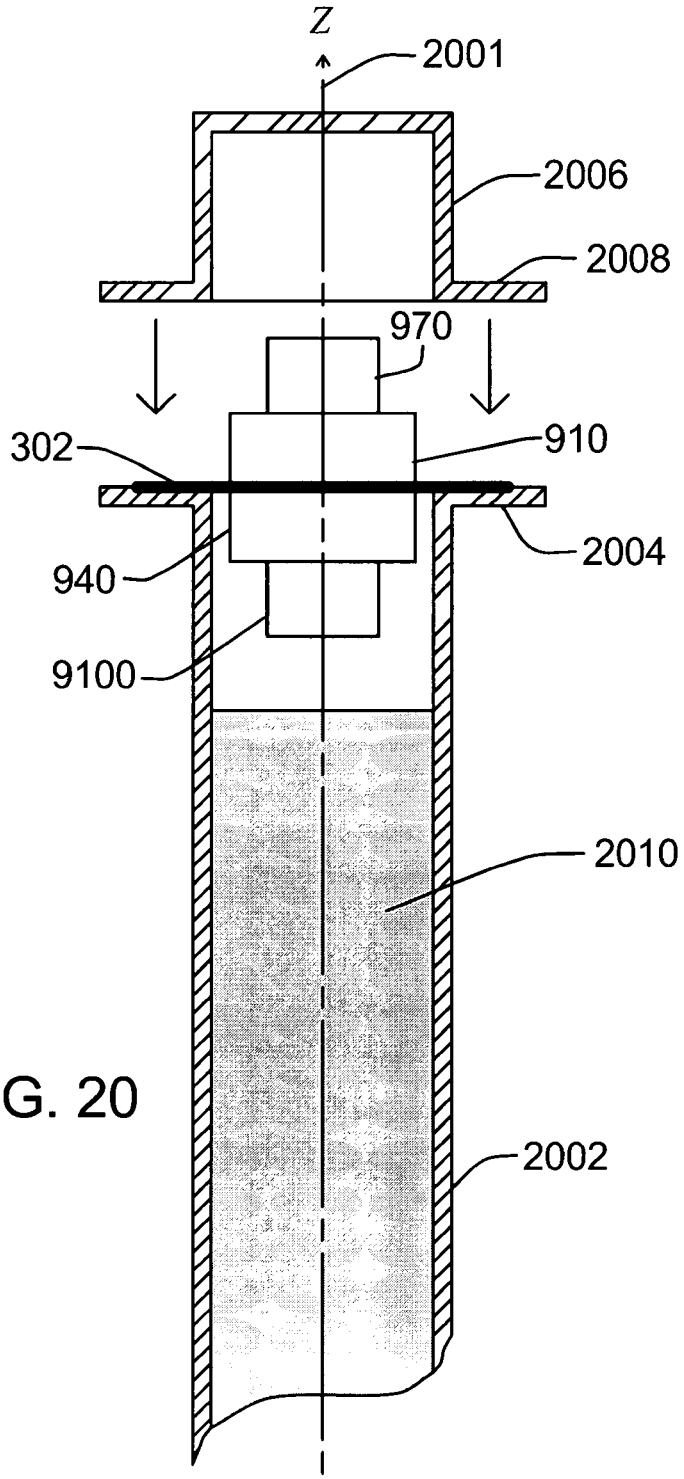
FIG. 20 shows a schematic of an embodiment of an antenna system mounted on a surveying pole.

As discussed above, in surveying applications, an antenna is often mounted on a surveying pole. The compact, lightweight antenna systems described above can all be integrated with a surveying pole (also referred to as a geodetic pole). FIG. 20 shows a cut-away view of a pole-mounted antenna assembly with the z-axis 2001. The pole case 2002 is fitted over the survey pole 2010. The pole case 2002 terminates in the flange 2004. As an example, the antenna system 900 (FIG. 9A) is shown in FIG. 20. The passive antenna 940 and the passive antenna 9100 are inserted in the pole case 2002. The ground plane 302 sits on the flange 2004.

The active antenna 910 and the active antenna 970 sit above the pole case 2002. The active antennas are covered by the antenna housing 2006, which terminates in the flange 2008. The flange 2008 mates with the flange 2004. For simplicity, various mounting hardware is not shown. The pole case 2002 and the antenna housing 2006 are fabricated from material that is substantially transparent to radio-frequency electromagnetic radiation. Examples of suitable materials include Xenoy 5220 and Lexan 143.

As discussed above, the excitation efficiency of a passive antenna is directly related to the distance α between the perimeter of the ground plane and the perimeter of the active antenna. The distance α also determines the maximum cross-sectional dimensions of the antenna system. Presented below is an analysis of the dependence of the operation of the antenna system on the distance a. Design rules are derived for minimizing the distance α while maintaining a high suppression of multipath signals reflected from the backward hemisphere.

As previously presented in (E1), to quantitatively characterize the capability of an antenna to reject or suppress the reflected signal, the following ratio is commonly used:

$$DU(\theta) = \frac{F(-\theta)}{F(\theta)},$$

where θ is measured from the horizon. For satellite applications, the value for the angle θ=90° is often used as a characteristic parameter.

Figure 21B:
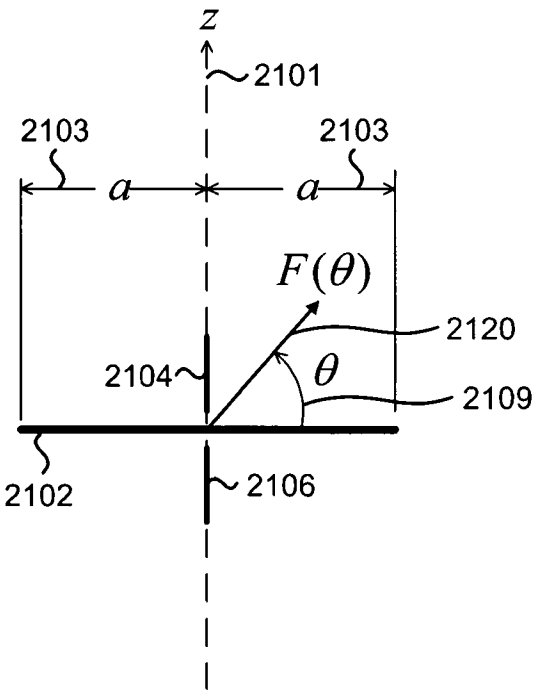
FIG. 21A and FIG. 21B show schematics of a magnetic current model.
Figure 21A:
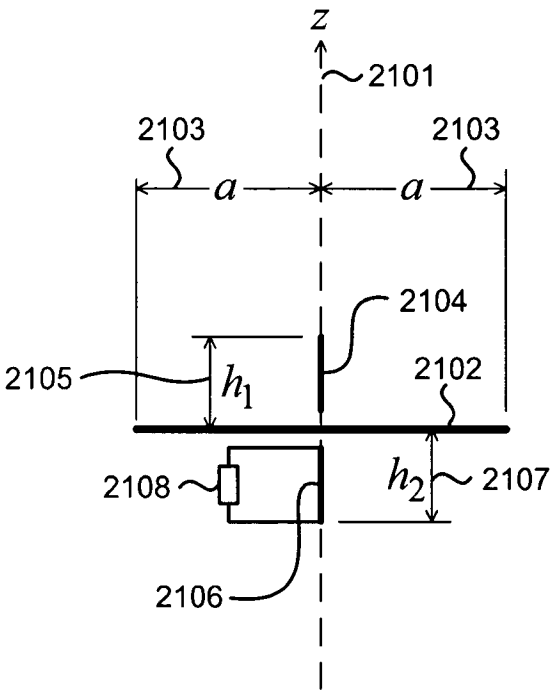

The analysis can be performed using a simplified two-dimensional radiator model, as shown in FIG. 21A. The model includes an ideally-conducting flat surface 2102. The axis 2101 is normal to the flat surface 2102 and passes through its center. The distance between the axis 2101 and the perimeter of the flat surface 2102 is a 2103; the total length of the flat surface 2102 is therefore 2a.

Above the flat surface 2102 is the magnetic current with surface density $j_{m1}$ 2104 (referred to as the upper magnetic current), which simulates an active antenna. Below the flat surface 2102 is the magnetic current with surface density $j_{m2}$ 2106 (referred to as the lower magnetic current), which simulates a passive antenna. The surface densities of these currents are given by $$j_{m1} = \frac{U_1}{h_1}, \tag{E5}$$

and $$j_{m2} = \frac{U_2}{h_2}. \tag{E6}$$

Here $U_1$ and $U_2$ are the equivalent voltages in the area of the impedance elements (for example, the set of impedance elements 918 and the set of impedance elements 920 in the antenna system 900 shown in FIG. 9A). The voltages $U_1$ and $U_2$ determine the amplitudes of the electric fields excited by the active and passive radiators, respectively. The parameters $h_1$ 2105 and $h_2$ 2107 are the vertical sizes of the impedance elements; for this analysis, assume $h_1=h_2=h$.

Assume that the amplitude $U_1$ is a known quantity. The passive antenna is a resonator formed by a set of conductors [for example, in the antenna system 900, the resonator is formed by the radiating conductor 964, the ground plane 302, and the sets of impedance elements on the tubular dielectric substrate 942 (see FIG. 9B and FIG. 9E). The reactive admittance of the resonator is then:

$$y=0+ib. \tag{E7}$$

The value b is determined by structural details of the passive antenna and can be varied according to parameters discussed below. In FIG. 21A, the reactive admittance y is represented by the reactive admittance 2108.

The amplitude $U_2$ characterizes the coupling between the top and bottom radiators:

$$U_2 = -U_1\frac{Y_{12}}{Y_{22}+y}. \tag{E8}$$

Here $Y_{12}$ is the mutual admittance between the upper and lower magnetic currents, and $Y_{22}$ is the radiation admittance of the lower magnetic current.

The field of this system is a sum of the upper and lower magnetic current fields:

$$E=E(j_{m1})+E(j_{m2}). \tag{E9}$$

It then follows that:

$$F(\theta)=U_1F_1(\theta)+U_2F_2(\theta). \tag{E10}$$

Here $F_1(\theta)$ is the directional pattern level of the source $j_{m1}$ with $U_1=1$ and $U_2=0$; and $F_2(\theta)$ is the directional pattern level of the source $j_{m2}$ with $U_2=1$ and $U_1=0$.

As discussed above, the ratio $DU(\theta)$ at $\theta=90°$ is commonly used as a characteristic parameter in satellite applications; this parameter is designate as $DU_{90}$. Then, $$DU_{90} = \frac{F(-90°)}{F(90°)} = \frac{U_1F_1(-90°)+U_2F_2(-90°)}{U_1F_1(90°)+U_2F_2(90°)} \tag{E11}$$

Now let $$A = \frac{F_1(-90°)}{F_2(-90°)}. \tag{E12}$$

If the magnetic currents $j_{m1}$ and $j_{m2}$ are symmetrical relative to the flat surface 2102, then $F_1(90°)=F_2(-90°)$ and $F_1(-90°)=F_2(90°)$. It then follows that $$A = \frac{F_1(-90°)}{F_2(-90°)} = \frac{F_2(90°)}{F_1(90°)}. \tag{E13}$$

From (E11), it then follows that $$DU_{90} = \frac{A+\frac{U_2}{U_1}}{1+A\frac{U_2}{U_1}}. \tag{E14}$$

Assume that the antenna system is designed to minimize the value of $DU_{90}$. Then, in (E14), the numerator needs to be minimized, and the denominator needs to be maximized (that is, the fields of the upper and lower sources need to be subtracted, not added, in the region near the nadir ($\theta=-90°$). If the numerator is set to zero, then $$A = -\frac{U_2}{U_1}. \tag{E15}$$

The denominator can then be expressed as:

$$1+A\frac{U_2}{U_1} = 1-A^2. \tag{E16}$$

The denominator is maximized if $$\arg(A)=\pm\pi/2. \tag{E17}$$

The condition (E15) cannot be fully satisfied, since there is no active component in (E7). The system parameters (the distance a and the reactivity b are therefore selected such that condition (E15) is satisfied as closely as possible.

Figure 22:
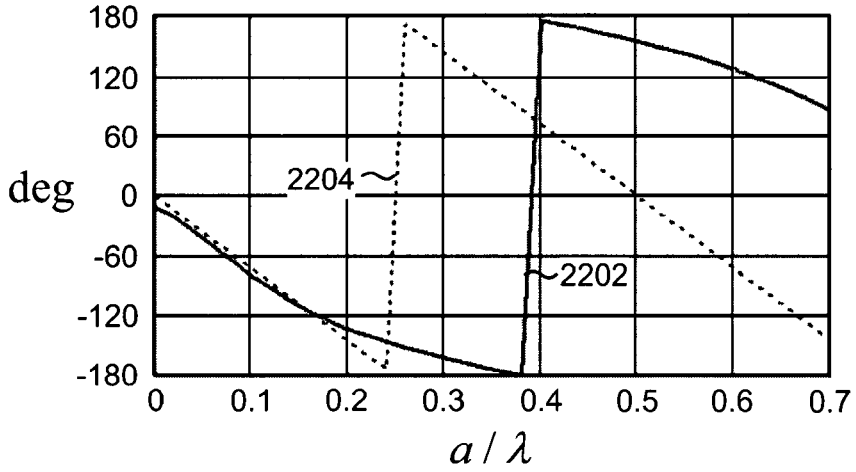
FIG. 22 show plots of antenna parameters as a function of a ground plane dimension.

Consider graphs of dependences for phase and modulus of the coefficient A when the distance a changes. The graphs were obtained by solving numerically the electro-dynamic problem using the moment method. In FIG. 22, plot 2202 shows the dependence of arg(A) (measured in degrees) on $\alpha/\lambda$, where $\lambda$ is the wavelength. For values of $\alpha$ up to $0.15\lambda$, a change in phase varies according to the function $-2ka$ (plot 2204). Here $$k = \frac{2\pi}{\lambda}.$$

The value $$\arg(A) = -\frac{\pi}{2}$$

(condition E17) is reached at $$a \approx 0.125 = \frac{\lambda}{8}. \tag{E18}$$

An expression for the admittance of the passive antenna (E7) needed to tune the system and a achieve a minimum ratio $DU_{90}$ is now derived. Substituting (E15) into (E8) yields $$y = \frac{Y_{12}}{A} - Y_{22}. \tag{E19}$$

The active component of equation (E19) is negative; therefore, condition (E15) for the passive system cannot be satisfied. The active component, however, of the passive antenna admittance can be set to zero (E7). The condition for tuning the passive antenna is then:

$$b = \mathrm{Im}\left(\frac{Y_{12}}{A} - Y_{22}\right).$$

Figure 23:
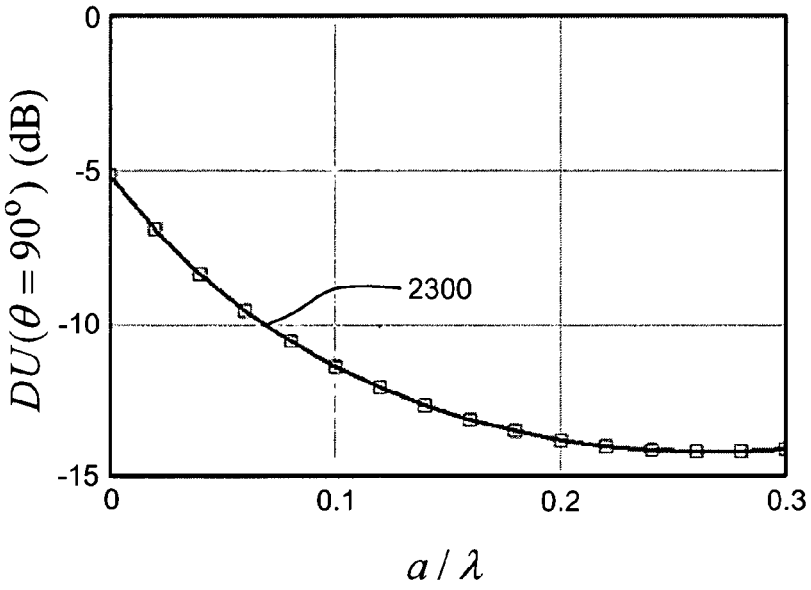
FIG. 23 shows a plot of the down/up ratio as a function of a ground plane dimension.

In FIG. 23, plot 2300 shows the dependence of the down/up ratio $DU_{90}$ (measured in dB) as a function of a (measured in units of the wavelength $\lambda$) when the condition (E20) is satisfied. As a varies over the range $0.1\lambda$-$0.3\lambda$, the value $DU_{90}$ decreases. For values greater than $0.12\lambda$-$0.15\lambda$, the improvement (decrease) becomes slow. Therefore, a length $\alpha=0.12\lambda$-$0.15\lambda$ (approximately 25-35 mm for GPS frequencies) is optimal. This result is in accord with E18.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna system having an antenna axis, the antenna system comprising:

a substantially flat ground plane having a first surface, a second surface, a perimeter, and a normal axis, wherein the normal axis is substantially coincident with the antenna axis;

an active antenna comprising:

a first conducting ring, wherein:

the first conducting ring is substantially parallel to the first surface;

the first conducting ring is spaced apart from the first surface; and the first conducting ring has a first center, wherein the first center is disposed substantially on the antenna axis;

a first radiating conductor having a first end and a second end, wherein:

the first end is electrically connected to a first point on the first conducting ring;

the second end is electrically connected to a second point on the first conducting ring; and the first radiating conductor passes through substantially the first center;

an excitation pin electrically connected to the first radiating conductor; and a first set of reactive impedance elements, wherein, for each reactive impedance element in the first set of reactive impedance elements:

the reactive impedance element is substantially parallel to the antenna axis;

the reactive impedance element has a first termination and a second termination;

the first termination is electrically connected to the first conducting ring;

the second termination is electrically connected to the first surface;

the first termination of any one reactive impedance element is spaced apart from the first termination of any other reactive impedance element; and the second termination of any one reactive impedance element is spaced apart from the second termination of any other reactive impedance element; and a passive antenna comprising:

a second conducting ring, wherein:

the second conducting ring is substantially parallel to the second surface;

the second conducting ring is spaced apart from the second surface; and the second conducting ring has a second center, wherein the second center is disposed substantially on the antenna axis;

a second radiating conductor having a third end and a fourth end, wherein:

the third end is electrically connected to a third point on the second conducting ring;

the fourth end is electrically connected to a fourth point on the second conducting ring; and the second radiating conductor passes through substantially the second center; and a second set of reactive impedance elements, wherein, for each reactive impedance element in the second set of reactive impedance elements:

the reactive impedance element is substantially parallel to the antenna axis;

the reactive impedance element has a third termination and a fourth termination;

the third termination is electrically connected to the second conducting ring;

the fourth termination is electrically connected to the second surface;

the third termination of any one reactive impedance element is spaced apart from the third termination of any other reactive impedance element; and the fourth termination of any one reactive impedance element is spaced apart from the fourth termination of any other reactive impedance element.

2. The antenna system of claim 1, wherein the antenna system is configured for linearly-polarized electromagnetic radiation.

3. The antenna system of claim 1, wherein the first set of reactive impedance elements comprises a set of capacitive impedance elements.

4. The antenna system of claim 3, wherein the set of capacitive impedance elements comprises a set of interdigitated capacitors or a set of parallel-plane capacitors.

5. The antenna system of claim 1, wherein the second set of reactive impedance elements comprises a set of capacitive impedance elements.

6. The antenna system of claim 5, wherein the set of capacitive impedance elements comprises a set of interdigitated capacitors or a set of parallel-plane capacitors.

7. The antenna system of claim 1, wherein:

the active antenna further comprises a tubular dielectric substrate;

the first conducting ring is disposed on the tubular dielectric substrate; and the first set of reactive impedance elements is disposed on the tubular dielectric substrate.

8. The antenna system of claim 1, wherein:

the passive antenna further comprises a tubular dielectric substrate;

the second conducting ring is disposed on the tubular dielectric substrate; and the second set of reactive impedance elements is disposed on the tubular dielectric substrate.

9. The antenna system of claim 1, wherein:

the active antenna further comprises a substantially planar dielectric substrate substantially parallel to the antenna axis;

the first radiating conductor is disposed on the substantially planar dielectric substrate; and the excitation pin is disposed on the substantially planar dielectric substrate.

10. The antenna system of claim 1, wherein:

the passive antenna further comprises a substantially planar dielectric substrate substantially parallel to the antenna axis; and the second radiating conductor is disposed on the substantially planar dielectric substrate.

11. The antenna system of claim 1, wherein the first set of reactive impedance elements and the second set of reactive impedance elements are configured such that, in response to electromagnetic radiation, the antenna operates in a first frequency band and in a second frequency band, wherein any frequency in the second frequency band is higher than any frequency in the first frequency band.

12. The antenna system of claim 11, wherein:

the first frequency band includes frequencies from about 1150 MHz to about 1300 MHz; and the second frequency band includes frequencies from about 1500 MHz to about 1650 MHz.

13. The antenna system of claim 11, wherein each reactive impedance element in the first set of reactive impedance elements and each impedance element in the second set of reactive impedance elements comprises at least one capacitor and at least one inductor.

14. The antenna system of claim 1, wherein:

the active antenna further comprises:

a first frequency-control reactive impedance element, wherein:

the first frequency-control reactive impedance element is substantially parallel to the antenna axis;

the first frequency-control reactive impedance element has a fifth termination and a sixth termination;

the fifth termination is electrically connected to a fifth point on the first radiating conductor;

the sixth termination is electrically connected to a sixth point on the first surface; and the first frequency-control reactive impedance element is disposed between the antenna axis and the excitation pin, wherein a first spacing between the first frequency-control reactive impedance element and the antenna axis is a user-defined spacing value; and a second frequency-control reactive impedance element, wherein:

the second frequency-control reactive impedance element is substantially parallel to the antenna axis;

the second frequency-control reactive impedance element has a seventh termination and an eighth termination;

the seventh termination is electrically connected to a seventh point on the first radiating conductor;

the eighth termination is electrically connected to an eighth point on the first surface; and the second frequency-control reactive impedance element is disposed on a first opposite side of the antenna axis from the first frequency-control reactive impedance element, wherein a second spacing between the second frequency-control reactive impedance element and the antenna axis is substantially equal to the user-defined spacing value; and the passive antenna further comprises:

a third frequency-control reactive impedance element, wherein:

the third frequency-control reactive impedance element is substantially parallel to the antenna axis;

the third frequency-control reactive impedance element has a ninth termination and a tenth termination;

the ninth termination is electrically connected to a ninth point on the second radiating conductor;

the tenth termination is electrically connected to a tenth point on the second surface; and a third spacing between the third frequency-control reactive impedance element and the antenna axis is substantially equal to the user-defined spacing value; and a fourth frequency-control reactive impedance element, wherein:

the fourth frequency-control reactive impedance element is substantially parallel to the antenna axis;

the fourth frequency-control reactive impedance element has an eleventh termination and a twelfth termination;

the eleventh termination is electrically connected to an eleventh point on the second radiating conductor;

the twelfth termination is electrically connected to a twelfth point on the second surface; and the fourth frequency-control reactive impedance element is disposed on a second opposite side of the antenna axis from the third frequency-control reactive impedance element, wherein a fourth spacing between the fourth frequency-control reactive impedance element and the antenna axis is substantially equal to the user-defined spacing value.

15. The antenna system of claim 14 wherein the first frequency-control reactive impedance element, the second frequency-control reactive impedance element, the third frequency-control reactive impedance element, the fourth frequency-control reactive impedance element, and the user-defined spacing value are configured such that, in response to electromagnetic radiation, the antenna system operates in a first frequency band and in a second frequency band, wherein any frequency in the second frequency band is higher than any frequency in the first frequency band.

16. The antenna system of claim 15, wherein:

the first frequency band includes frequencies from about 1150 MHz to about 1300 MHz; and the second frequency band includes frequencies from about 1500 MHz to about 1650 MHz.

17. The antenna system of claim 15, wherein each of the first frequency-control reactive impedance element, the second frequency-control reactive impedance element, the third frequency-control reactive impedance element, and the fourth frequency-control reactive impedance element comprises at least one capacitor and at least one inductor.

18. The antenna system of claim 1, wherein:

the excitation pin is a first excitation pin;

the active antenna further comprises:

a third radiating conductor having a fifth end and a sixth end, wherein:

the fifth end is electrically connected to a fifth point on the first conducting ring;

the sixth end is electrically connected to a sixth point on the first conducting ring;

the third conducting radiator passes through substantially the first center; and the third radiating conductor is substantially orthogonal to the first radiating conductor; and a second excitation pin electrically connected to the third radiating conductor; and the passive antenna further comprises:

a fourth radiating conductor having a seventh end and an eighth end, wherein:

the seventh end is electrically connected to a seventh point on the second conducting ring;

the eighth end is electrically connected to an eighth point on the second conducting ring;

the fourth radiating conductor passes through substantially the second center; and the fourth radiating conductor is substantially orthogonal to the second radiating conductor.

19. The antenna system of claim 18, wherein the antenna system is configured for circularly-polarized electromagnetic radiation.

20. The antenna system of claim 18, wherein the active antenna further comprises:

a first substantially planar dielectric substrate substantially parallel to the antenna axis, wherein:

the first radiating conductor is disposed on the first substantially planar dielectric substrate; and the first excitation pin is disposed on the first substantially planar dielectric substrate; and a second substantially planar dielectric substrate substantially parallel to the antenna axis, wherein:

the third radiating conductor is disposed on the second substantially planar dielectric substrate; and the second excitation pin is disposed on the second substantially planar dielectric substrate.

21. The antenna system of claim 18, wherein the passive antenna further comprises:

a first substantially planar dielectric substrate substantially parallel to the antenna axis, wherein:

the second radiating conductor is disposed on the first substantially planar dielectric substrate; and a second substantially planar dielectric substrate substantially parallel to the antenna axis, wherein:

the fourth radiating conductor is disposed on the second substantially planar dielectric substrate.

22. The antenna system of claim 18, wherein the first set of reactive impedance elements and the second set of reactive impedance elements are configured such that, in response to electromagnetic radiation, the antenna system operates in a first frequency band and in a second frequency band, wherein any frequency in the second frequency band is higher than any frequency in the first frequency band.

23. The antenna system of claim 22, wherein:

the first frequency band includes frequencies from about 1150 MHz to about 1300 MHz; and the second frequency band includes frequencies from about 1500 MHz to about 1650 MHz.

24. The antenna system of claim 22, wherein each reactive impedance element in the first set of reactive impedance elements and each impedance element in the second set of reactive impedance elements comprises at least one capacitor and at least one inductor.

25. The antenna system of claim 18, wherein:

the active antenna further comprises:

a first frequency-control reactive impedance element, wherein:

the first frequency-control reactive impedance element is substantially parallel to the antenna axis;

the first frequency-control reactive impedance element has a fifth termination and a sixth termination;

the fifth termination is electrically connected to a fifth point on the first radiating conductor;

the sixth termination is electrically connected to a sixth point on the first surface; and the first frequency-control reactive impedance element is disposed between the antenna axis and the first excitation pin, wherein a first spacing between the first frequency-control reactive impedance element and the antenna axis is a user-defined spacing value;

a second frequency-control reactive impedance element, wherein:

the second frequency-control reactive impedance element is substantially parallel to the antenna axis;

the second frequency-control reactive impedance element has a seventh termination and an eighth termination;

the seventh termination is electrically connected to a seventh point on the first radiating conductor;

the eighth termination is electrically connected to an eighth point on the first surface; and the second frequency-control reactive impedance element is disposed on a first opposite side of the antenna axis from the first frequency-control reactive impedance element, wherein a second spacing between the second frequency-control reactive impedance element and the antenna axis is substantially equal to the user-defined spacing value; and a third frequency-control reactive impedance element, wherein:

the third frequency-control reactive impedance element is substantially parallel to the antenna axis;

the third frequency-control reactive impedance element has a ninth termination and a tenth termination;

the ninth termination is electrically connected to a ninth point on the third radiating conductor;

the tenth termination is electrically connected to a tenth point on the first surface; and the third frequency-control reactive impedance element is disposed between the antenna axis and the second excitation pin, wherein a third spacing between the third frequency-control reactive impedance element and the antenna axis is substantially equal to the user-defined spacing value; and a fourth frequency-control reactive impedance element, wherein:

the fourth frequency-control reactive impedance element is substantially parallel to the antenna axis;

the fourth frequency-control reactive impedance element has an eleventh termination and a twelfth termination;

the eleventh termination is electrically connected to an eleventh point on the second radiating conductor;

the twelfth termination is electrically connected to a twelfth point on the first surface; and the fourth frequency-control reactive impedance element is disposed on a second opposite side of the antenna axis from the third frequency-control reactive impedance element, wherein a fourth spacing between the fourth frequency-control reactive impedance element and the antenna axis is substantially equal to the user-defined spacing value; and the passive antenna further comprises:

a fifth frequency-control reactive impedance element, wherein:

the fifth frequency-control reactive impedance element is substantially parallel to the antenna axis;

the fifth frequency-control reactive impedance element has a thirteenth termination and a fourteenth termination;

the thirteenth termination is electrically connected to a thirteenth point on the second radiating conductor;

the fourteenth termination is electrically connected to a fourteenth point on the second surface; and a fifth spacing between the fifth frequency-control reactive impedance element and the antenna axis is substantially equal to the user-defined spacing value;

a sixth frequency-control reactive impedance element, wherein:

the sixth frequency-control reactive impedance element is substantially parallel to the antenna axis;

the sixth frequency-control reactive impedance element has a fifteenth termination and a sixteenth termination;

the fifteenth termination is electrically connected to a fifteenth point on the second radiating conductor;

the sixteenth termination is electrically connected to a sixteenth point on the second surface;

the sixth frequency-control reactive impedance element is disposed on a third opposite side of the antenna axis from the fifth frequency-control reactive impedance element, wherein a sixth spacing between the sixth frequency-control reactive impedance element and the antenna axis is substantially equal to the user-defined spacing value;

a seventh frequency-control reactive impedance element, wherein:

the seventh frequency-control reactive impedance element is substantially parallel to the antenna axis;

the seventh frequency-control reactive impedance element has a seventeenth termination and an eighteenth termination;

the seventeenth termination is electrically connected to a seventeenth point on the fourth radiating conductor;

the eighteenth termination is electrically connected to an eighteenth point on the second surface; and a seventh spacing between the seventh frequency-control reactive impedance element and the antenna axis is substantially equal to the user-defined spacing value; and an eighth frequency-control reactive impedance element, wherein:

the eighth frequency-control reactive impedance element is substantially parallel to the antenna axis;

the eighth frequency-control reactive impedance element has a nineteenth termination and a twentieth termination;

the nineteenth termination is electrically connected to a nineteenth point on the fourth radiating conductor;

the twentieth termination is electrically connected to a twentieth point on the second surface;

the eighth frequency-control reactive impedance element is disposed on a fourth opposite side of the antenna axis from the seventh frequency-control reactive impedance element, wherein an eighth spacing between the eighth frequency-control reactive impedance element and the antenna axis is substantially equal to the user-defined spacing value;

wherein:

in response to electromagnetic radiation, the antenna system operates in a first frequency band and in a second frequency band, wherein any frequency in the second frequency band is higher than any frequency in the first frequency band.

26. The antenna system of claim 25, wherein:

the first frequency band includes frequencies from about 1150 MHz to about 1300 MHz; and the second frequency band includes frequencies from about 1500 MHz to about 1650 MHz.

27. The antenna system of claim 25, wherein each of the first frequency-control reactive impedance element, the second frequency-control reactive impedance element, the third frequency-control reactive impedance element, the fourth frequency-control reactive impedance element, the fifth frequency-control reactive impedance element, the sixth frequency-control reactive impedance element, the seventh frequency-control reactive impedance element, and the eighth frequency-control reactive impedance element comprises at least one capacitor and at least one inductor.

28. The antenna system of claim 1, further comprising:

a pole case; and an antenna housing;

wherein:

the pole case and the antenna housing comprise a material substantially transparent to radiofrequency electromagnetic radiation;

the passive antenna is inserted into the pole case;

the antenna housing is fitted over the active antenna;

the antenna housing is mated to the pole case; and the pole case is configured to be mounted onto a surveying pole.

29. A dual-frequency band antenna system having an antenna axis, the antenna system comprising:

a substantially flat ground plane having a first surface, a second surface, a perimeter, and a normal axis, wherein the normal axis is substantially coincident with the antenna axis;

a first active antenna comprising:

a first conducting ring, wherein:

the first conducting ring is substantially parallel to the first surface;

the first conducting ring is spaced apart from the first surface;

the first conducting ring has a first center, wherein the first center is disposed substantially on the antenna axis; and the first conducting ring has a first lateral dimension;

a first radiating conductor having a first end and a second end, wherein:

the first end is electrically connected to a first point on the first conducting ring;

the second end is electrically connected to a second point on the first conducting ring; and the first radiating conductor passes through substantially the first center;

a first excitation pin electrically connected to the first radiating conductor; and a first set of reactive impedance elements, wherein, for each reactive impedance element in the first set of reactive impedance elements:

the reactive impedance element is substantially parallel to the antenna axis;

the reactive impedance element has a first termination and a second termination;

the first termination is electrically connected to the first conducting ring;

the second termination is electrically connected to the first surface;

the first termination of any one reactive impedance element is spaced apart from the first termination of any other reactive impedance element; and the second termination of any one reactive impedance element is spaced apart from the second termination of any other reactive impedance element;

a second active antenna comprising:

a second conducting ring, wherein:

the second conducting ring is substantially parallel to the first surface;

the second conducting ring has a second center, wherein the second center is disposed substantially on the antenna axis;

the second conducting ring has a second lateral dimension, wherein the second lateral dimension is less than the first lateral dimension; and the second conducting ring is electrically connected to the first radiating conductor;

a third conducting ring, wherein:

the third conducting ring is substantially parallel to the first surface;

the third conducting ring is spaced apart from the second conducting ring;

the third conducting ring has a third center, wherein the third center is disposed substantially on the antenna axis; and the third conducting ring has a third lateral dimension, wherein the third lateral dimension is substantially equal to the second lateral dimension;

a second radiating conductor having a third end and a fourth end, wherein:

the third end is electrically connected to a third point on the third conducting ring;

the fourth end is electrically connected to a fourth point on the third conducting ring;

the second radiating conductor passes through substantially the third center; and the second radiating conductor is substantially parallel to the first radiating conductor;

a second excitation pin electrically connected to the second radiating conductor; and a second set of reactive impedance elements, wherein, for each reactive impedance element in the second set of reactive impedance elements:

the reactive impedance element is substantially parallel to the antenna axis;

the reactive impedance element has a third termination and a fourth termination;

the third termination is electrically connected to the third conducting ring;

the fourth termination is electrically connected to the second conducting ring;

the third termination of any one reactive impedance element is spaced apart from the third termination of any other reactive impedance element; and the fourth termination of any one reactive impedance element is spaced apart from the fourth termination of any other reactive impedance element;

a first passive antenna comprising:

a fourth conducting ring, wherein:

the fourth conducting ring is substantially parallel to the first surface;

the fourth conducting ring is spaced apart from the second surface;

the fourth conducting ring has a fourth center, wherein the fourth center is disposed substantially on the antenna axis; and the fourth conducting ring has a fourth lateral dimension;

a third radiating conductor having a fifth end and a sixth end, wherein:

the fifth end is electrically connected to a fifth point on the fourth conducting ring;

the sixth end is electrically connected to a sixth point on the fourth conducting ring; and the third radiating conductor passes through substantially the fourth center; and a third set of reactive impedance elements, wherein, for each reactive impedance element in the third set of reactive impedance elements:

the reactive impedance element is substantially parallel to the antenna axis;

the reactive impedance element has a fifth termination and a sixth termination;

the fifth termination is electrically connected to the fourth conducting ring;

the sixth termination is electrically connected to the second surface;

the fifth termination of any one reactive impedance element is spaced apart from the fifth termination of any other reactive impedance element; and the sixth termination of any one reactive impedance element is spaced apart from the sixth termination of any other reactive impedance element; and a second passive antenna comprising:

a fifth conducting ring, wherein:

the fifth conducting ring is substantially parallel to the second surface;

the fifth conducting ring has a fifth center, wherein the fifth center is disposed substantially on the antenna axis;

the fifth conducting ring has a fifth lateral dimension, wherein the fifth lateral dimension is less than the fourth lateral dimension; and the fourth conducting ring is electrically connected to the third radiating conductor;

a sixth conducting ring, wherein:

the sixth conducting ring is substantially parallel to the second surface;

the sixth conducting ring is spaced apart from the fifth conducting ring;

the sixth conducting ring has a sixth center, wherein the sixth center is disposed substantially on the antenna axis; and the sixth conducting ring has a sixth lateral dimension, wherein the sixth lateral dimension is substantially equal to the fifth lateral dimension;

a fourth radiating conductor having a seventh end and an eighth end, wherein:

the seventh end is electrically connected to a seventh point on the sixth conducting ring;

the eighth end is electrically connected to an eighth point on the sixth conducting ring;

the fourth radiating conductor passes through substantially the sixth center; and the fourth radiating conductor is substantially parallel to the third radiating conductor; and a fourth set of reactive impedance elements, wherein, for each reactive impedance element in the fourth set of reactive impedance elements:

the reactive impedance element is substantially parallel to the antenna axis;

the reactive impedance element has a seventh termination and an eighth termination;

the seventh termination is electrically connected to the sixth conducting ring;

the eighth termination is electrically connected to the fifth conducting ring;

the seventh termination of any one reactive impedance element is spaced apart from the seventh termination of any other reactive impedance element; and the eighth termination of any one reactive impedance element is spaced apart from the eighth termination of any other reactive impedance element.

30. The dual-frequency band antenna system of claim 29, wherein:

the first active antenna and the first passive antenna are configured for electromagnetic radiation in a first frequency band; and the second active antenna and the second passive antenna are configured for electromagnetic radiation in a second frequency band, wherein any frequency in the second frequency band is higher than any frequency in the first frequency band.

31. The dual-frequency band antenna system of claim 30, wherein:

the first frequency band includes frequencies from about 1150 MHz to about 1300 MHz; and the second frequency band includes frequencies from about 1500 MHz to about 1650 MHz.

32. The dual-frequency band antenna system of claim 29, wherein the dual-frequency band antenna system is configured for linearly-polarized electromagnetic radiation.

33. The dual-frequency band antenna system of claim 29, wherein the first set of reactive impedance elements comprises a set of capacitive impedance elements.

34. The dual-frequency band antenna system of claim 33, wherein the set of capacitive impedance elements comprises a set of interdigitated capacitors or a set of parallel-plane capacitors.

35. The dual-frequency band antenna system of claim 29, wherein the second set of reactive impedance elements comprises a set of capacitive impedance elements.

36. The dual-frequency band antenna system of claim 35, wherein the set of capacitive impedance elements comprises a set of interdigitated capacitors or a set of parallel-plane capacitors.

37. The dual-frequency band antenna system of claim 29, wherein the third set of reactive impedance elements comprises a set of capacitive impedance elements.

38. The dual-frequency band antenna system of claim 37, wherein the set of capacitive impedance elements comprises a set of interdigitated capacitors or a set of parallel-plane capacitors.

39. The dual-frequency band antenna system of claim 29, wherein the fourth set of reactive impedance elements comprises a set of capacitive impedance elements.

40. The dual-frequency band antenna system of claim 39, wherein the set of capacitive impedance elements comprises a set of interdigitated capacitors or a set of parallel-plane capacitors.

41. The dual-frequency band antenna system of claim 29, wherein:

the first active antenna further comprises a tubular dielectric substrate;

the first conducting ring is disposed on the tubular dielectric substrate; and the first set of reactive impedance elements is disposed on the tubular dielectric substrate.

42. The dual-frequency band antenna system of claim 29, wherein:

the second active antenna further comprises a tubular dielectric substrate;

the second conducting ring is disposed on the tubular dielectric substrate;

the third conducting ring is disposed on the tubular dielectric substrate and the second set of reactive impedance elements is disposed on the tubular dielectric substrate.

43. The dual-frequency band antenna system of claim 29, wherein:

the first passive antenna further comprises a tubular dielectric substrate;

the fourth conducting ring is disposed on the tubular dielectric substrate; and the third set of reactive impedance elements is disposed on the tubular dielectric substrate.

44. The dual-frequency band antenna system of claim 29, wherein:

the second passive antenna further comprises a tubular dielectric substrate;

the fifth conducting ring is disposed on the tubular dielectric substrate;

the sixth conducting ring is disposed on the tubular dielectric substrate and the fourth set of reactive impedance elements is disposed on the tubular dielectric substrate.

45. The dual-frequency band antenna system of claim 29, further comprising a substantially planar dielectric substrate substantially parallel to the antenna axis, wherein:

the first radiating conductor is disposed on the substantially planar dielectric substrate;

the first excitation pin is disposed on the substantially planar dielectric substrate;

the second radiating conductor is disposed on the substantially planar dielectric substrate; and the second excitation pin is disposed on the substantially planar dielectric substrate.

46. The dual-frequency band antenna system of claim 29, further comprising a substantially planar dielectric substrate substantially parallel to the antenna axis, wherein:

the third radiating conductor is disposed on the substantially planar dielectric substrate; and the fourth radiating conductor is disposed on the substantially planar dielectric substrate.

47. The dual-frequency band antenna system of claim 29, wherein:

the first active antenna further comprises:

a fifth radiating conductor having a ninth end and a tenth end, wherein:

the ninth end is electrically connected to a ninth point on the first conducting ring;

the tenth end is electrically connected to a tenth point on the first conducting ring;

the fifth conducting radiator passes through substantially the first center; and the fifth radiating conductor is substantially orthogonal to the first radiating conductor; and a third excitation pin electrically connected to the fifth radiating conductor;

the second active antenna further comprises:

a sixth radiating conductor having an eleventh end and a twelfth end, wherein:

the eleventh end is electrically connected to an eleventh point on the third conducting ring;

the twelfth end is electrically connected to a twelfth point on the third conducting ring;

the sixth conducting radiator passes through substantially the third center; and the sixth radiating conductor is substantially orthogonal to the second radiating conductor; and a fourth excitation pin electrically connected to the sixth radiating conductor;

the first passive antenna further comprises:

a seventh radiating conductor having a thirteenth end and a fourteenth end, wherein:

the thirteenth end is electrically connected to a thirteenth point on the fourth conducting ring;

the fourteenth end is electrically connected to a fourteenth point on the fourth conducting ring;

the seventh radiating conductor passes through substantially the fourth center; and the seventh radiating conductor is substantially orthogonal to the third radiating conductor; and the second passive antenna further comprises:

an eighth radiating conductor having a fifteenth end and a sixteenth end, wherein:

the fifteenth end is electrically connected to a fifteenth point on the sixth conducting ring;

the sixteenth end is electrically connected to a sixteenth point on the sixth conducting ring;

the eighth radiating conductor passes through substantially the sixth center; and the eighth radiating conductor is substantially orthogonal to the fourth radiating conductor.

48. The dual-frequency band antenna system of claim 47, wherein the dual-frequency band antenna system is configured for circularly-polarized electromagnetic radiation.

49. The dual-frequency band antenna system of claim 29, further comprising:

a first substantially planar dielectric substrate substantially parallel to the antenna axis, wherein:

the first radiating conductor is disposed on the first substantially planar dielectric substrate;

the first excitation pin is disposed on the first substantially planar dielectric substrate;

the second radiating conductor is disposed on the first substantially planar dielectric substrate; and the second excitation pin is disposed on the first substantially planar dielectric substrate; and a second substantially planar dielectric substrate substantially parallel to the antenna axis, wherein:

the fifth radiating conductor is disposed on the second substantially planar dielectric substrate;

the third excitation pin is disposed on the second substantially planar dielectric substrate;

the sixth radiating conductor is disposed on the second substantially planar dielectric substrate; and the fourth excitation pin is disposed on the second substantially planar dielectric substrate.

50. The dual-frequency band antenna system of claim 29, further comprising:

a first substantially planar dielectric substrate substantially parallel to the antenna axis, wherein:

the third radiating conductor is disposed on the first substantially planar dielectric substrate; and the fourth radiating conductor is disposed on the first substantially planar dielectric substrate; and a second substantially planar dielectric substrate substantially parallel to the antenna axis, wherein:

the seventh radiating conductor is disposed on the second substantially planar dielectric substrate; and the eighth radiating conductor is disposed on the second substantially planar dielectric substrate.

51. The dual-frequency band antenna system of claim 29, further comprising:

a pole case; and an antenna housing;

wherein:

the pole case and the antenna housing comprise a material substantially transparent to radiofrequency electromagnetic radiation;

the first passive antenna and the second passive antenna are inserted into the pole case;

the antenna housing is fitted over the first active antenna and the second active antenna;

the antenna housing is mated to the pole case; and the pole case is configured to be mounted onto a surveying pole.

* * * * *